US009550096B2

(12) United States Patent
Parsons et al.

(10) Patent No.: US 9,550,096 B2
(45) Date of Patent: Jan. 24, 2017

(54) GOLF CLUB HEADS AND METHODS TO MANUFACTURE GOLF CLUB HEADS

(71) Applicant: Parsons Xtreme Golf, LLC, Scottsdale, AZ (US)

(72) Inventors: Robert R. Parsons, Scottsdale, AZ (US); Bradley D. Schweigert, Scottsdale, AZ (US); Michael R. Nicolette, Scottsdale, AZ (US)

(73) Assignee: Parsons Xtreme Golf, LLC, Scottsdale, AZ (US)

( * ) Notice: Subject to any disclaimer, the term of this patent is extended or adjusted under 35 U.S.C. 154(b) by 0 days.

(21) Appl. No.: 15/040,892

(22) Filed: Feb. 10, 2016

(65) Prior Publication Data

US 2016/0158610 A1 Jun. 9, 2016

Related U.S. Application Data

(60) Continuation-in-part of application No. 14/939,849, filed on Nov. 12, 2015, which is a continuation of application No. 14/615,606, filed on Feb. 6, 2015, now Pat. No. 9,199,140, application No. 15/040,892, which is a continuation-in-part of application No. 29/516,817, filed on Feb. 6, 2015, now Pat. No. Des. 753,251, which is a division of application No. 29/507,474, filed on Oct. 28, 2014, now Pat. No. Des. 724,164, application No. 15/040,892, which is a continuation-in-part of application No. 29/547,662, (Continued)

(51) Int. Cl.
*A63B 53/06* (2015.01)
*A63B 53/04* (2015.01)

(52) U.S. Cl.
CPC ..... *A63B 53/0466* (2013.01); *A63B 53/04* (2013.01); *A63B 53/0475* (2013.01); *A63B 60/54* (2015.10); *A63B 2053/0433* (2013.01); *A63B 2053/0491* (2013.01); *A63B 2060/002* (2015.10); *A63B 2209/00* (2013.01)

(58) Field of Classification Search
CPC ..... A63B 205/0491; A63B 60/54; A63B 2053/0433; A63B 2053/0453; A63B 2053/0491; A63B 53/0475; A53B 53/0475
USPC ..... 473/332, 334–339, 345, 349
See application file for complete search history.

(56) References Cited

U.S. PATENT DOCUMENTS 1,133,129 A 3/1915 Govan
1,269,745 A 6/1918 Robertson
(Continued)

OTHER PUBLICATIONS

International Search Report and Written Opinion received in connection with corresponding application No. PCT/US2015/016666, on May 14, 2015 (8 pages).
(Continued)

*Primary Examiner* — Benjamin Layno

(57) ABSTRACT

Embodiments of golf club heads and methods to manufacture golf club heads are generally described herein. In one example, a golf club head may include a body portion and a plurality of weight portions. The body portion may include a front portion, a rear portion, a toe portion, a heel portion, a top portion, a bottom portion having an outer surface associated with an outer surface curve, and a weight port region located at or proximate to the bottom portion. Other examples and embodiments may be described and claimed.

17 Claims, 28 Drawing Sheets

Related U.S. Application Data filed on Dec. 7, 2015, now Pat. No. Des. 764,614, which is a division of application No. 29/537,455, filed on Aug. 26, 2015, now Pat. No. Des. 746,927, which is a continuation-in-part of application No. 29/533,540, filed on Jul. 17, 2015, now abandoned, application No. 15/040,892, which is a continuation-in-part of application No. 29/548,537, filed on Dec. 15, 2015, which is a continuation-in-part of application No. 29/543,195, filed on Oct. 21, 2015, now abandoned.

(60) Provisional application No. 62/115,024, filed on Feb. 11, 2015, provisional application No. 62/120,760, filed on Feb. 25, 2015, provisional application No. 62/138,918, filed on Mar. 26, 2015, provisional application No. 62/184,757, filed on Jun. 25, 2015, provisional application No. 62/194,135, filed on Jul. 17, 2015, provisional application No. 62/195,211, filed on Jul. 21, 2015, provisional application No. 62/244,679, filed on Oct. 21, 2015, provisional application No. 62/245,116, filed on Oct. 22, 2015, provisional application No. 62/042,155, filed on Aug. 26, 2014, provisional application No. 62/048,693, filed on Sep. 10, 2014, provisional application No. 62/101,543, filed on Jan. 9, 2015, provisional application No. 62/105,123, filed on Jan. 19, 2015, provisional application No. 62/109,510, filed on Jan. 29, 2015.

(56) References Cited

U.S. PATENT DOCUMENTS

| | | | | |
|---|---|---|---|---|
| 1,306,029 | A | 6/1919 | Robertson | |
| D55,867 | S | 7/1920 | Mattern | |
| 1,534,600 | A | 4/1925 | Mattern | |
| 1,538,312 | A | 5/1925 | Beat | |
| D138,437 | S | 8/1944 | Link | |
| D138,438 | S | 8/1944 | Link | |
| D138,442 | S | 8/1944 | Link | |
| 3,652,094 | A | 3/1972 | Glover | |
| D240,748 | S | 7/1976 | Bock | |
| 4,085,934 | A | 4/1978 | Churchward | |
| D253,778 | S | 12/1979 | Madison | |
| D307,783 | S | 5/1990 | Linuma | |
| D326,885 | S | 6/1992 | Paul | |
| D351,883 | S | 10/1994 | Solheim et al. | |
| 5,518,243 | A | 5/1996 | Redman | |
| D378,111 | S | 2/1997 | Parente et al. | |
| D384,120 | S | 9/1997 | De La Cruz et al. | |
| 5,788,584 | A | 8/1998 | Parente et al. | |
| D400,625 | S | 11/1998 | Kubica et al. | |
| D400,627 | S | 11/1998 | Kubica et al. | |
| D405,489 | S | 2/1999 | Kubica et al. | |
| D405,492 | S | 2/1999 | Kubica et al. | |
| 5,997,415 | A * | 12/1999 | Wood | A63B 53/04 473/346 |
| D444,830 | S | 7/2001 | Kubica et al. | |
| 6,409,612 | B1 * | 6/2002 | Evans | A63B 53/04 473/324 |
| D478,140 | S | 8/2003 | Burrows | |
| 6,638,182 | B2 | 10/2003 | Kosmatka | |
| 6,773,360 | B2 | 8/2004 | Willett et al. | |
| D508,969 | S | 8/2005 | Hasebe | |
| D513,051 | S | 12/2005 | Barez et al. | |
| D514,179 | S | 1/2006 | Chen et al. | |
| D514,185 | S | 1/2006 | Barez et al. | |
| D520,586 | S | 5/2006 | Bingman | |
| D522,077 | S | 5/2006 | Schweigert et al. | |
| D522,601 | S | 6/2006 | Schweigert et al. | |
| D523,498 | S | 6/2006 | Chen et al. | |
| D526,694 | S | 8/2006 | Schweigert et al. | |
| 7,121,956 | B2 | 10/2006 | Lo | |
| D534,599 | S | 1/2007 | Barez et al. | |
| 7,166,040 | B2 | 1/2007 | Hoffman et al. | |
| D536,401 | S | 2/2007 | Kawami | |
| D536,403 | S | 2/2007 | Kawami | |
| D536,498 | S | 2/2007 | Presnell | |
| 7,186,190 | B1 | 3/2007 | Beach et al. | |
| 7,223,180 | B2 | 5/2007 | Willett et al. | |
| D564,054 | S | 3/2008 | Jertson et al. | |
| D564,055 | S | 3/2008 | Jertson et al. | |
| 7,338,388 | B2 | 3/2008 | Schweigert et al. | |
| 7,347,794 | B2 | 3/2008 | Schweigert | |
| D567,317 | S | 4/2008 | Jertson et al. | |
| D569,933 | S | 5/2008 | Jertson et al. | |
| D569,934 | S | 5/2008 | Jertson et al. | |
| D569,935 | S | 5/2008 | Schweigert et al. | |
| D569,936 | S | 5/2008 | Schweigert et al. | |
| D569,942 | S | 5/2008 | Jertson et al. | |
| D570,937 | S | 6/2008 | Schweigert et al. | |
| D570,938 | S | 6/2008 | Jertson et al. | |
| 7,407,447 | B2 | 8/2008 | Beach et al. | |
| 7,410,425 | B2 | 8/2008 | Willett et al. | |
| 7,410,426 | B2 | 8/2008 | Willett et al. | |
| 7,419,441 | B2 | 9/2008 | Hoffman et al. | |
| 7,448,963 | B2 | 11/2008 | Beach et al. | |
| 7,448,964 | B2 | 11/2008 | Schweigert et al. | |
| 7,530,904 | B2 | 5/2009 | Beach et al. | |
| D594,520 | S | 6/2009 | Schweigert et al. | |
| D594,521 | S | 6/2009 | Jertson et al. | |
| D594,919 | S | 6/2009 | Schweigert et al. | |
| 7,540,811 | B2 | 6/2009 | Beach et al. | |
| D597,620 | S | 8/2009 | Taylor et al. | |
| 7,568,985 | B2 | 8/2009 | Beach et al. | |
| 7,578,753 | B2 | 8/2009 | Beach et al. | |
| D600,297 | S | 9/2009 | Jertson et al. | |
| 7,584,531 | B2 | 9/2009 | Schweigert et al. | |
| 7,588,502 | B2 | 9/2009 | Nishino | |
| 7,591,738 | B2 | 9/2009 | Beach et al. | |
| D603,472 | S | 11/2009 | Schweigert et al. | |
| 7,611,424 | B2 | 11/2009 | Nagai et al. | |
| 7,621,823 | B2 | 11/2009 | Beach et al. | |
| D605,715 | S | 12/2009 | Barez et al. | |
| 7,632,194 | B2 | 12/2009 | Beach et al. | |
| 7,658,686 | B2 | 2/2010 | Soracco | |
| 7,713,142 | B2 | 5/2010 | Hoffman et al. | |
| 7,717,804 | B2 | 5/2010 | Beach et al. | |
| 7,717,805 | B2 | 5/2010 | Beach et al. | |
| D618,746 | S | 6/2010 | Jertson et al. | |
| D618,747 | S | 6/2010 | Schweigert et al. | |
| D618,753 | S | 6/2010 | Jertson et al. | |
| D618,754 | S | 6/2010 | Schweigert et al. | |
| 7,744,484 | B1 | 6/2010 | Chao | |
| 7,798,203 | B2 | 9/2010 | Schweigert et al. | |
| 7,846,041 | B2 | 12/2010 | Beach et al. | |
| D635,626 | S | 4/2011 | Nicolette | |
| 7,927,229 | B2 | 4/2011 | Jertson et al. | |
| D638,893 | S | 5/2011 | Schweigert et al. | |
| D638,896 | S | 5/2011 | Schweigert et al. | |
| 7,963,861 | B2 | 6/2011 | Beach et al. | |
| 8,012,038 | B1 | 9/2011 | Beach et al. | |
| D647,585 | S | 10/2011 | Jertson et al. | |
| D661,751 | S | 6/2012 | Nicolette et al. | |
| D661,756 | S | 6/2012 | Nicolette et al. | |
| 8,257,196 | B1 | 9/2012 | Abbott et al. | |
| 8,257,197 | B2 | 9/2012 | Schweigert | |
| 8,262,506 | B2 | 9/2012 | Watson et al. | |
| D673,630 | S | 1/2013 | Schweigert | |
| D673,632 | S | 1/2013 | Schweigert et al. | |
| 8,371,957 | B2 | 2/2013 | Schweigert et al. | |
| D680,179 | S | 4/2013 | Solheim et al. | |
| 8,414,422 | B2 | 4/2013 | Peralta et al. | |
| 8,485,919 | B2 | 7/2013 | Rice et al. | |
| D691,230 | S | 10/2013 | Chen et al. | |
| 8,562,457 | B2 | 10/2013 | Beach et al. | |
| 8,608,587 | B2 | 12/2013 | Henrikson et al. | |
| 8,628,431 | B2 | 1/2014 | Schweigert et al. | |
| 8,663,026 | B2 | 3/2014 | Blowers et al. | |
| 8,777,778 | B2 | 7/2014 | Solheim et al. | |

(56) References Cited

U.S. PATENT DOCUMENTS

| | | | | |
|---|---|---|---|---|
| 8,784,232 | B2 | 7/2014 | Jertson et al. | |
| 8,790,196 | B2 | 7/2014 | Solheim et al. | |
| 8,808,108 | B2 | 8/2014 | Schweigert | |
| D712,989 | S | 9/2014 | Gillig | |
| 8,826,512 | B2 | 9/2014 | Schweigert | |
| 8,858,362 | B1 | 10/2014 | Leposky et al. | |
| 8,961,336 | B1 | 2/2015 | Parsons et al. | |
| D724,164 | S | 3/2015 | Schweigert et al. | |
| D729,892 | S | 5/2015 | Nicolette et al. | |
| D733,234 | S | 6/2015 | Nicolette | |
| 9,199,140 | B1 | 12/2015 | Schweigert et al. | |
| 9,199,143 | B1 | 12/2015 | Parsons et al. | |
| D753,251 | S | 4/2016 | Schweigert et al. | |
| D756,471 | S | 5/2016 | Nicolette et al. | |
| 2006/0105856 | A1 | 5/2006 | Lo | |
| 2006/0111200 | A1 | 5/2006 | Poynor | |
| 2007/0293344 | A1 | 12/2007 | Davis | |
| 2008/0004133 | A1 | 1/2008 | Schweigert | |
| 2008/0188322 | A1 | 8/2008 | Anderson et al. | |
| 2009/0029795 | A1 | 1/2009 | Schweigert et al. | |
| 2010/0144461 | A1 | 6/2010 | Ban | |
| 2010/0331102 | A1* | 12/2010 | Golden ..... | A63B 53/0466 473/337 |
| 2011/0143858 | A1 | 6/2011 | Peralta et al. | |
| 2012/0202615 | A1 | 8/2012 | Beach et al. | |
| 2013/0303304 | A1 | 11/2013 | Sato | |
| 2015/0231454 | A1 | 8/2015 | Parsons et al. | |

OTHER PUBLICATIONS

International Search Report and Written Opinion received in connection with PCT/US15/42484 on Oct. 19, 2015 (12 pages).

International Search Report and Written Opinion received in connection with PCT Application PCT/US2015042282 on Oct. 13, 2015 (12 pages).

U.S. Appl. No. 29/512,313, Nicolette, "Golf Club Head," filed Dec. 18, 2014.

U.S. Appl. No. 14/667,541, Schweigert et al., "Golf Club Heads and Methods to Manufacture Golf Club Heads," filed Mar. 24, 2015.

U.S. Appl. No. 14/667,546, Schweigert at al., "Golf Club Heads and Methods to Manufacture Golf Club Heads," filed Mar. 24, 2015.

U.S. Appl. No. 14/618,501, Parsons et al., "Golf Club Heads and Methods to Manufacture Golf Club Heads," filed Feb. 10, 2015.

U.S. Appl. No. 29/516,820, Schweigert et al., "Golf Club Head," filed Feb. 6, 2015.

Wall, Jonathan, "Details: Phil's Prototype Mack Daddy PM-Grind Wedge," (http://www.pgatour.com/equipmentreport/2015/01/21/callaway-wedge.html), www.pgatour.com, PGA Tour, Inc., published Jan. 21, 2015.

* cited by examiner

GOLF CLUB HEADS AND METHODS TO MANUFACTURE GOLF CLUB HEADS

CROSS REFERENCE

This application claims the benefits of U.S. Provisional Application No. 62/115,024, filed on Feb. 11, 2015, U.S. Provisional Application No. 62/120,760, filed on Feb. 25, 2015, U.S. Provisional Application No. 62/138,918, filed on Mar. 26, 2015, U.S. Provisional Application No. 62/184,757, filed on Jun. 25, 2015, U.S. Provisional Application No. 62/194,135, filed on Jul. 17, 2015, U.S. Provisional Application No. 62/195,211, filed on Jul. 21, 2015, U.S. Provisional Application No. 62/244,679, filed on Oct. 21, 2015, and U.S. Provisional Application No. 62/245,116, filed on Oct. 22, 2015. This application is a continuation-in-part application of U.S. application Ser. No. 14/939,849, filed on Nov. 12, 2015, which is a continuation application of U.S. application Ser. No. 14/615,606, filed on Feb. 6, 2015, which claims the benefits of U.S. Provisional Application No. 62/042,155, filed on Aug. 26, 2014, U.S. Provisional Application No. 62/048,693, filed on Sep. 10, 2014, U.S. Provisional Application No. 62/101,543, filed on Jan. 9, 2015, U.S. Provisional Application No. 62/105,123, filed on Jan. 19, 2015, and U.S. Provisional Application No. 62/109,510, filed on Jan. 29, 2015. This application is also a continuation-in-part application of U.S. application Ser. No. 29/516,817, filed on Feb. 6, 2015, now U.S. Pat. No. 9,199,140 issued Dec. 1, 2015, which is a divisional application of U.S. application Ser. No. 29/507,474, filed on Oct. 28, 2014. This application is also a continuation-in-part of application of U.S. application Ser. No. 29/547,662, filed on Dec. 7, 2015, which is a divisional application of U.S. application Ser. No. 29/537,455, filed on Aug. 26, 2015, which is a continuation-in-part application of U.S. application Ser. No. 29/533,540, filed on Jul. 17, 2015. This application is also a continuation-in-part application of U.S. application Ser. No. 29/548,537, filed on Dec. 15, 2015, which is a continuation-in-part application of U.S. application Ser. No. 29/543,195, filed on Oct. 21, 2015. The disclosures of the referenced applications are incorporated herein by reference.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to sports equipment, and more particularly, to golf club heads and methods to manufacture golf club heads.

BACKGROUND

In golf, various factors may affect the distance and direction that a golf ball may travel. In particular, the center of gravity (CG) and/or the moment of inertia (MOI) of a golf club head may affect the launch angle, the spin rate, and the direction of the golf ball at impact. Such factors may vary significantly based the type of golf swing.

Figure 1:
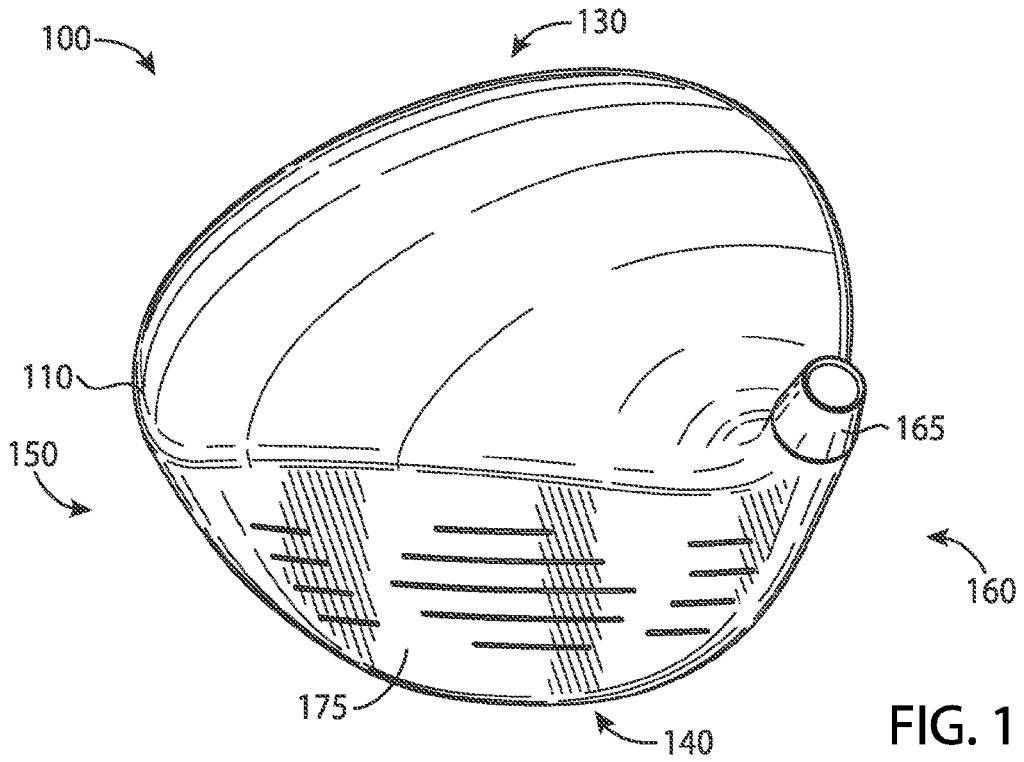
FIG. 1 is top perspective view of an example golf club head according to an embodiment of the apparatus, methods, and articles of manufacture described herein.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure.

DESCRIPTION

In general, golf club heads and methods to manufacture golf club heads are described herein. The apparatus, methods, and articles of manufacture described herein are not limited in this regard.

Figure 2:
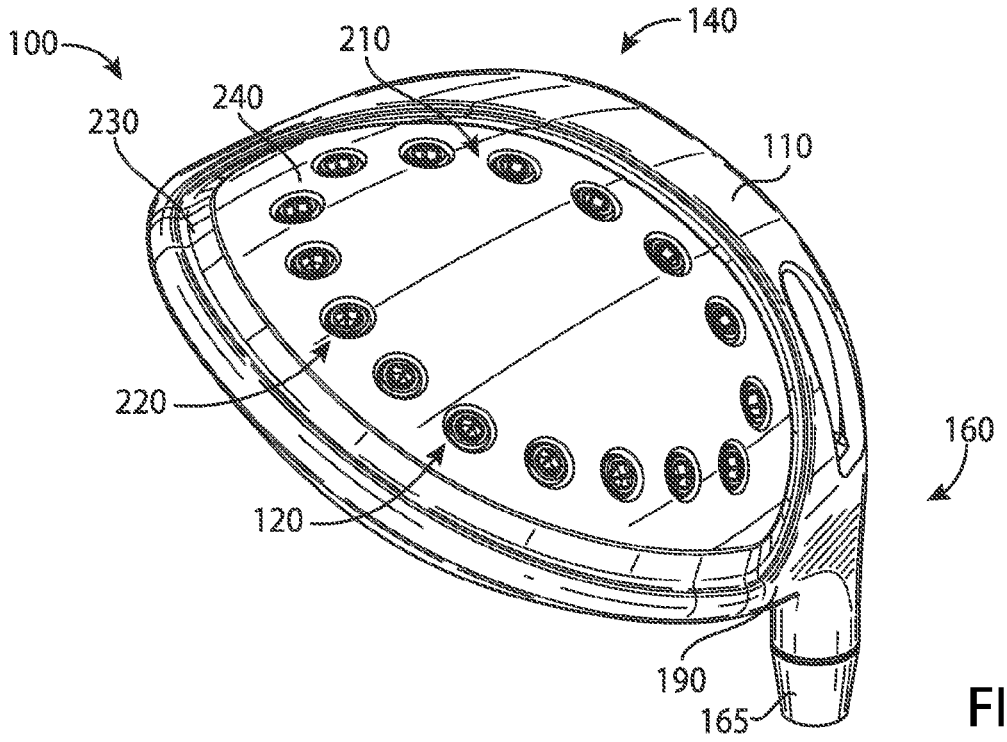
FIG. 2 depicts a bottom perspective view of the example golf club head of FIG. 1.
Figure 3:
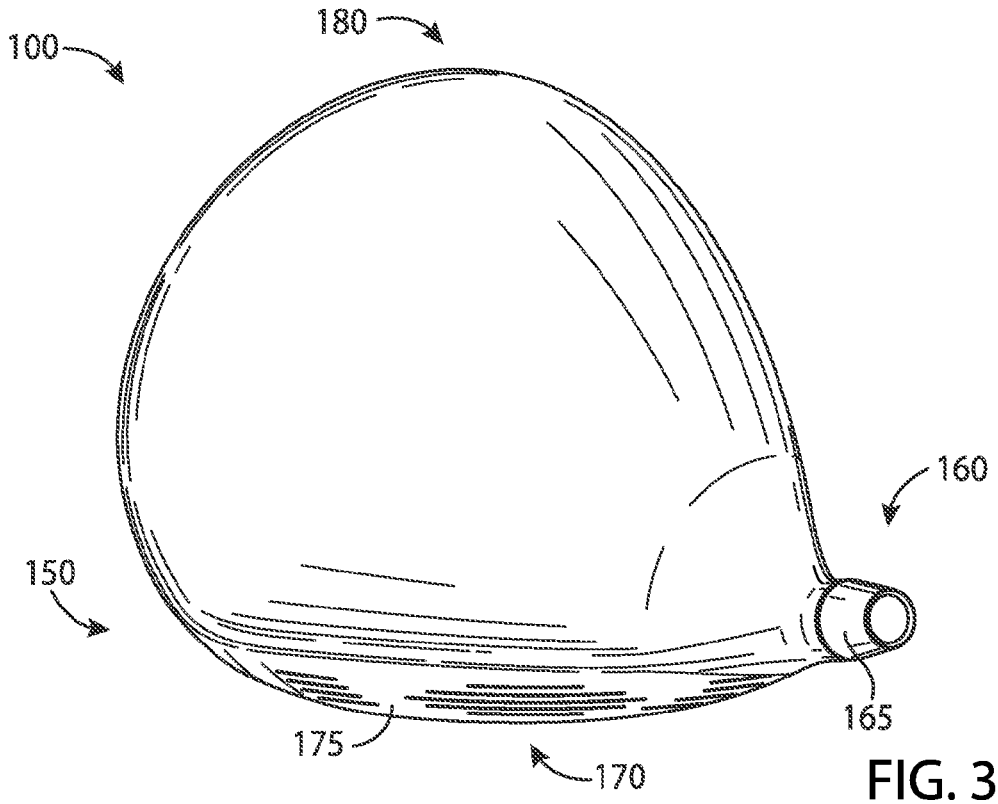
FIG. 3 depicts a top view of the example golf club head of FIG. 1.

In the example of FIGS. 1-13, a golf club head 100 may include a body portion 110, and a plurality of weight portions 120, generally, shown as a first set of weight portions 210 (FIG. 2) and a second set of weight portions 220 (FIG. 2). The body portion 110 may include a top portion 130, a bottom portion 140, a toe portion 150, a heel portion 160, a front portion 170, and a rear portion 180. The bottom portion 140 may include a skirt portion 190 defined as a side portion of the golf club head 100 between the top portion 130 and the bottom portion 140 excluding the front portion 170 and extending across a periphery of the golf club head 100 from the toe portion 150, around the rear portion 180, and to the heel portion 160. The bottom portion 140 may include a transition region 230 and a weight port region 240. For example, the weight port region 240 may be a D-shape region. The weight port region 240 may include a plurality of weight ports 900 (FIG. 9) to receive the plurality of weight portions 120. The front portion 170 may include a face portion 175 to engage a golf ball (not shown). The body portion 110 may also include a hosel portion 165 to receive a shaft (not shown). Alternatively, the body portion 110 may include a bore instead of the hosel portion 165. For example, the body portion 110 may be made partially or entirely of an aluminum-based material, a magnesium-type material, a steel-based material, a titanium-based material, any combination thereof, or any other suitable material. In another example the body portion 110 may be made partially or entirely of a non-metal material such as a ceramic material, a composite material, any combination thereof, or any other suitable material.

The golf club head 100 may have a club head volume greater than or equal to 300 cubic centimeters ($cm^3$ or cc). In one example, the golf club head 100 may be about 460 cc. Alternatively, the golf club head 100 may have a club head volume less than or equal to 300 cc. In particular, the golf club head 100 may have a club head volume between 100 cc and 200 cc. The club head volume of the golf club head 100 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 100. Although FIG. 1 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). The apparatus, methods, and articles of manufacture described herein are not limited in this regard.

Each of the first set of weight portions 210, generally shown as 405, 410, 415, 420, 425, 430, and 435 (FIG. 4), may be associated with a first mass. Each of the second set of weight portions 220, generally shown as 440, 445, 450, 455, 460, 465, 470, 475, and 480 (FIG. 4), may be associated with a second mass. The first mass may be greater than the second mass or vice versa. In one example, the first set of weight portions 210 may be made of a tungsten-based material whereas the second set of weight portions 220 may be made of an aluminum-based material. As described in detail below, the first and second set of weight portions 210 and 220, respectively, may provide various weight configurations (e.g., FIGS. 15-18).

Figure 9:
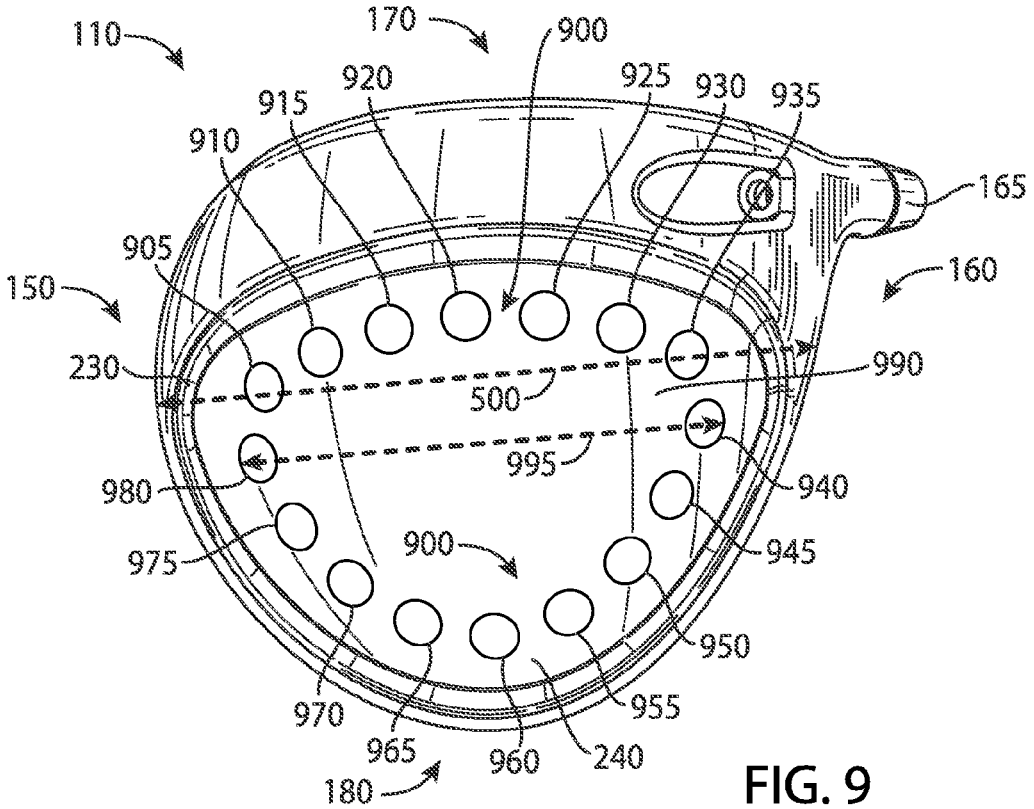
FIG. 9 depicts a bottom view of an example body portion of the example golf club head of FIG. 1.
Figure 10:
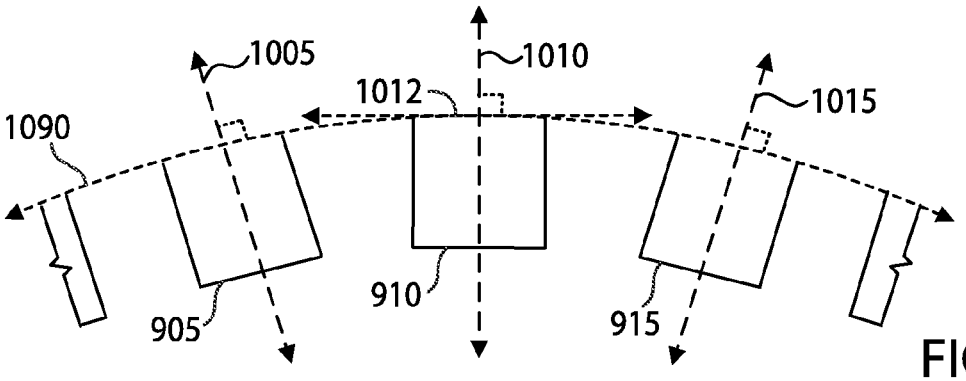
FIG. 10 depicts a cross-sectional view of the example body portion of the example golf club head of FIG. 1.
Figure 11:
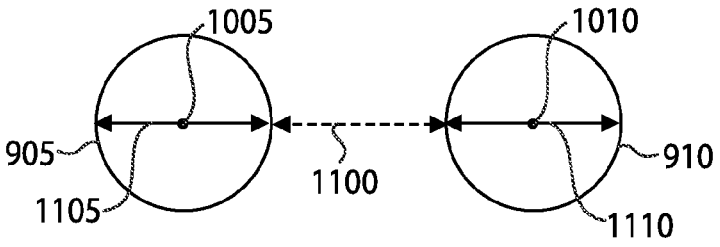
FIG. 11 depicts two weight ports of the example golf club head of FIG. 1.

Referring to FIGS. 9-11, for example, the bottom portion 140 of the body portion 110 may include a plurality of weight ports 900. The plurality of weight ports 900, generally shown as 905, 910, 915, 920, 925, 930, 935, 940, 945, 950, 955, 960, 965, 970, 975, and 980, may be located along a periphery of the weight port region 240 of the bottom portion 140. The plurality of weight ports 900 may extend across the bottom portion 140. In particular, the plurality of weight ports 900 may extend between the toe and heel portions 150 and 160, respectively, across the bottom portion 140. The plurality of weight ports 900 may also extend between the front and rear portions 170 and 180, respectively, across the bottom portion 140. The plurality of weight ports 900 may be arranged across the bottom portion 140 along a path that defines a generally D-shaped loop. In one example, the plurality of weight ports 900 may extend more than 50% of a maximum toe-to-heel distance 500 between of the toe and heel portions 150 and 160, respectively, across the bottom portion 140. The maximum toe-to-heel distance 500 of the golf club head 100 may be measured from transition regions between the top and bottom portions 130 and 140, respectively, at the toe and heel portions 150 and 160, respectively. Alternatively, the maximum toe-to-heel distance 500 may be a horizontal distance between vertical projections of the outermost points of the toe and heel portions 150 and 160, respectively. For example, the maximum toe-to-heel distance 500 may be measured when the golf club head 100 is at a lie angle 510 of about 60 degrees. If the outermost point of the heel portion 160 is not readily defined, the outermost point of the heel portion 160 may be located at a height 520 of about 0.875 inches (22.23 millimeters) above a ground plane 530 (i.e., a horizontal plane on which the golf club head 100 is lying on). The plurality of weight ports 900 may extend more than 50% of a maximum toe-to-heel club head distance 500 of the golf club head 110. In particular, the plurality of weight ports 900 may extend between the toe portion 150 and the heel portion 160 at a maximum toe-to-heel weight port distance 995, which may be more than 50% of the maximum toe-to-heel club head distance 500 of the golf club head 110. In one example, the maximum toe-to-heel club head distance 500 of the golf club head 110 may be no more than 5 inches (127 millimeters). Accordingly, the plurality of weight ports 900 may extend a weight port maximum toe-to-heel weight port distance of at least 2.5 inches between the toe and heel portions 150 and 160, respectively. A maximum toe-to-heel weight port distance 995 may be the maximum distance between the heel-side boundary of the weight port farthest from the toe portion 150 and the toe-side boundary of the weight port farthest from the heel portion 160. In the example of FIG. 9, the weight port maximum toe-to-heel weight port distance 995 may be the maximum distance between the heel-side boundary of the weight port 940 and toe-side boundary of the weight port 980. For example, the maximum toe-to-heel weight port distance 995 may be about 3.7 inches. As the rules of golf may change from time to time (e.g., new regulations may be adopted or old rules may be eliminated or modified by golf standard organizations and/or governing bodies), the lie angle 510 and/or the height 520 for measuring the maximum toe-to-heel club head distance 500 may also change. The apparatus, methods, and articles of manufacture described herein are not limited in this regard.

Each of the plurality of weight ports 900 may be associated with a port diameter ($D_{port}$) (e.g., two shown as 1105 and 1110 in FIG. 11). For example, the port diameter of each weight port of the plurality of weight ports 900 may be about 0.3 inch (7.65 millimeters). Alternatively, the port diameters of adjacent weight ports may be different. In one example, the weight port 905 may be associated with a port diameter 1105, and the weight port 910 may be associated with a port diameter 1110. In particular, the port diameter 1105 of the weight port 905 may be larger than the port diameter 1110 of the weight port 910 or vice versa. The apparatus, methods, and articles of manufacture described herein are not limited in this regard.

The bottom portion 140 may also include an outer surface 990. As illustrated in FIG. 10, for example, the plurality of weight ports 900 may be formed on the bottom portion 140 relative to an outer surface curve 1090 formed by the outer surface 990. In particular, each of the plurality of weight ports 900 may be associated with a port axis generally shown as 1005, 1010, and 1015. A center of a weight port may define the port axis of the weight port. Each port axis may be perpendicular or substantially perpendicular to a plane that is tangent to the outer surface curve 1090 at the point of intersection of the port axis and the outer surface curve 1090. In one example, substantially perpendicular may refer to a deviation of ±5° from perpendicular. In another example, substantially perpendicular may refer to a deviation of ±3° from perpendicular. The deviation from perpendicular may depend on manufacturing tolerances.

In one example, the port axis 1010 may be perpendicular or substantially perpendicular (i.e., normal) to a tangent plane 1012 of the outer surface curve 1090. Multiple fixtures may be used to manufacture the plurality of weight ports 900 by positioning the golf club head 100 in various positions. Alternatively, the weight ports may be manufactured by multiple-axis machining processes, which may be able to rotate the golf club head around multiple axes to mill away excess material (e.g., by water jet cutting and/or laser cutting) to form the plurality of weight ports 900. Further, multiple-axis machining processes may provide a suitable surface finish because the milling tool may be moved tangentially about a surface. Accordingly, the apparatus, methods, and articles of manufacture described herein may use a multiple-axis machining process to form each of the plurality of weight ports 900 on the bottom portion 140. For example, a five-axis milling machine may form the plurality of weight ports 900 so that the port axis 1000 of each of the plurality weight ports 900 may be perpendicular or substantially perpendicular to the outer surface curve 1090. The tool of the five-axis milling machine may be moved tangentially about the outer surface curve 1090 of the outer surface 990.

Turning to FIG. 11, for example, two adjacent weight ports may be separated by a port distance 1100, which may be the shortest distance between two adjacent weight ports on the outer surface 990. In particular, the port distance 1100 may be less than or equal to the port diameter of any of the two adjacent weight ports. In one example, the port distance 1100 between the weight ports 905 and 910 may be less than or equal to either the port diameter 1105 or the port diameter 1110. The apparatus, methods, and articles of manufacture described herein are not limited in this regard.

The plurality of weight portions 120 may have similar or different physical properties (e.g., density, shape, mass, volume, size, color, etc.). In one example, the first set of weight portions 210 may be a black color whereas the second set of weight portions 220 may be a gray color or a steel color. Some or all of the plurality of weight portions 120 may be partially or entirely made of a metal material such as a steel-based material, a tungsten-based material, an aluminum-based material, any combination thereof or suitable types of materials. Alternatively, some or all of the plurality of weight portions 120 may be partially or entirely made of a non-metal material (e.g., composite, plastic, etc.).

Figure 12:
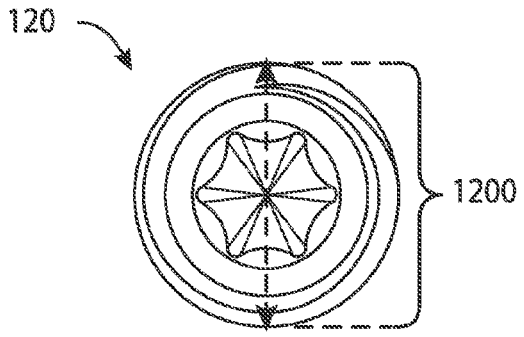
FIG. 12 depicts a top view of an example weight portion of the example golf club head of FIG. 1.
Figure 13:
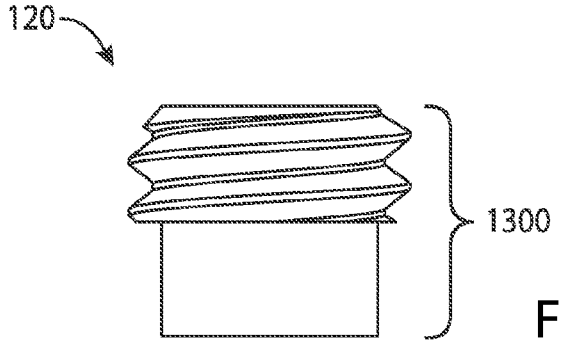
FIG. 13 depicts a side view of the example weight portion of FIG. 10.

In the illustrated example as shown in FIGS. 12 and 13, each weight portion of the plurality of weight portions 120 may have a cylindrical shape (e.g., a circular cross section). Although the above examples may describe weight portions having a particular shape, the apparatus, methods, and articles of manufacture described herein may include weight portions of other suitable shapes (e.g., a portion of or a whole sphere, cube, cone, cylinder, pyramid, cuboidal, prism, frustum, or other suitable geometric shape). Each weight portion of the plurality of weight portions 120 may be associated with a diameter 1200 and a height 1300. In one example, each weight portion of the plurality of weight portions 120 may have a diameter of about 0.3 inch (7.62 millimeters) and a height of about 0.2 inch (5.08 millimeters). Alternatively, the first and second sets of weight portions 210 and 220, respectively, may be different in width and/or height.

Instead of a rear-to-front direction as in other golf club heads, each weight portion of the plurality of weight portions 120 may engage one of the plurality of weight ports 400 in a bottom-to-top direction. The plurality of weight portions 120 may include threads to secure in the weight ports. For example, each weight portion of the plurality of weight portions 120 may be a screw. The plurality of weight portions 120 may not be readily removable from the body portion 110 with or without a tool. Alternatively, the plurality of weight portions 120 may be readily removable (e.g., with a tool) so that a relatively heavier or lighter weight portion may replace one or more of the plurality of weight portions 120. In another example, the plurality of weight portions 120 may be secured in the weight ports of the body portion 110 with epoxy or adhesive so that the plurality of weight portions 120 may not be readily removable. In yet another example, the plurality of weight portions 120 may be secured in the weight ports of the body portion 110 with both epoxy and threads so that the plurality of weight portions 120 may not be readily removable. The apparatus, methods, and articles of manufacture described herein are not limited in this regard.

Figure 14:
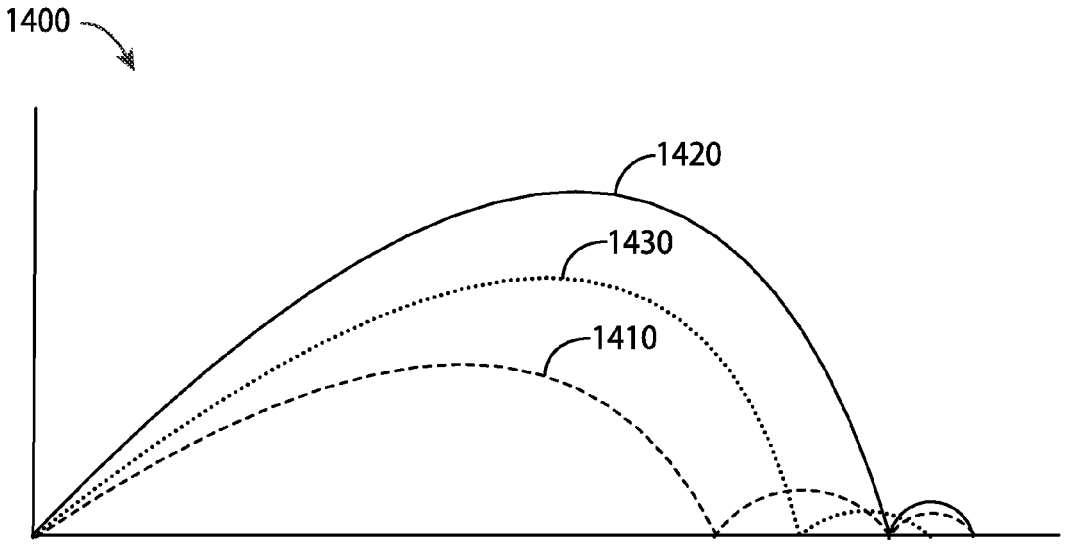
FIG. 14 depicts example launch trajectory profiles of the example golf club head of FIG. 1.
Figure 15:
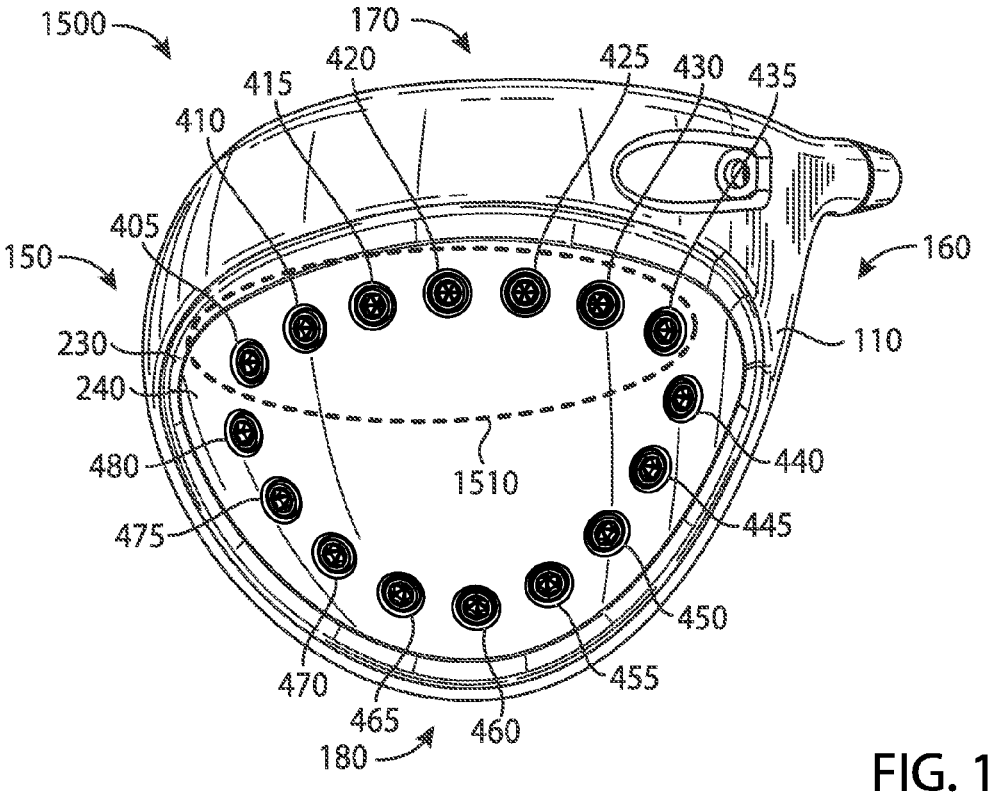
FIG. 15 depicts a first weight configuration of the example weight portions.

In contrast to other golf club heads, the golf club head 100 may accommodate at least four different types of golf swings. As illustrated in FIG. 14, for example, each weight configuration may be associated with one of the plurality of launch trajectory profiles 1400, generally shown as 1410, 1420, and 1430. Referring to FIG. 15, for example, a first weight configuration 1500 may be associated with a configuration of a first set of weight ports 1510. The first set of weight ports 1510 may be located at or proximate to the front portion 170 (e.g., weight ports 905, 910, 915, 920, 925, 930, and 935 shown in FIG. 9). In the first weight configuration 1500, a first set of weight portions may be disposed toward the front portion 170 according to the configuration of the first set of weight ports 1510, whereas a second set of weight portions may be disposed toward the rear portion 180. In particular, the first set of weight portions may form a cluster according to the configuration of the first set of weight ports 1510 at or proximate to the front portion 170. The weight portions 405, 410, 415, 420, 425, 430, and 435 may define the first set of weight portions and may be disposed in weight ports 905, 910, 915, 920, 925, 930, and 935, respectively. The weight portions 440, 445, 450, 455, 460, 465, 470, 475, and 480 may define the second set of weight portions and may be disposed in weight ports 940, 945, 950, 955, 960, 965, 970, 975, and 980, respectively. The first weight configuration 1500 may be associated with the first launch trajectory profile 1410 (FIG. 14). In particular, the first weight configuration 1500 may decrease spin rate of a golf ball. By placing relatively heavier weight portions (i.e., the first set of weight portions) towards the front portion 170 of the golf club head 100 according to the configuration of the first set of weight ports 1510, the center of gravity (GC) of the golf club head 100 may move relatively forward and lower to produce a relatively lower launch and spin trajectory. As a result, the first launch trajectory profile 1410 may be associated with a relatively greater roll distance (i.e., distance after impact with the ground). While the above example may describe the weight portions being disposed in certain weight ports, any weight portion of the first set of weight portions 210 may be disposed in any weight port of the first set of weight ports 1510.

Figure 16:
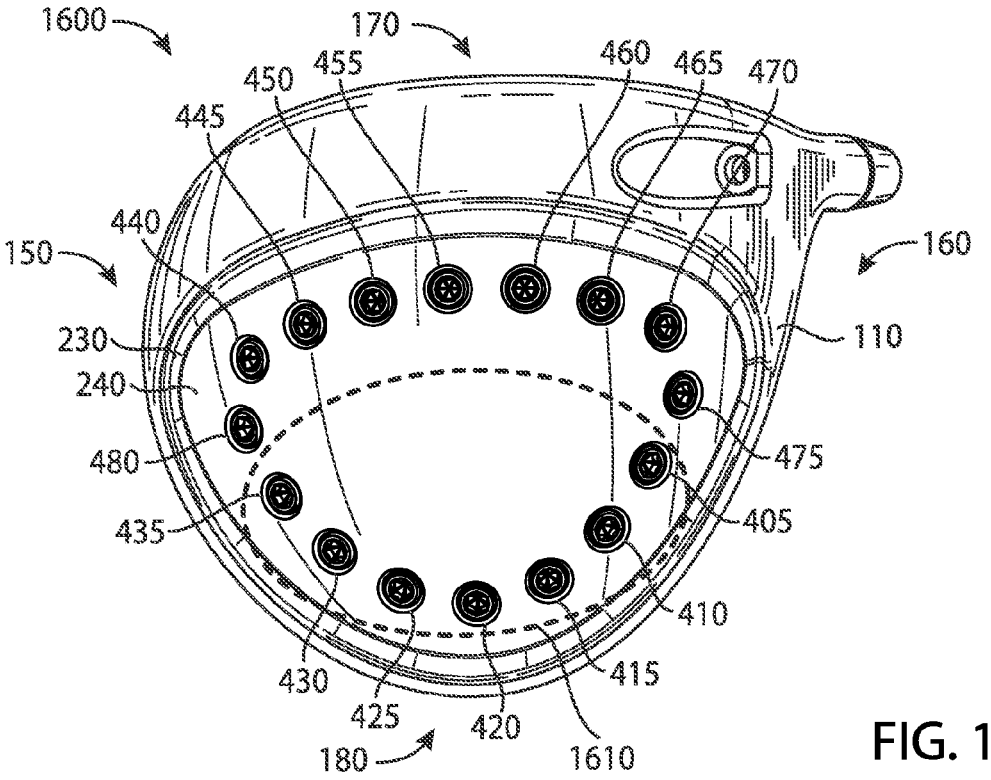
FIG. 16 depicts a second weight configuration of the example weight portions.

Turning to FIG. 16, for example, a second weight configuration 1600 may be associated with a configuration of a second set of weight ports 1610. The second set of weight ports 1610 may be located at or proximate to the rear portion 180 (e.g., weight ports, 945, 950, 955, 960, 965, 970, and 975 shown in FIG. 9). In a second weight configuration 1600 as illustrated in FIG. 16, for example, a first set of weight portions may be disposed toward the rear portion 180 whereas a second set of weight portions may be disposed toward the front portion 170. In particular, the first set of weight portions may form a cluster 1610 at or proximate to the rear portion 180 according to the configuration of the second set of weight ports 1610. The weight portions 405, 410, 415, 420, 425, 430, and 435 may define the first set of weight portions and may be disposed in weight ports 945, 950, 955, 960, 965, 970, and 975, respectively. The weight portions 440, 445, 450, 455, 460, 465, 470, 475, and 480 may define the second set of weight portions and may be disposed in weight ports 905, 910, 915, 920, 925, 930, 935, 940, and 980, respectively. The second weight configuration 1600 may be associated with the second launch trajectory profile 1420 (FIG. 14). In particular, the second weight configuration 1600 may increase launch angle of a golf ball and maximize forgiveness. By placing the relatively heavier weight portion (i.e., the first set of weight portions) towards the rear portion 180 of the golf club head 100 according to the configuration of the second set of weight ports 1610, the center of gravity (GC) of the golf club head 100 may move relatively back and up to produce a relatively higher launch and spin trajectory. Further, the moment of inertia (MOI) of the golf club head 100 may increase in both the horizontal (front-to-back axis) and vertical axes (top-to-bottom axis), which in turn, provides relatively more forgiveness on off-center hits. As a result, the second launch trajectory profile 1420 may be associated with a relatively greater carry distance (i.e., in-the-air distance).

Figure 17:
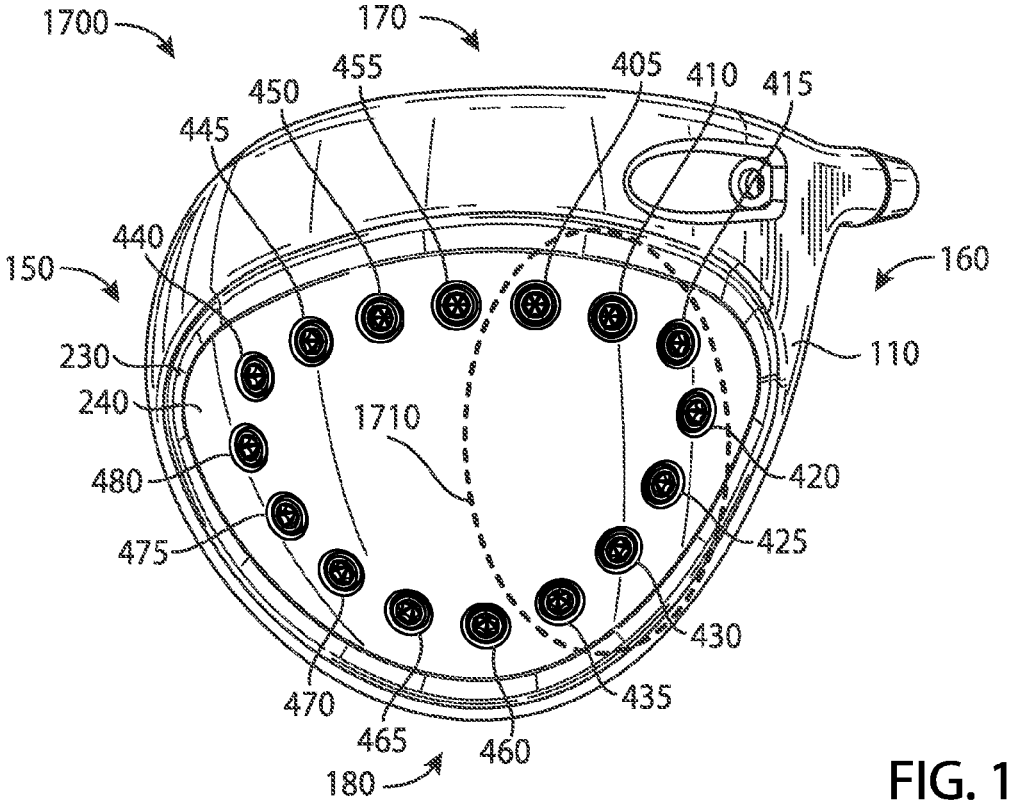
FIG. 17 depicts a third weight configuration of the example weight portions.

Turning to FIG. 17, for example, a third weight configuration 1700 may be associated with a configuration of a third set of weight ports 1710. In the third weight configuration 1700, for example, a first set of weight portions may be disposed toward the heel portion 160 whereas a second set of weight portions may be disposed toward the toe portion 150. In particular, the first set of weight portions may form a cluster of weight portions at or proximate to the heel portion 160 according to the configuration of the third set of weight ports 1710. The weight portions 405, 410, 415, 420, 425, 430, and 435 may define the first set of weight portions and may be disposed in weight ports 925, 930, 935, 940, 945, 950, and 955, respectively. The weight portions 440, 445, 450, 455, 460, 465, 470, 475, and 480 may define the second set of weight portions and may be disposed in weight ports 905, 910, 915, 920, 960, 965, 970, 975, and 980, respectively. The third weight configuration 1600 may be associated with a third launch trajectory profile 1430 (FIG. 14). In particular, the third weight configuration 1700 may allow an individual to turn over the golf club head 100 relatively easier (i.e., square up the face portion 175 to impact a golf ball). By placing the relatively heavier weight portions (i.e., the first set of weight portions) towards the heel portion 160 of the golf club head 100, the center of gravity (GC) of the golf club head 100 may move relatively closer to the axis of the shaft.

Figure 18:
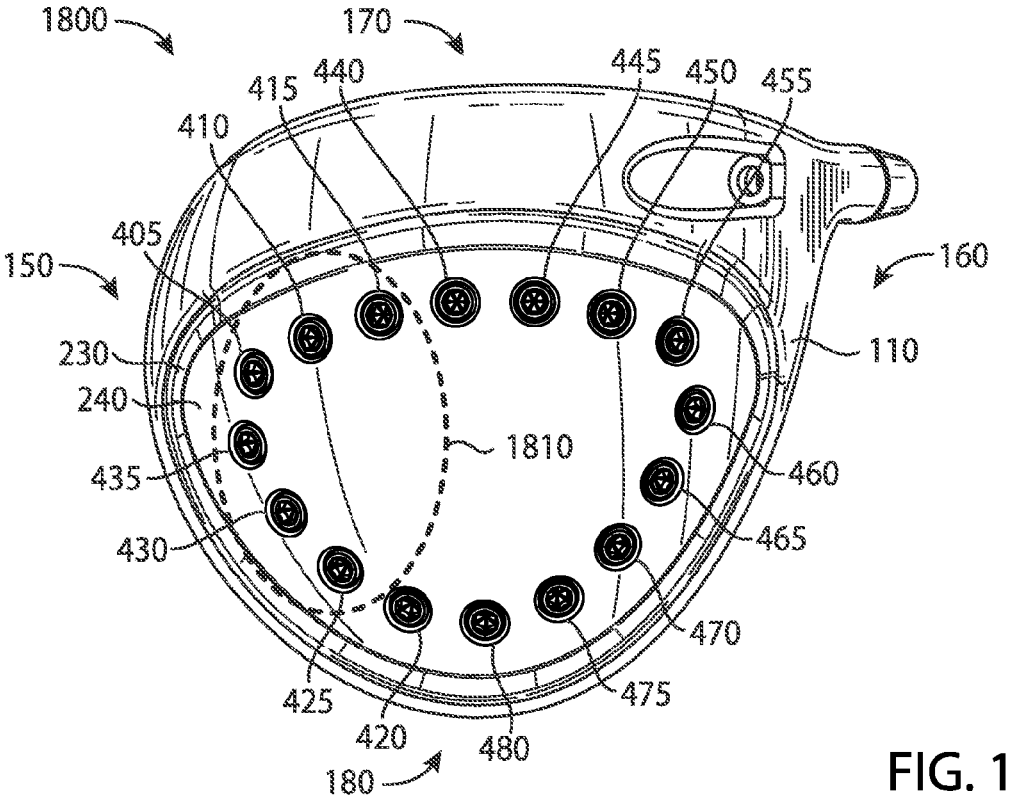
FIG. 18 depicts a fourth weight configuration of the example weight portions.
Figure 19:
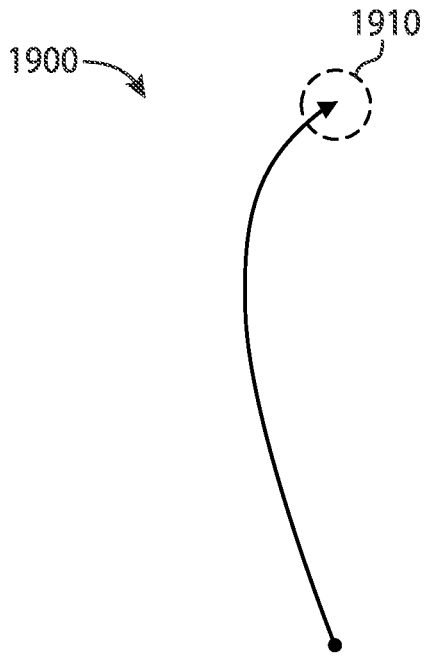
FIG. 19 depicts an example launch trajectory profile of the example golf club head of FIG. 18.

Turning to FIG. 18, for example, a fourth weight configuration 1800 may be associated with a configuration of a fourth set of weight ports 1810. In a fourth weight configuration 1800, for example, a first set of weight portions may be disposed toward the toe portion 150 whereas a second set of weight portions may be disposed toward the heel portion 160. In particular, the first set of weight portions may form a cluster of weight portions at or proximate to the toe portion 150 according to the configuration of the fourth set of weight ports 1810. The weight portions 405, 410, 415, 420, 425, 430, and 435 may define the first set of weight portions and may be disposed in weight ports 905, 910, 915, 965, 970, 975, and 980, respectively. The weight portions 440, 445, 450, 455, 460, 465, 470, 475, and 480 may define the second set of weight portions and may be disposed in weight ports 920, 925, 930, 935, 940, 945, 950, 955, and 960, respectively. The fourth weight configuration 1800 may be associated with the third launch trajectory profile 1430 (FIG. 14). In particular, the fourth weight configuration 1800 may prevent an individual from turning over the golf club head 100 (i.e., the face portion 175 may be more open to impact a golf ball). By placing the relatively heavier weight portions (i.e., the first set of weight portions) towards the toe portion 150 of the golf club head 100, the center of gravity (GC) of the golf club head 100 may move relatively farther away from the axis of the shaft. The fourth weight configuration 1800 may result in a fade golf shot (as shown in FIG. 19, for example, a trajectory or ball flight in which a golf ball travels to the left of a target 1910 and curving back to the right of the target for a right-handed individual). The apparatus, methods, and articles of manufacture described herein are not limited in this regard.

Figure 20:
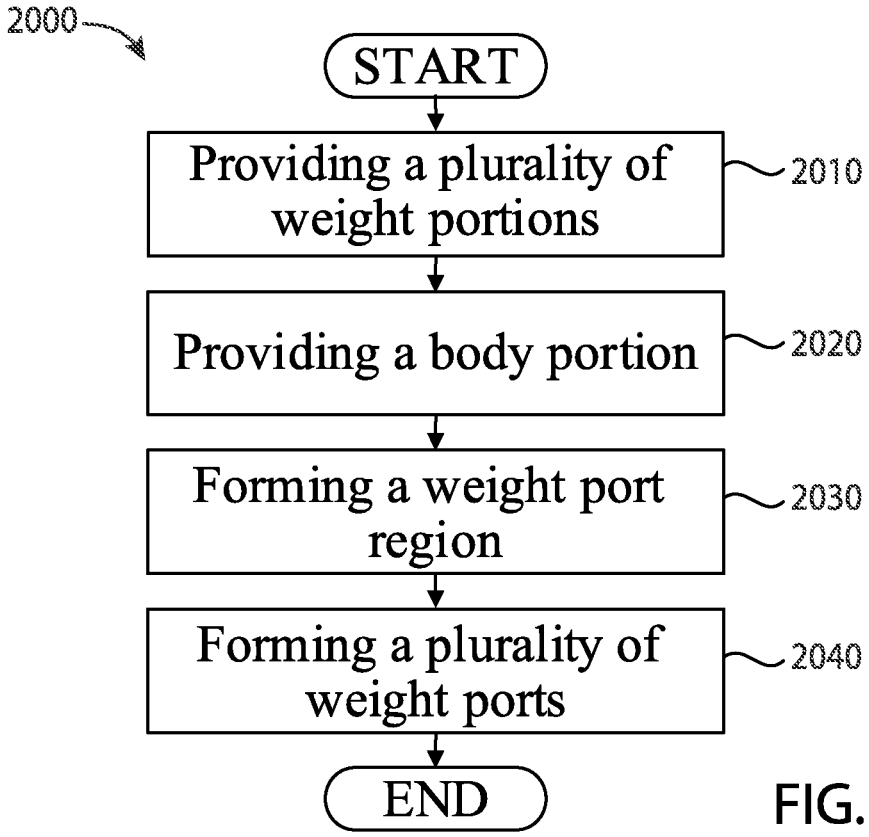
FIG. 20 depicts one manner in which the example golf club heads described herein may be manufactured.

FIG. 20 depicts one manner in which the golf club head 100 may be manufactured. In the example of FIG. 20, the process 2000 may begin with providing a plurality of weight portions (block 2010). The plurality of weight portions may include a first set of weight portions and a second set of weight portions. Each weight portion of the first set of weight portions may be associated with a first mass whereas each weight portion of the second set of weight portions may be associated with a second mass. The first mass may be greater than the second mass. In one example, each weight portion of the first set of weight portions may be made of a tungsten-based material with a mass 2.6 grams whereas each weight portion of the second set of weight portions may be made of an aluminum-based material with a mass of 0.4 grams. The first set of weight portions may have a gray color or a steel color whereas the second set of weight portions may have a black color.

The process 2000 may provide a body portion of a golf club head (block 2020). The body portion may include a front portion, a rear portion, a toe portion, a heel portion, a top portion, a bottom portion having an outer surface associated with outer surface curve, and a skirt portion between the top and bottom portion.

The process 2000 may form a weight port region located at or proximate to the bottom and skirts portions (block 2030). A transition region may surround the weight port region.

The process 2000 may form a plurality of weight ports along a periphery of the weight port region (block 2040). Each weight port of the plurality of weight ports may be associated with a port diameter and configured to receive at least one weight portion of the plurality of weight portions. Two adjacent weight ports may be separated by less than or equal to the port diameter. Further, each weight port of the plurality of weight ports may be associated with a port axis. The port axis may be perpendicular or substantially perpendicular relative to a tangent plane of the outer surface curve of the bottom portion of the golf club head.

The example process 2000 of FIG. 20 is merely provided and described in conjunction with FIGS. 1-19 as an example of one way to manufacture the golf club head 100. While a particular order of actions is illustrated in FIG. 20, these actions may be performed in other temporal sequences. For example, two or more actions depicted in FIG. 20 may be performed sequentially, concurrently, or simultaneously. Although FIG. 20 depicts a particular number of blocks, the process may not perform one or more blocks. The apparatus, methods, and articles of manufacture described herein are not limited in this regard.

Figure 4:
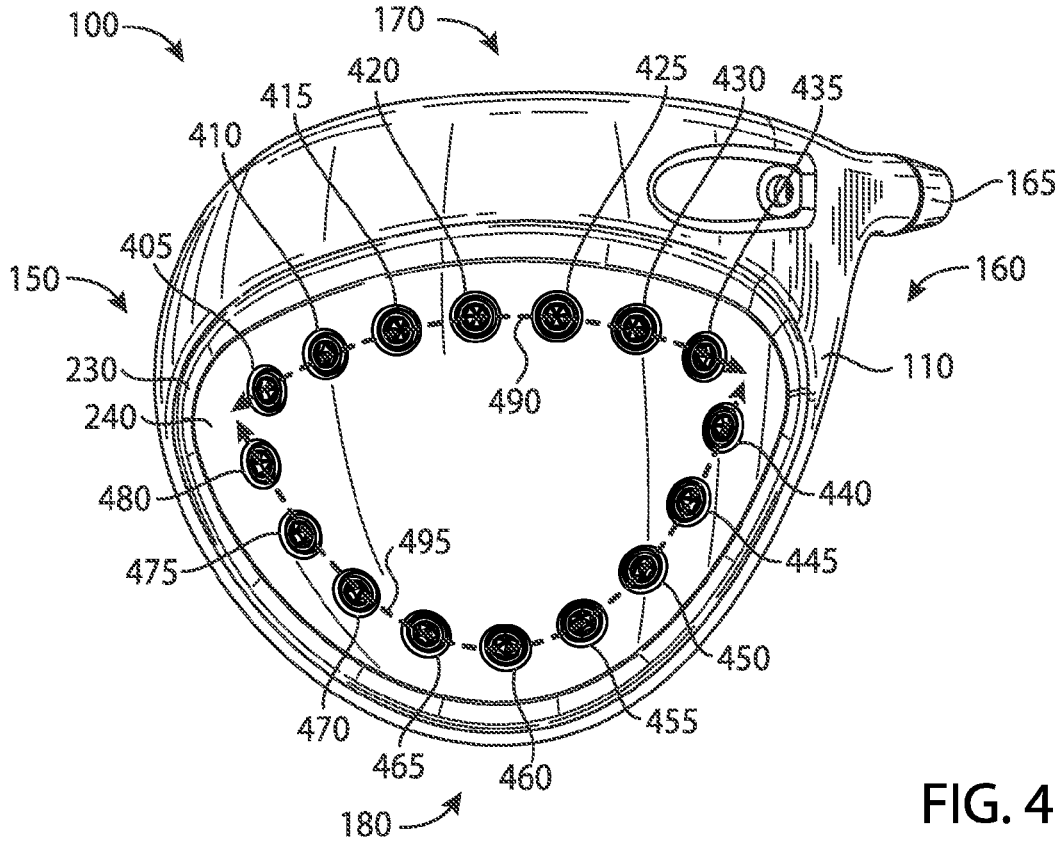
FIG. 4 depicts a bottom view of the example golf club head of FIG. 1.
Figure 5:
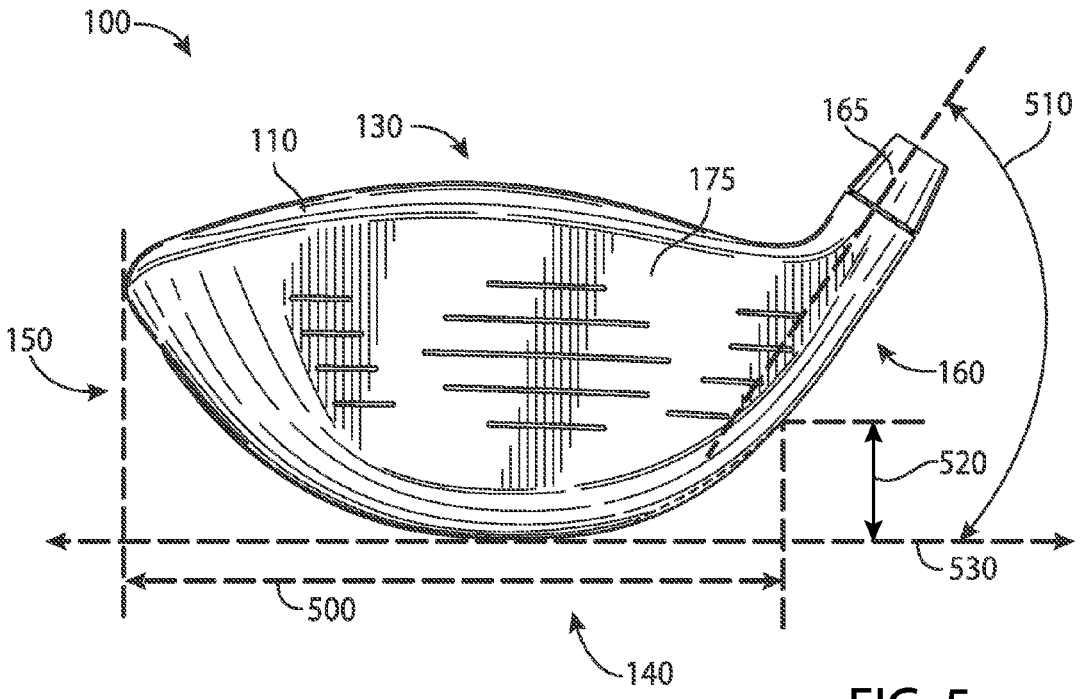
FIG. 5 depicts a front view of the example golf club head of FIG. 1.
Figure 6:
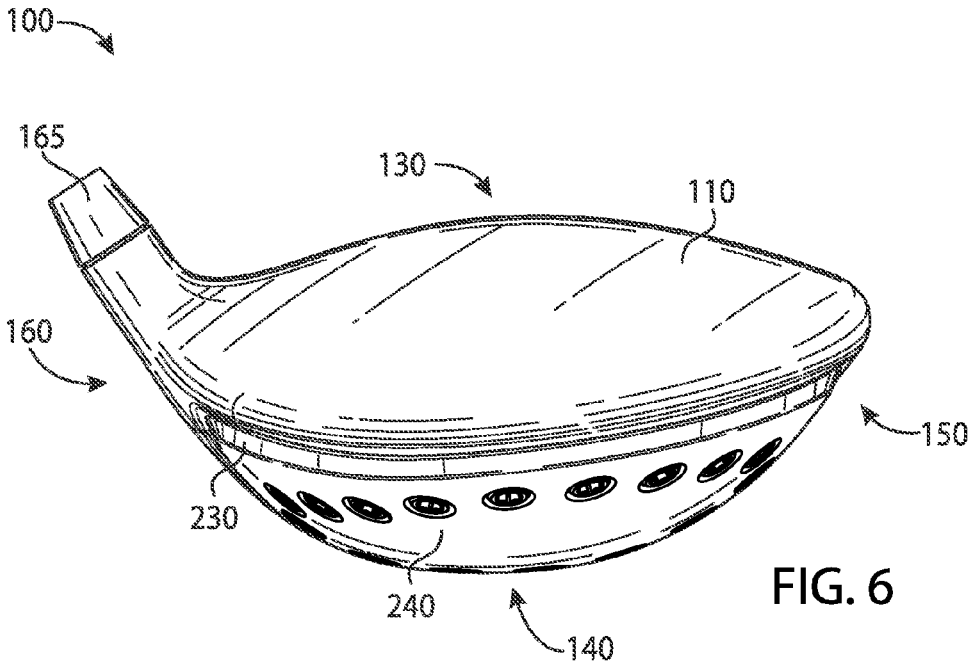
FIG. 6 depicts a rear view of the example golf club head of FIG. 1.
Figure 7:
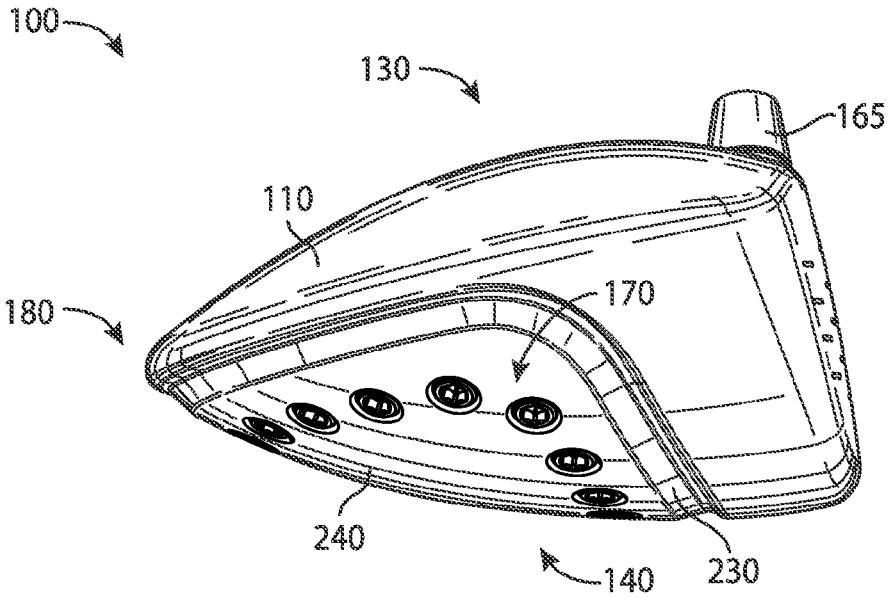
FIG. 7 depicts a toe view of the example golf club head of FIG. 1.
Figure 8:
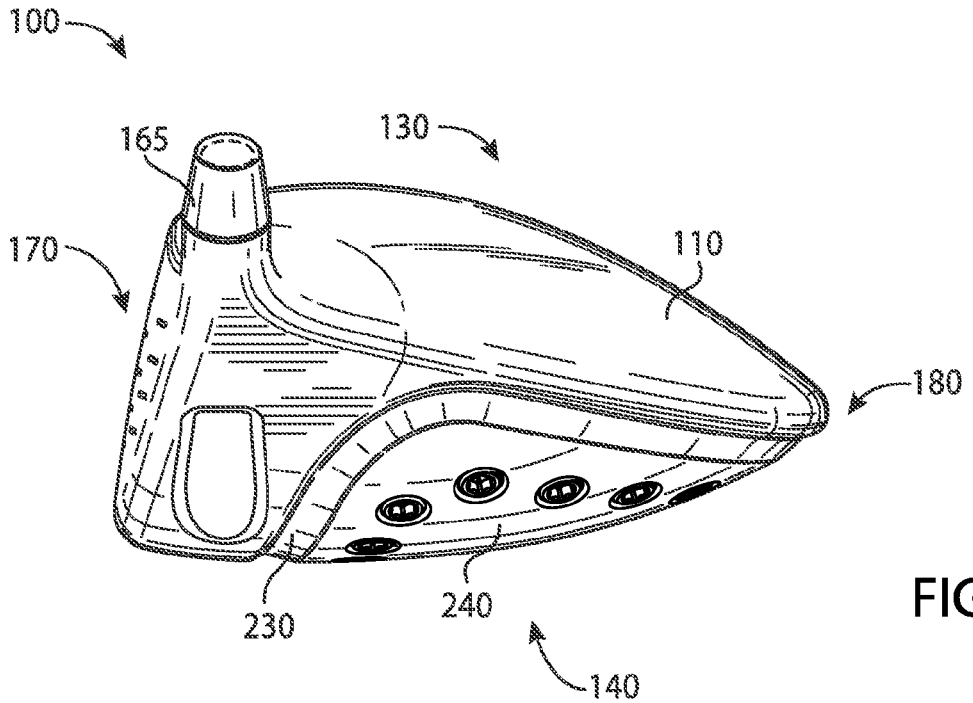
FIG. 8 depicts a heel view of the example golf club head of FIG. 1.

As shown in the above examples, the plurality of weight portions 120 and the plurality of weight ports 900 may be located on a periphery of the weight port region 240 along a path that defines a generally D-shaped loop formed with two arcs, generally shown as 490 and 495 in FIG. 4. For example, the weight portions 405, 410, 415, 420, 425, 430, and 435 (FIG. 4), and the weight ports 905, 910, 915, 920, 925, 930, and 935 (FIG. 9) may form the first arc 490. In particular, the first arc 490 may extend between the toe and heel portions 150 and 160, respectively, across the bottom portion 140. The weight portions 440, 445, 450, 455, 460, 465, 470, 475, and 480 (FIG. 4), the weight ports 940, 945, 950, 955, 960, 965, 970, 975, and 980 (FIG. 9) may form the second arc 495. The second arc 495 may generally follow the contour of the rear portion 180 of the body portion 110. Alternatively, the first and second arcs 490 and 495 may define loops with other shapes that extend across the bottom portion 140 (e.g., a generally O-shaped loop). The apparatus, methods, and articles of manufacture described herein are not limited in this regard.

Figure 21:
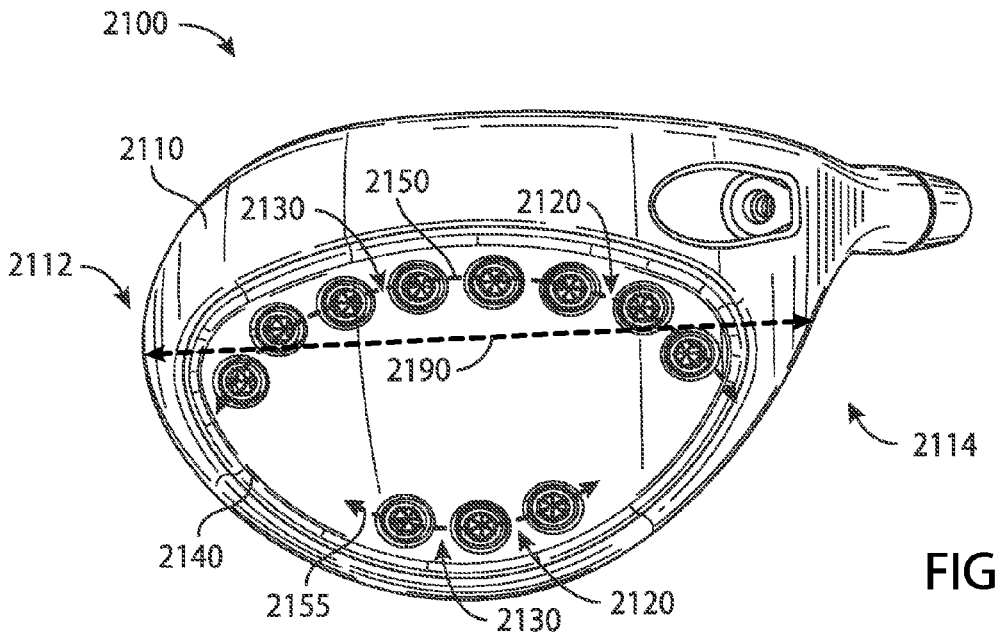
FIG. 21 depicts a bottom view of another example golf club head.

Although the above examples may depict the plurality of weight portions 120 and the plurality of weight ports 900 forming a particular geometric shape, the apparatus, methods, and articles of manufacture described herein may have weight portions and weight ports located along a periphery of a weight portion region to form other geometric shapes. Turning to FIG. 21, for example, a golf club head 2100 may include a bottom portion 2110, and a plurality of weight portions 2120 disposed in a plurality of weight ports 2130. The plurality of weight ports 2130 may be located along a periphery of a weight port region 2140 of the bottom portion 2110 (i.e., the plurality of weight ports 2130 may extend between the toe and heel portions 2112 and 2114, respectively, across the bottom portion 2110). In contrast to the plurality of weight portions 120 and the plurality of weight ports 900 (e.g., FIGS. 4 and 9), the plurality of weight ports 2130 may form two discrete arcs, generally shown as 2150 and 2155, extending across the bottom portion 2110.

The first arc 2150 may extend between the toe portion 2112 and the heel portion 2114. The first arc 2150 may curve toward the front portion 2170 of the golf club head 2100 (i.e., concave relative to the front portion 2170). According to the example of FIG. 21, the first arc 2150 may extend from a region proximate the toe portion 2112 to a region proximate to the front portion 2170 and from the region proximate to the front portion 2170 to a region proximate to the heel portion 2114 (i.e., concave relative to the front portion 2170). Accordingly, the first arc 2150 may appear as a C-shaped arc facing the rear portion 2180 of the golf club head 2110 that extends between the toe portion 2112 and the heel portion 2114. The second arc 2155 may also extend between the toe portion 2112 and the heel portion 2114. The second arc 2155 may curve toward the rear portion 2180 of the golf club head 2100 (i.e., concave relative to the rear portion 2180). Accordingly, the second arc 2155 may appear as a C-shaped arc facing the front portion 2170 of the golf club head 2110 that extends between the toe portion 2112 and the heel portion 2114. Further, the first arc 2150 may be closer to the front portion 2170 than the second arc 2155. The first arc 2150 and the second arc 2155 may be discrete so that the first and second arcs 2150 and 2155, respectively, may be spaced apart along the periphery of the bottom portion 2110. Accordingly, the bottom portion 2110 may include gaps 2190 and 2192 along the periphery of the bottom portion 2110 between the weight ports 2130 of the first arc 2150 and the weight ports 2130 of the second arc 2155. The gaps 2190 and/or 2192 may be greater than or equal to the port diameter of any of the weight ports 2130 such as the weight ports 2130 that are adjacent to the gaps 2190 and/or 2192. According to one example as shown in FIG. 21, the gaps 2190 and 2192 may be several orders or magnitude larger than the diameters of the weight ports 2130 that are adjacent to the gaps 2190 and 2192. The apparatus, methods, and articles of manufacture described herein are not limited in this regard.

Referring to FIG. 21, for example, the first arc 2150 may include a greater number of weight ports 2130 than the second arc 2155, which may be suitable for certain golf club heads (e.g., a fairway wood-type golf club head and/or a hybrid-type golf club head). Alternatively, the second arc 2155 may include the same or a greater number of weight ports 2130 than the first arc 2150. The number of weight ports 2130 in each of the first and second arcs 2150 and 2155, respectively, the weight portions 2120 associated with each weight port 2130 and the spacing between adjacent weight ports 2130 may be determined based on the type of golf club, a preferred weight distribution of the golf club head 2110, and/or a center of gravity location of the golf club head 2110.

The weight ports 2130 of the first arc 2150 and/or the second arc 2155 may be spaced from each other at the same or approximately the same distance along the first arc 2150 and/or the second arc 2155, respectively. Any variation in the spacing between the weight ports 2130 of the first arc 2150 or the second arc 2155 or any of the weight ports described herein may be due to different manufacturing considerations, such as manufacturing tolerances and/or cost effectiveness associated with manufacturing precision. For example, the variation in the spacing between the weight ports 2130 of the first arc 2150 and/or the second arc 2155 may be between 1/16 of an inch to 0.001 inch. As described herein, the distance between adjacent weight ports 2130 (i.e., port distance) may be less than or equal to the port diameter of any of the two adjacent weight ports. The plurality of weight ports 2130 may extend between the toe portion 2112 and the heel portion 2114 at a maximum toe-to heel weight port distance that is more than 50% of a maximum toe-to-heel club head distance 2195 of the golf club head 2100. The maximum toe-to-heel weight port distance may be the maximum distance between the heel-side boundary of the weight port farthest from the toe portion 2112 and the toe-side boundary of the weight port farthest from the heel portion 2114.

In particular, the golf club head 2100 may have a volume of less than 430 cc. In example, the golf club head 2100 may have a volume ranging from 100 cc to 400 cc. In another example, the golf club head 2100 may have a volume ranging from 150 cc to 350 cc. In yet another example, the golf club head 2100 may have a volume ranging from 200 cc to 300 cc. The golf club head 2100 may have a mass ranging from 100 grams to 350 grams. In another example, the golf club head 2100 may be have a mass ranging from 150 grams to 300 grams. In yet another example, the golf club head 2100 may have a mass ranging from 200 grams to 250 grams. The golf club head 2100 may have a loft angle ranging from 10° to 30°. In another example, the golf club head 2100 may have a loft angle ranging from 13° to 27°. For example, the golf club head 2100 may be a fairway wood-type golf club head. Alternatively, the golf club head 2100 may be a smaller driver-type golf club head (i.e., larger than a fairway wood-type golf club head but smaller than a driver-type golf club head). The apparatus, methods, and articles of manufacture described herein are not limited in this regard.

Figure 22:
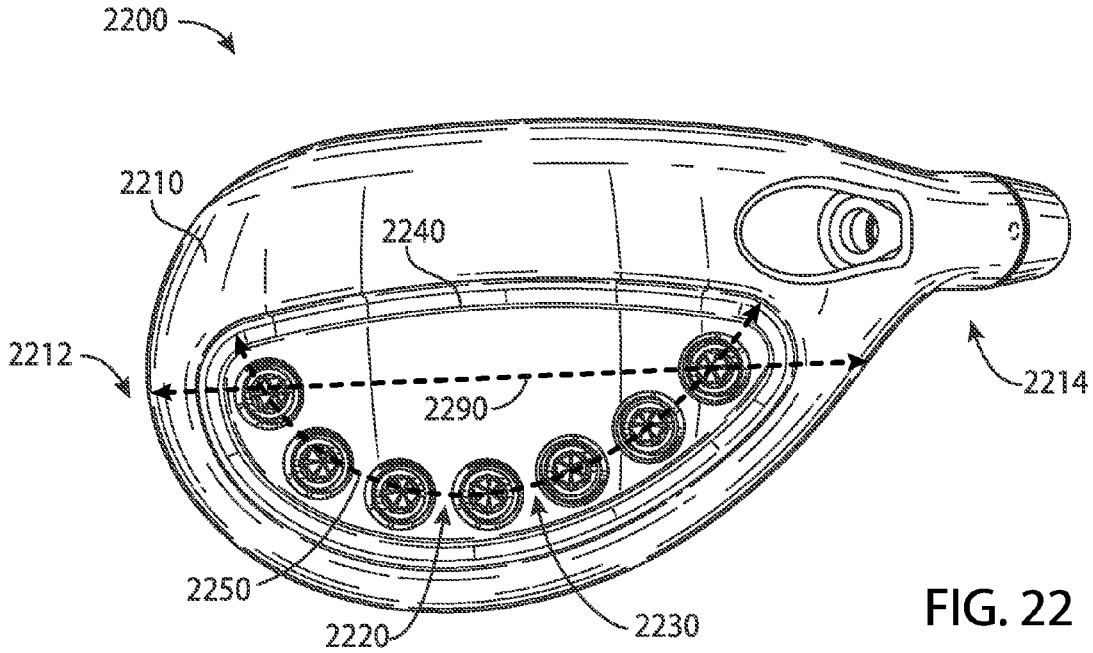
FIG. 22 depicts a bottom view of yet another example golf club head.

As illustrated in FIG. 22, for example, a golf club head 2200 may include a bottom portion 2210, and a plurality of weight portions 2220 disposed in a plurality of weight ports 2230. The plurality of weight ports 2230 located along a periphery of a weight port region 2240 may be arranged along a path that defines an arc, generally shown as 2250, extending across the bottom portion 2210 (i.e., the plurality of weight ports 2230 may extend between the toe and heel portions 2212 and 2214, respectively, across the bottom portion 2210). The arc 2250 may curve toward the rear portion 2280 of the golf club head 2200 (i.e., concave relative to the rear portion 2280). According to the example of FIG. 22, the arc 2250 may extend from a region proximate the toe portion 2212 to a region proximate to the rear portion 2280 and from the region proximate to the rear portion 2280 to a region proximate to the heel portion 2214 (i.e., concave relative to the rear portion 2280). Accordingly, the arc 2250 may appear as a C-shaped arc facing the front portion 2270 of the golf club head 2210 that extends from near the heel portion 2214 to near the toe portion 2212. Further, the curvature of the arc 2250 is substantially similar to or generally follows the contour of the rear portion 2280 of the golf club head 2210. The number of weight ports 2230 in the arc 2250, the weight portions 2220 associated with each weight port 2230 and the spacing between adjacent weight ports 2230 may be determined based on the type of golf club, a preferred weight distribution of the golf club head 2210, and/or a center of gravity location of the golf club head 2210.

The weight ports 2230 of the arc 2250 may be spaced from each other at the same or approximately the same distance along the arc 2250 (e.g., the weight ports 2230 may be substantially similarly spaced apart from each other). Any variation in the spacing between the weight ports 2230 of the arc 2250 or any of the weight ports described herein may be due to different manufacturing considerations, such as manufacturing tolerances and/or cost effectiveness associated with manufacturing precision. For example, the variation in the spacing between the weight ports 2130 of the arc 2250 may be between 1/16 of an inch to 0.001 inch. As described herein, the distance between adjacent weight ports 2230 (i.e., port distance) may be less than or equal to the port diameter of any of the two adjacent weight ports. The plurality of weight ports 2230 may extend between the toe portion 2212 and the heel portion 2214 at a maximum toe-to heel weight port distance that is more than 50% of a maximum toe-to-heel club head distance of 2290 the golf club head 2200. The maximum toe-to-heel weight port distance may be the maximum distance between the heel-side boundary of the weight port farthest from the toe portion 2212 and the toe-side boundary of the weight port farthest from the heel portion 2214.

In particular, the golf club head 2200 may have a volume of less than 200 cc. In example, the golf club head 2200 may have a volume ranging from 50 cc to 150 cc. In another example, the golf club head 2200 may have a volume ranging from 60 cc to 120 cc. In yet another example, the golf club head 2200 may have a volume ranging from 70 cc to 100 cc. The golf club head 2200 may have a mass ranging from 180 grams to 275 grams. In another example, the golf club head 2200 may have a mass ranging from 200 grams to 250 grams. The golf club head 2200 may have a loft angle ranging from 15° to 35°. In another example, the golf club head 2200 may have a loft angle ranging from 17° to 33°. For example, the golf club head 2200 may be a hybrid-type golf club head. The apparatus, methods, and articles of manufacture described herein are not limited in this regard.

Figure 23:
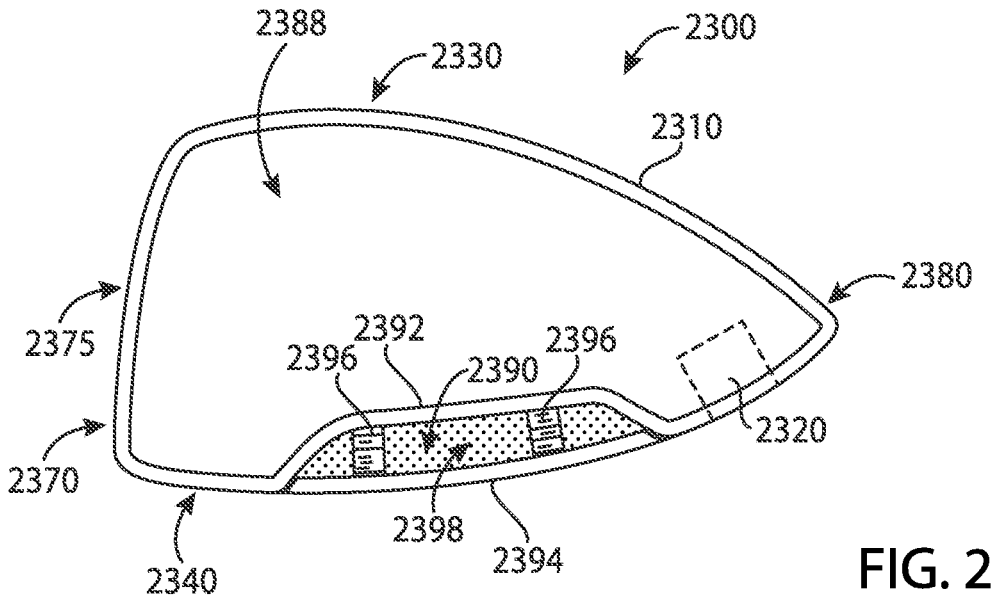
FIG. 23 depicts a schematic cross-sectional view of yet another example golf club head.

In the example of FIG. 23, a golf club head 2300 may include a body portion 2310. The golf club head 2300 may include a plurality of weight ports (e.g., one is generally shown as 2320) and a plurality of weight portions that may be similar in many respects to the weight ports and weight portions, respectively, of the golf club heads described herein. Accordingly, a detailed description of the weight ports and the weight portions of the golf club head 2300 is not provided. Alternatively, the golf club head 2300 may not include any weight ports or weight portions. The body portion 2310 may include a top portion 2330, a bottom portion 2340, a toe portion (not shown), a heel portion (not shown), a front portion 2370, and a rear portion 2380. The bottom portion 2340 may include a skirt portion (not shown) defined as a side portion of the golf club head 2300 between the top portion 2330 and the bottom portion 2340 excluding the front portion 2370 and extending across a periphery of the golf club head 2300 from the toe portion, around the rear portion 2380, and to the heel portion. The bottom portion 2340 may include one or more weight port regions (not shown). For example, a weight port region may include a plurality of weight ports, one of which is generally shown as 2320, to receive a plurality of weight portions (not shown). The front portion 2370 may include a face portion 2375 to engage a golf ball (not shown). The body portion 2310 may also include a hosel portion (not shown) to receive a shaft (not shown). Alternatively, the body portion 2310 may include a bore (not shown) instead of a hosel portion (not shown). For example, the body portion 2310 may be made partially or entirely of an aluminum-based material, a magnesium-type material, a steel-based material, a titanium-based material, any combination thereof, or any other suitable material. In another example the body portion 2310 may be made partially or entirely of a non-metal material such as a ceramic material, a composite material, any combination thereof, or any other suitable material.

The golf club head 2300 may have a club head volume greater than or equal to 300 cubic centimeters ($cm^3$ or cc). In one example, the golf club head 2300 may be about 460 cc. Alternatively, the golf club head 2300 may have a club head volume less than or equal to 300 cc. In particular, the golf club head 2300 may have a club head volume between 100 cc and 200 cc. The club head volume of the golf club head 2300 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 2300. Although FIG. 23 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). Accordingly, the club head 2300 may be any type of club head such as any of the club heads described herein. The apparatus, methods, and articles of manufacture described herein are not limited in this regard.

The body portion 2310 may be a hollow body including a first interior cavity 2388 that may extend from the front portion 2370 to the rear portion 2380 and from the toe portion to the heel portion. The body portion 2310 may include a second interior cavity 2390 near the bottom portion 2340 or at the bottom portion 2340 and extending between the front portion 2360 and the rear portion 2370. The second interior cavity 2390 may extend between the top portion 2380 and the bottom portion 2390. The first interior cavity 2388 and the second interior cavity 2390 may be separated by a cavity wall 2389. In the example of FIG. 23, the second interior cavity 2390 may be defined by a recessed portion 2392 of the bottom portion 2340 that is covered with a bottom cover 2394. Accordingly, in the example of FIG. 23, the cavity wall 2389 may be defined by the recessed portion 2392 of the bottom portion 2340. The bottom cover 2394 may be attached to the bottom portion 2340 with one or more fasteners, two of which are generally shown as 2396. Thus, the space between the recessed portion 2392 of the bottom portion 2340 and the bottom cover 2394 may define the second interior cavity 2390.

In one example, the second interior cavity 2390 may be unfilled (i.e., empty space). Alternatively, the second interior cavity 2390 may be partially or entirely filled with an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. For example, at least 50% of the second interior cavity 2390 may be filled with a TPE material to absorb shock, isolate vibration, and/or dampen noise when the golf club head 2300 strikes a golf ball via the face portion 2375. The apparatus, methods, and articles of manufacture described herein are not limited in this regard.

In one example, the interior cavity may be filled with an elastic polymer or elastomer material (e.g., shown as 2398) by filling the recessed portion 2392 of the bottom portion 2340 with elastomer polymer or elastomer material, and then attaching the bottom cover 2394 over the recessed portion 2392 with the fasteners 2396. Alternatively, the bottom cover 2394 may be initially placed over the recessed portion 2392 and then attached to the bottom portion 2340 with one of the fasteners 2396. Elastic polymer or elastomer material may then be injected into the interior cavity 2392 through a fastener port or another one of the fasteners 2396 for the bottom cover 2394. After the interior cavity 2392 is filled, all of the fasteners for the bottom cover 2394 may fastened to completely attach the bottom cover 2394 over the recessed portion 2392. Alternatively yet, a combination of the methods described herein including the methods described below may be used to fill the interior cavity 2392 with an elastic polymer or elastomer material. The apparatus, methods, and articles of manufacture described herein are not limited in this regard.

Figure 24:
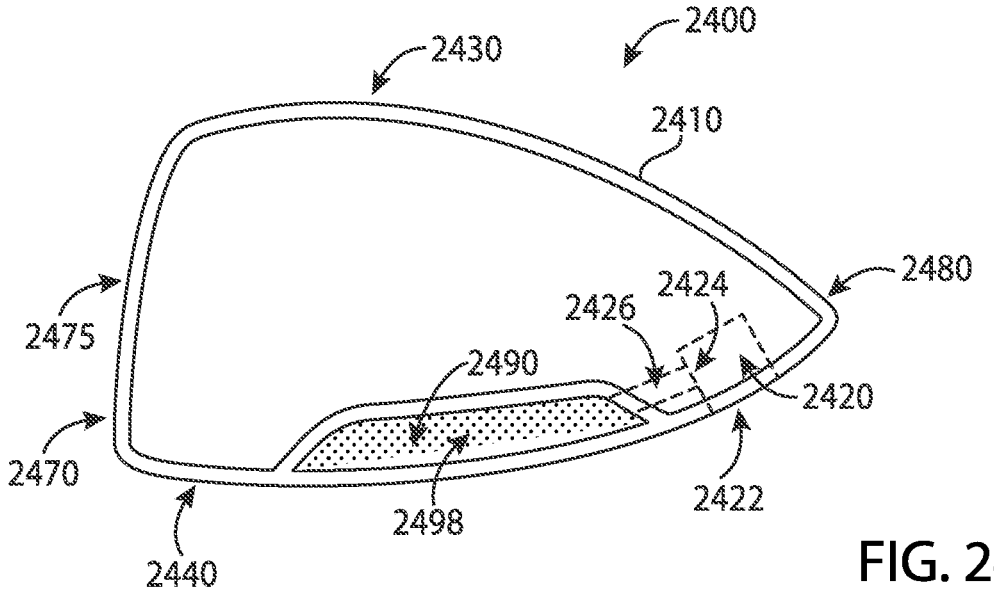
FIG. 24 depicts a schematic cross-sectional view of yet another example golf club head.

In the example of FIG. 24, a golf club head 2400 may include a body portion 2410. The golf club head 2400 may include a plurality of weight ports (e.g. one is generally shown as 2420) and a plurality of weight portions that may be similar in many respects to the weight ports and weight portions of the golf club heads described herein. Accordingly, a detailed description of the weight ports and the weight portions of the golf club head 2400 is not provided. Alternatively, the golf club head 2400 may not include any weight ports or weight portions. The body portion 2410 may include a top portion 2430, a bottom portion 2440, a toe portion (not shown), a heel portion (not shown), a front portion 2470, and a rear portion 2480. The bottom portion 2440 may include a skirt portion (not shown) defined as a side portion of the golf club head 2400 between the top portion 2430 and the bottom portion 2440 excluding the front portion 2470 and extending across a periphery of the golf club head 2400 from the toe portion, around the rear portion 2480, and to the heel portion. The bottom portion 2440 may include one or more weight port regions (not shown). For example, a weight port region may include a plurality of weight ports, one of which is generally shown as 2420, to receive a plurality of weight portions (not shown). The front portion 2470 may include a face portion 2475 to engage a golf ball (not shown). The body portion 2410 may also include a hosel portion (not shown) to receive a shaft (not shown). Alternatively, the body portion 2410 may include a bore (not shown) instead of a hosel portion (not shown). For example, the body portion 2410 may be made partially or entirely of an aluminum-based material, a magnesium-type material, a steel-based material, a titanium-based material, any combination thereof, or any other suitable material. In another example the body portion 2410 may be made partially or entirely of a non-metal material such as a ceramic material, a composite material, any combination thereof, or any other suitable material.

The golf club head 2400 may have a club head volume greater than or equal to 300 cubic centimeters ($cm^3$ or cc). In one example, the golf club head 2400 may be about 460 cc. Alternatively, the golf club head 2400 may have a club head volume less than or equal to 300 cc. In particular, the golf club head 2400 may have a club head volume between 100 cc and 200 cc. The club head volume of the golf club head 2400 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 2400. Although FIG. 24 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). Accordingly, the club head 2400 may be any type of club head such as the club heads described herein. The apparatus, methods, and articles of manufacture described herein are not limited in this regard.

The body portion 2410 may be a hollow body including the interior cavity 2490 near the bottom portion 2440 or at the bottom portion 2440 and extending between the front portion 2460 and the rear portion 2470. The interior cavity 2490 may extend between the top portion 2480 and the bottom portion 2490. In one example, the interior cavity 2490 may be unfilled (i.e., empty space). Alternatively, the interior cavity 2490 may be partially or entirely filled with an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. For example, at least 50% of the interior cavity 2490 may be filled with a TPE material to absorb shock, isolate vibration, and/or dampen noise when the golf club head 2300 strikes a golf ball via the face portion 2475. The apparatus, methods, and articles of manufacture described herein are not limited in this regard.

In one example, the interior cavity may be filled with an elastic polymer or elastomer material through at least one of the weight ports such as the weight port shown as 2420. As illustrated in FIG. 24, for example, the golf club head 2400 may include one or more weight ports (e.g., one shown as 2420) with a first opening 2422 and a second opening 2424. The second opening 2424 may be used to access the interior cavity 2490 through a conduit an interior port 2426. In one example, the interior cavity 2490 may be filled with an elastic polymer material (e.g., generally shown as 2498) by injecting the elastic polymer material into the interior cavity 2490 from the first opening 2422 via the second opening 2424 and through the interior port 2426. The first and second openings 2422 and 2424, respectively, may be same or different in size and/or shape. While the above example may describe and depict a particular weight port with a second opening, any other weight ports (not shown) of the golf club head 2400 may include a second opening. The apparatus, methods, and articles of manufacture described herein are not limited in this regard.

Figure 25:
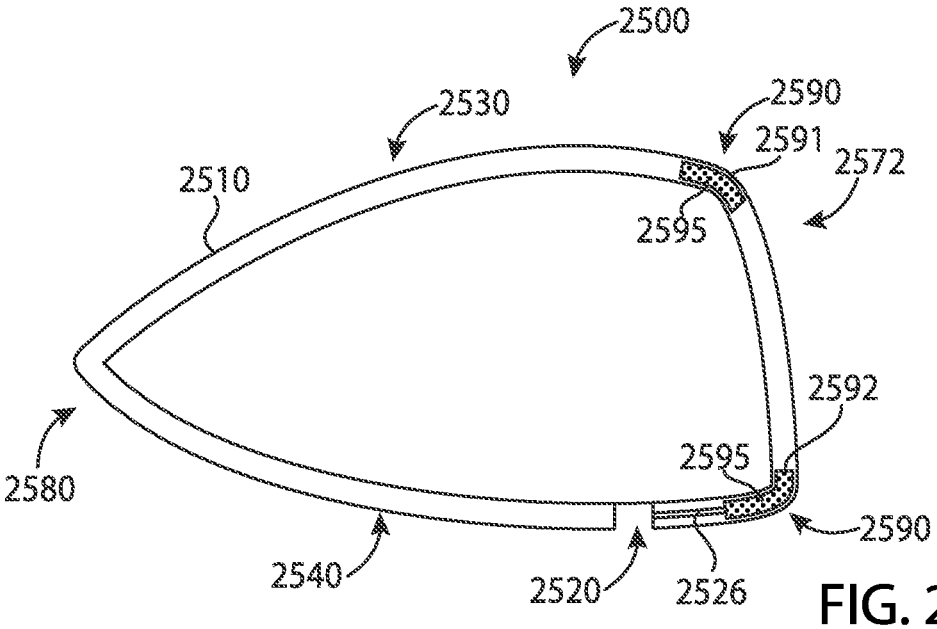
FIG. 25 depicts a schematic side cross-sectional view of another example golf club head.
Figure 26:
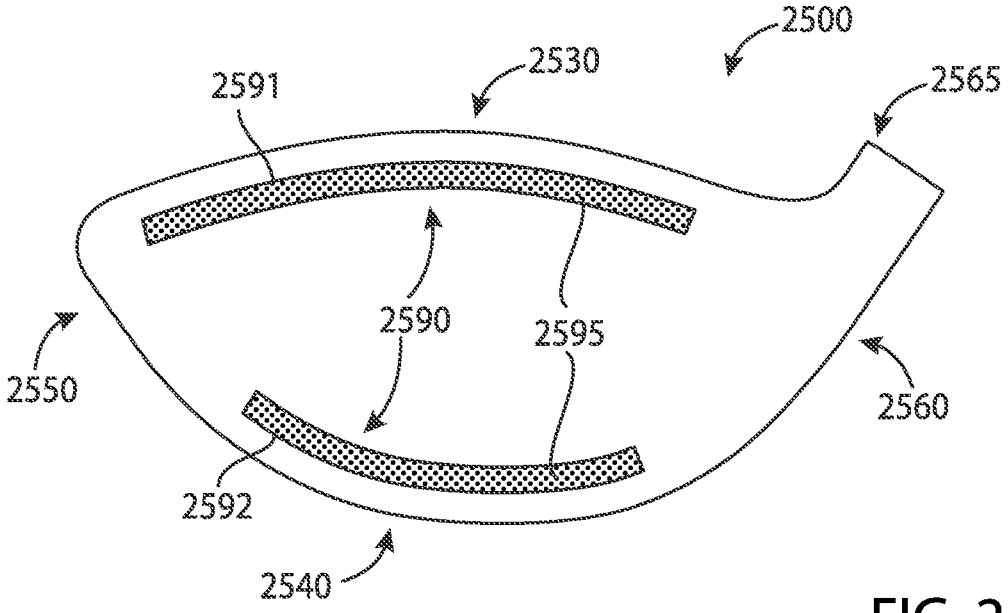
FIG. 26 depicts a schematic front cross-section view of the golf club head of FIG. 25.

In the example of FIGS. 25 and 26, a golf club head 2500 may include a body portion 2510. The golf club head 2500 may include a plurality of weight ports (e.g. one is generally shown as 2520) and a plurality of weight portions, which may be similar in many respects to the weight ports and weight portions of the golf club heads described herein. Accordingly, a detailed description of the weight ports and the weight portions of the golf club head 2500 is not provided. Alternatively, the golf club head 2500 may not include any weight ports and/or weight portions. The body portion 2510 may include a top portion 2530, a bottom portion 2540, a toe portion 2550, a heel portion 2560, a front portion 2570, and a rear portion 2580. The bottom portion 2540 may include a skirt portion (not shown) defined as a side portion of the golf club head 2500 between the top portion 2530 and the bottom portion 2540 excluding the front portion 2570 and extending across a periphery of the golf club head 2500 from the toe portion, around the rear portion 2580, and to the heel portion 2560. The bottom portion 2540 may include one or more weight port regions (not shown). For example, a weight port region may include a plurality of weight ports, one of which is generally shown as 2520, to receive a plurality of weight portions (not shown). The front portion 2570 may include a face portion 2575 to engage a golf ball (not shown). The body portion 2510 may also include a hosel portion 2565 to receive a shaft (not shown). Alternatively, the body portion 2510 may include a bore (not shown) instead of a hosel portion 2565. For example, the body portion 2510 may be made partially or entirely of an aluminum-based material, a magnesium-type material, a steel-based material, a titanium-based material, any combination thereof, or any other suitable material. In another example the body portion 2510 may be made partially or entirely of a non-metal material such as a ceramic material, a composite material, any combination thereof, or any other suitable material.

The golf club head 2500 may have a club head volume greater than or equal to 300 cubic centimeters ($cm^3$ or cc). In one example, the golf club head 2500 may be about 460 cc. Alternatively, the golf club head 2500 may have a club head volume less than or equal to 300 cc. In particular, the golf club head 2500 may have a club head volume between 100 cc and 200 cc. The club head volume of the golf club head 2500 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 2500. Although FIGS. 25 and 26 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). Accordingly, the club head 2500 may be any type of club head such as the club heads described herein. The apparatus, methods, and articles of manufacture described herein are not limited in this regard.

The body portion 2510 may be a hollow body including one or more interior cavities 2590, which may be located in a transition region between the top portion 2530 and the front portion 2570, in a transition region between the bottom portion 2540 and the front portion 2570, in a transition region between the toe portion 2550 and the front portion 2570, and/or in a transition region between the heel portion 2560 and the front portion 2570. In FIGS. 25 and 26, the body portion 2510 includes two interior cavities that are generally shown as interior cavities 2591 and 2592. The interior cavity 2591 may extend between the top portion 2530 and the front portion 2570. The interior cavity 2591 may be in a transition region between the top portion 2530 and the front portion 2570. The interior cavity 2592 may extend between the bottom portion 2540 and the front portion 2570. The interior cavity 2592 may be in a transition region between the bottom portion 2540 and the front portion 2570. In one example, any one or both of the interior cavities 2591 and 2592 may be unfilled (i.e., empty space). Alternatively, the interior cavities 2591 and 2592 may be partially or entirely filled with an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. The elastic polymer or elastomer material is generally shown as 2595. For example, at least 50% of the interior cavities 2591 and 2592 may be filled with a TPE material to absorb shock, isolate vibration, and/or dampen noise when the golf club head 2500 strikes a golf ball via the face portion 2575. At least partially or filling the interior cavities 2591 and 2592 may also change the feel and sound of the golf club to an individual when striking a golf ball. The elastomer material may also provide structural support for the body portion 2510 near the interior cavities 2591 and 2592. The elastomer material may be a non-foaming injection moldable elastomer material that can provide structural support for adjacent portions of the body portion. The apparatus, methods, and articles of manufacture described herein are not limited in this regard.

In one example, the interior cavities 2591 and 2592 may be filled with an elastic polymer or elastomer material through at least one of the weight ports such as the weight port shown as 2520. For example, the weight port 2520 may include an interior port 2526 connecting the weight port 2520 to the interior cavity 2591. The interior cavities 2591 and 2592 may be also filled with an elastic polymer or elastomer material through the hosel portion 2565. Alternatively, the body portion 2510 may include one or more openings (not shown) near the interior cavities 2591 and 2592. An elastic polymer or elastomer material may be injected into the interior cavities 2591 and 2592 through the one or more openings. The openings may then be closed after the process of injecting the elastic polymer or elastomer material into the interior cavities 2591 and 2592 is complete. The apparatus, methods, and articles of manufacture described herein are not limited in this regard.

Figure 27:
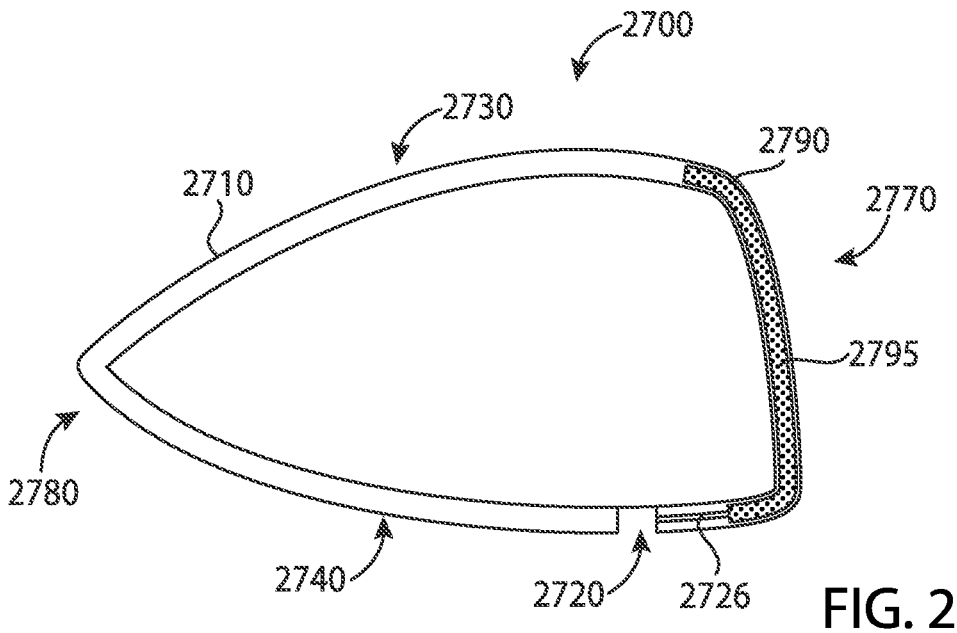
FIG. 27 depicts a schematic side cross-sectional view of another example golf club head.
Figure 28:
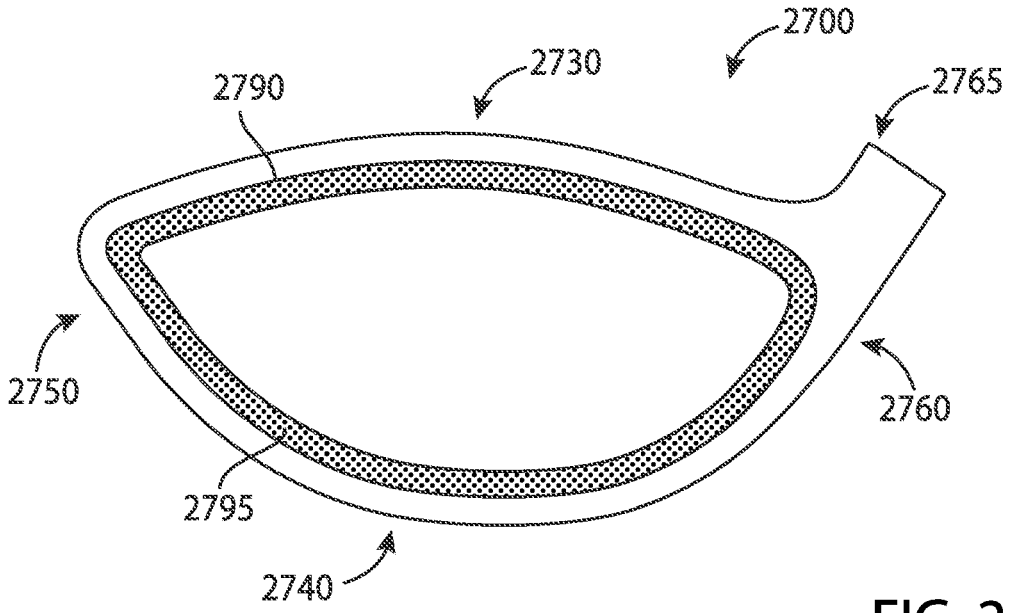
FIG. 28 depicts a schematic front cross-sectional view of the golf club head of FIG. 27.

In the example of FIGS. 27 and 28, a golf club head 2700 may include a body portion 2710. The golf club head 2700 may include a plurality of weight ports (e.g. one is generally shown as 2720) and a plurality of weight portions that may be similar in many respects to the weight ports and weight portions of the golf club heads described herein. Accordingly, a detailed description of the weight ports and the weight portions of the golf club head 2700 is not provided. Alternatively, the golf club head 2700 may not include any weight ports or weight portions. The body portion 2710 may include a top portion 2730, a bottom portion 2740, a toe portion 2750, a heel portion 2760, a front portion 2770, and a rear portion 2780. The bottom portion 2740 may include a skirt portion (not shown) defined as a side portion of the golf club head 2700 between the top portion 2730 and the bottom portion 2740 excluding the front portion 2770 and extending across a periphery of the golf club head 2700 from the toe portion, around the rear portion 2780, and to the heel portion 2760. The bottom portion 2740 may include one or more weight port regions (not shown). For example, a weight port region may include a plurality of weight ports, one of which is generally shown as 2720, to receive a plurality of weight portions (not shown). The front portion 2770 may include a face portion 2775 to engage a golf ball (not shown). The body portion 2710 may also include a hosel portion 2765 to receive a shaft (not shown). Alternatively, the body portion 2710 may include a bore (not shown) instead of a hosel portion 2765. For example, the body portion 2710 may be made partially or entirely of an aluminum-based material, a magnesium-type material, a steel-based material, a titanium-based material, any combination thereof, or any other suitable material. In another example the body portion 2710 may be made partially or entirely of a non-metal material such as a ceramic material, a composite material, any combination thereof, or any other suitable material.

The golf club head 2700 may have a club head volume greater than or equal to 300 cubic centimeters ($cm^3$ or cc). In one example, the golf club head 2700 may be about 460 cc. Alternatively, the golf club head 2700 may have a club head volume less than or equal to 300 cc. In particular, the golf club head 2700 may have a club head volume between 100 cc and 200 cc. The club head volume of the golf club head 2700 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 2700. Although FIGS. 27 and 28 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). Accordingly, the club head 2700 may be any type of club head such as the club heads described herein. The apparatus, methods, and articles of manufacture described herein are not limited in this regard.

The body portion 2710 may be a hollow body including one or more interior cavities 2790, which may be located in a transition region between the top portion 2730 and the front portion 2770, in a transition region between the toe portion 2750 and the front portion 2770, in a transition region between the bottom portion 2740 and the front portion 2770, and/or in a transition region between the heel portion 2760 and the front portion 2770. In FIGS. 27 and 28, the body portion 2710 includes an interior cavity 2790 that extends near the entire perimeter of the front portion 2770 in a transition region between the top portion 2730, the bottom portion 2740, the toe portion 2750, the heel portion 2760, and the front portion 2770. Accordingly, as shown in FIG. 28, the interior cavity 2790 may resemble a loop having generally the same shape as the perimeter of the front portion 2770.

In one example, the interior cavity 2790 may be unfilled (i.e., empty space). Alternatively, the interior cavity 2790 may be partially or entirely filled with an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. The elastic polymer or elastomer material is generally shown as 2795. For example, at least 50% of the interior cavity 2790 may be filled with a TPE material to absorb shock, isolate vibration, and/or dampen noise when the golf club head 2700 strikes a golf ball via the face portion 2775. At least partially or filling the interior cavity 2790 may also change the feel and sound of the golf club to an individual when striking a golf ball. The elastomer material may also provide structural support for the body portion 2710 near the interior cavity 2790. The elastomer material may be a non-foaming injection moldable elastomer material that can provide structural support for adjacent portions of the body portion. The apparatus, methods, and articles of manufacture described herein are not limited in this regard.

In one example, the interior cavity 2790 may be filled with an elastic polymer or elastomer material through at least one of the weight ports such as the weight port shown as 2720. For example, the weight port 2720 may include an interior port 2726 connecting the weight port 2720 to the interior cavity 2790. The interior cavity 2790 may be also filled with an elastic polymer or elastomer material through the hosel portion 2765. Alternatively, the body portion 2710 may include one or more openings (not shown) near the interior cavity 2790. An elastic polymer or elastomer material may be injected into the interior cavity 2790 through the one or more openings. The openings may then be closed after the process of injecting the elastic polymer with elastomer material into the interior cavity 2790 is complete. The apparatus, methods, and articles of manufacture described herein are not limited in this regard.

Figure 29:
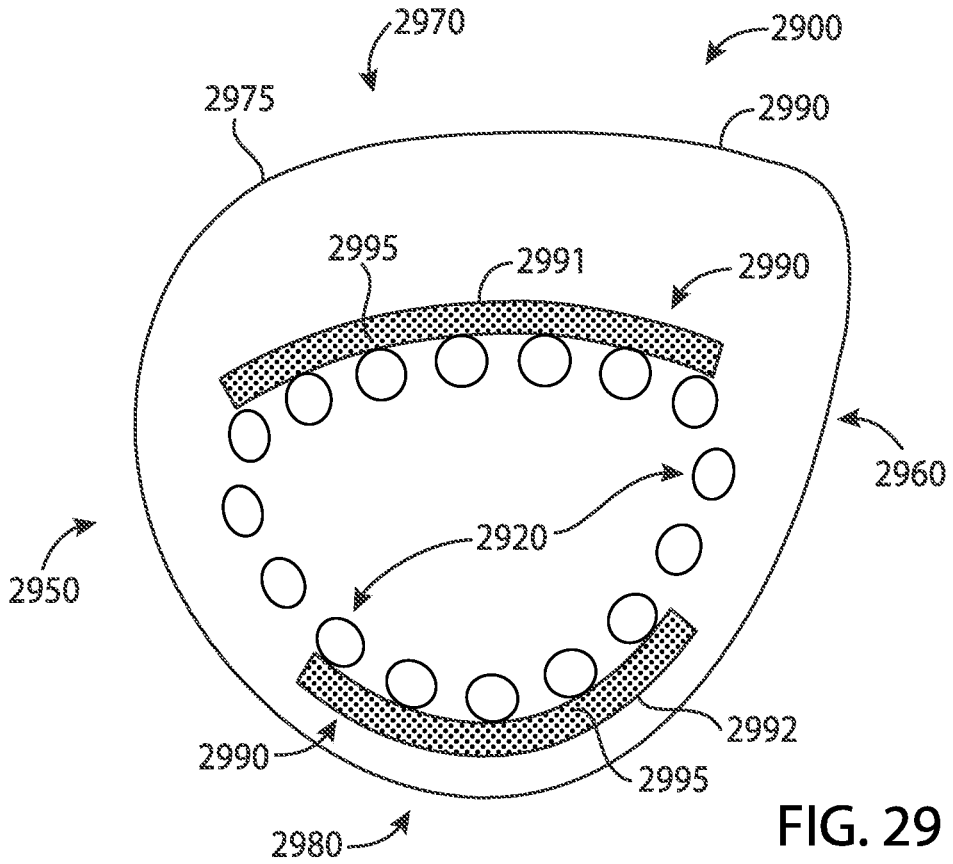
FIG. 29 depicts a schematic bottom cross-sectional view of another example golf club head.
Figure 30:
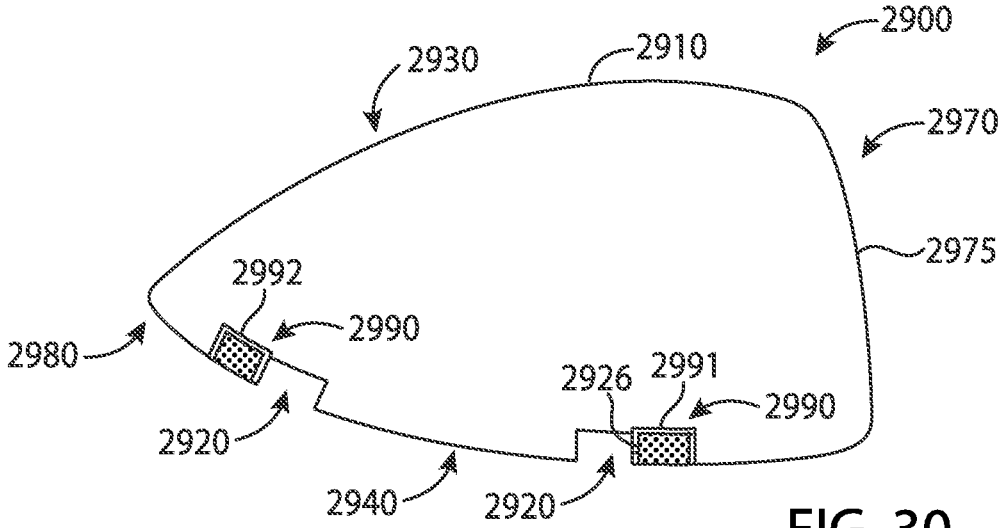
FIG. 30 depicts a schematic side cross-sectional view of the golf club head of FIG. 29.

In the example of FIGS. 29 and 30, a golf club head 2900 may include a body portion 2910. The golf club head 2900 may include a plurality of weight ports (e.g. one is generally shown as 2920) and a plurality of weight portions that may be similar in many respects to the weight ports and weight portions of the golf club heads described herein. Accordingly, a detailed description of the weight ports and the weight portions of the golf club head 2900 is not provided. Alternatively, the golf club head 2900 may not include any weight ports or weight portions. The body portion 2910 may include a top portion 2930, a bottom portion 2940, a toe portion 2950, a heel portion 2960, a front portion 2970, and a rear portion 2980. The bottom portion 2940 may include a skirt portion (not shown) defined as a side portion of the golf club head 2900 between the top portion 2930 and the bottom portion 2940 excluding the front portion 2970 and extending across a periphery of the golf club head 2900 from the toe portion, around the rear portion 2980, and to the heel portion 2960. The bottom portion 2940 may include one or more weight port regions (not shown). For example, a weight port region may include a plurality of weight ports, one of which is generally shown as 2920, to receive a plurality of weight portions (not shown). The front portion 2970 may include a face portion 2975 to engage a golf ball (not shown). The body portion 2910 may also include a hosel portion (not shown) to receive a shaft (not shown). Alternatively, the body portion 2910 may include a bore (not shown) instead of a hosel portion. For example, the body portion 2910 may be made partially or entirely of an aluminum-based material, a magnesium-type material, a steel-based material, a titanium-based material, any combination thereof, or any other suitable material. In another example the body portion 2910 may be made partially or entirely of a non-metal material such as a ceramic material, a composite material, any combination thereof, or any other suitable material.

The golf club head 2900 may have a club head volume greater than or equal to 300 cubic centimeters ($cm^3$ or cc). In one example, the golf club head 2900 may be about 460 cc. Alternatively, the golf club head 2900 may have a club head volume less than or equal to 300 cc. In particular, the golf club head 2900 may have a club head volume between 100 cc and 200 cc. The club head volume of the golf club head 2900 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 2900. Although FIGS. 29 and 30 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). Accordingly, the club head 2900 may be any type of club head such as the club heads described herein. The apparatus, methods, and articles of manufacture described herein are not limited in this regard.

The body portion 2910 may be a hollow body including one or more interior cavities 2990, which may at or near the bottom portion 2940 and/or in a transition region between the bottom portion 2940 and the front portion 2970, in a transition region between the bottom portion 2940 and the toe portion 2950, in a transition region between the bottom portion 2940 and the heel portion 2960, and/or in a transition region between the bottom portion 2940 and the rear portion 2980. In FIGS. 29 and 30, the body portion 2910 includes two interior cavities that are generally shown as interior cavities 2991 and 2992. The interior cavity 2991 may be at or near the bottom portion between the weight ports 2920 and the front portion 2970 and extend between the toe portion 2950 and the heel portion 2960. The interior cavity 2992 may be at or near the bottom portion between the weight ports 2920 and the rear portion 2980 and extend between the toe portion 2950 and the heel portion 2960. In one example, any one or both of the interior cavities 2991 and 2992 may be unfilled (i.e., empty space). Alternatively, the interior cavities 2991 and 2992 may be partially or entirely filled with an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. The elastic polymer or elastomer material is generally shown as 2995. For example, at least 50% of the interior cavities 2991 and 2992 may be filled with a TPE material to absorb shock, isolate vibration, and/or dampen noise when the golf club head 2900 strikes a golf ball via the face portion 2975. At least partially or filling the interior cavities 2991 and 2992 may also change the feel and sound of the golf club to an individual when striking a golf ball. The elastomer material may also provide structural support for the body portion 2910 near the interior cavities 2991 and 2992. The elastomer material may be a non-foaming injection moldable elastomer material that can provide structural support for adjacent portions of the body portion. The apparatus, methods, and articles of manufacture described herein are not limited in this regard.

In one example, the interior cavities 2991 and 2992 may be filled with an elastic polymer or elastomer material through at least one of the weight ports such as the weight port shown as 2920. For example, the weight port 2920 that is shown in FIG. 30 as being near the front portion 2970 may include an interior port 2926 connecting the weight port 2920 to the interior cavity 2991. Alternatively, the body portion 2910 may include one or more openings (not shown) near the interior cavities 2991 and 2992. An elastic polymer or elastomer material may be injected into the interior cavities 2991 and 2992 through the one or more openings. The openings may then be closed after the process of injecting the elastic polymer with elastomer material into the interior cavities 2991 and 2992 is complete. The apparatus, methods, and articles of manufacture described herein are not limited in this regard.

Figure 31:
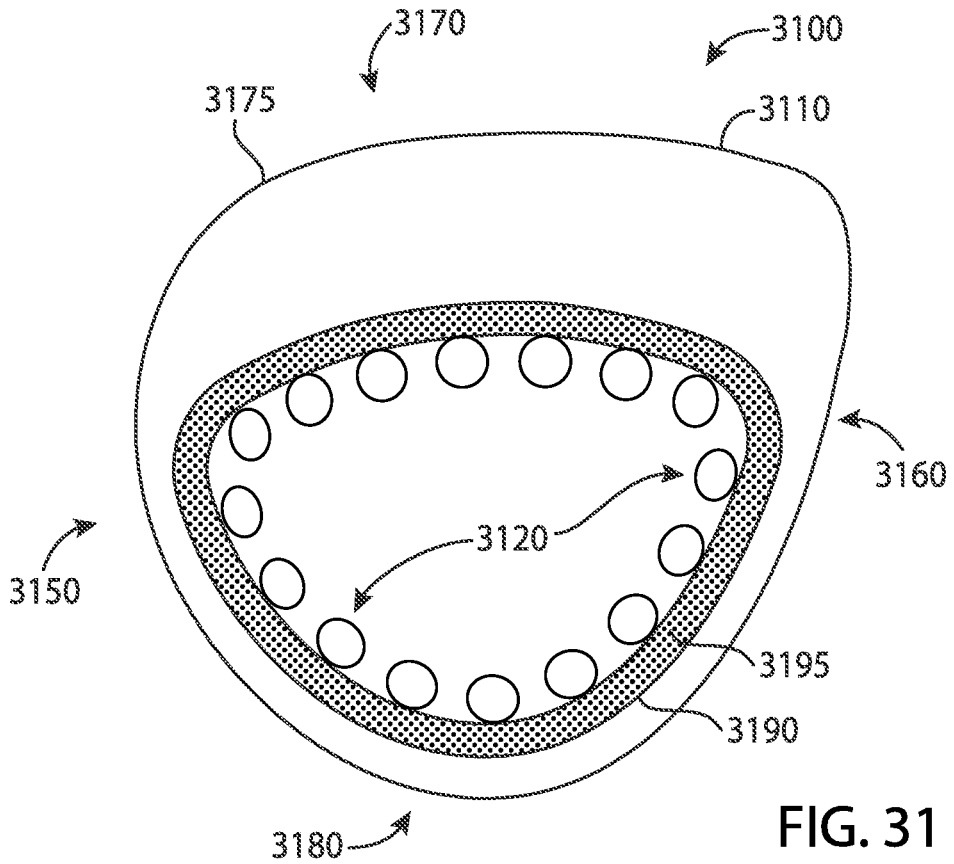
FIG. 31 depicts a schematic bottom cross-sectional view of another example golf club head.
Figure 32:
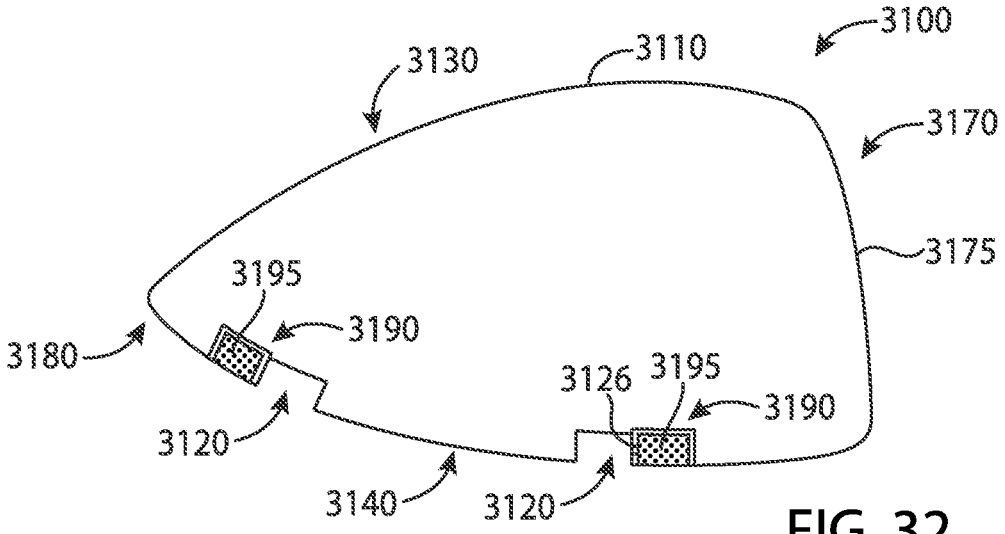
FIG. 32 depicts a schematic side cross-sectional view of the golf club head of FIG. 31.
Figure 33:
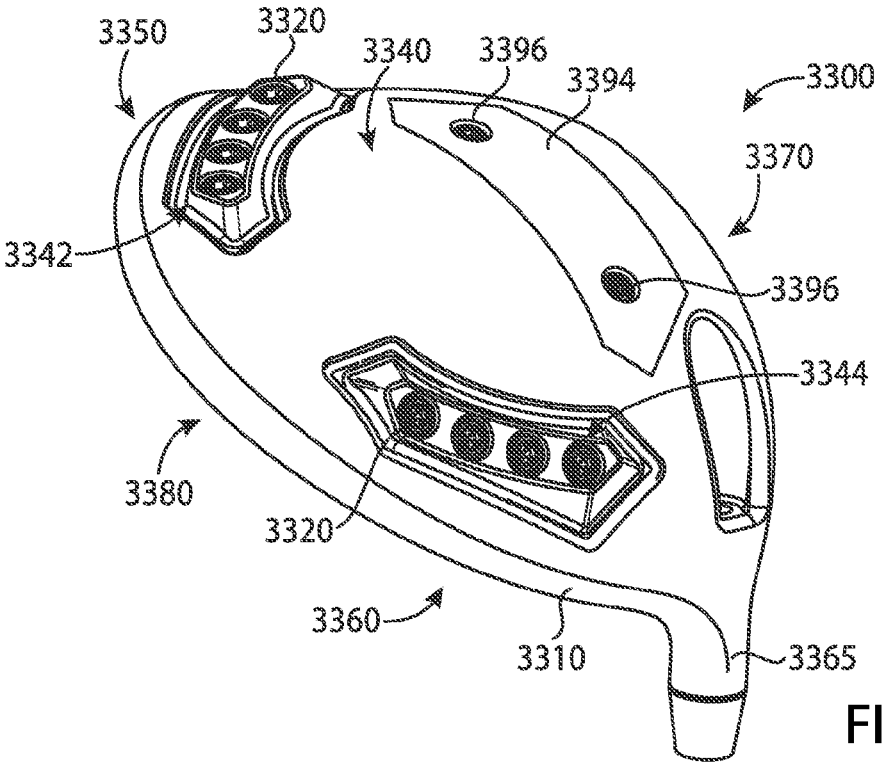
FIG. 33 depicts a bottom perspective view of another example golf club head.

In the example of FIGS. 31 and 32, a golf club head 3100 may include a body portion 3110. The golf club head 3100 may include a plurality of weight ports (e.g. one is generally shown as 3120) and a plurality of weight portions that may be similar in many respects to the weight ports and weight portions of the golf club heads described herein. Accordingly, a detailed description of the weight ports and the weight portions of the golf club head 3100 is not provided. Alternatively, the golf club head 3100 may not include any weight ports or weight portions. The body portion 3110 may include a top portion 3130, a bottom portion 3140, a toe portion 3150, a heel portion 3160, a front portion 3170, and a rear portion 3180. The bottom portion 3140 may include a skirt portion (not shown) defined as a side portion of the golf club head 3100 between the top portion 3130 and the bottom portion 3140 excluding the front portion 3170 and extending across a periphery of the golf club head 3100 from the toe portion, around the rear portion 3180, and to the heel portion 3160. The bottom portion 3140 may include one or more weight port region (not shown). For example, a weight port region may include a plurality of weight ports, one of which is generally shown as 3120, to receive a plurality of weight portions (not shown). The front portion 3170 may include a face portion 3175 to engage a golf ball (not shown). The body portion 3110 may also include a hosel portion (not shown) to receive a shaft (not shown). Alternatively, the body portion 3110 may include a bore (not shown) instead of a hosel portion. For example, the body portion 3110 may be made partially or entirely of an aluminum-based material, a magnesium-type material, a steel-based material, a titanium-based material, any combination thereof, or any other suitable material. In another example the body portion 3110 may be made partially or entirely of a non-metal material such as a ceramic material, a composite material, any combination thereof, or any other suitable material.

The golf club head 3100 may have a club head volume greater than or equal to 300 cubic centimeters ($cm^3$ or cc). In one example, the golf club head 3100 may be about 460 cc. Alternatively, the golf club head 3100 may have a club head volume less than or equal to 300 cc. In particular, the golf club head 3100 may have a club head volume between 100 cc and 200 cc. The club head volume of the golf club head 3100 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 3100. Although FIGS. 31 and 32 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). Accordingly, the club head 3100 may be any type of club head such as the club heads described herein. The apparatus, methods, and articles of manufacture described herein are not limited in this regard.

The body portion 3110 may be a hollow body including one or more interior cavities 3190, which may at or near the bottom portion 3140 between the front portion 3170, the toe portion 3150, the heel portion 3160 and the rear portion 3180. In FIGS. 31 and 32, the body portion 3110 includes an interior cavity 3190 that may be at or near the bottom portion and extend in a loop around the weight portions 3120. In one example, the interior cavity 3190 may be unfilled (i.e., empty space). Alternatively, the interior cavity 3190 may be partially or entirely filled with an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. The elastic polymer or elastomer material is generally shown as 3195. For example, at least 50% of the interior cavity 3190 may be filled with a TPE material to absorb shock, isolate vibration, and/or dampen noise when the golf club head 3100 strikes a golf ball via the face portion 3175. At least partially or filling the interior cavity 3190 may also change the feel and sound of the golf club to an individual when striking a golf ball. The elastomer material may also provide structural support for the body portion 3110 near the interior cavity 3190. The elastomer material may be a non-foaming injection moldable elastomer material that can provide structural support for adjacent portions of the body portion. The apparatus, methods, and articles of manufacture described herein are not limited in this regard.

In one example, the interior cavity 3190 may be filled with an elastic polymer or elastomer material through at least one of the weight ports 3120. For example, the weight port 3120 that is shown in FIG. 32 to be near the front portion 3170 may include an interior port 3126 connecting the weight port 3120 to the interior cavity 3190. Alternatively, the body portion 3110 may include one or more openings (not shown) near the interior cavity 3190. An elastic polymer or elastomer material may be injected into the interior cavity 3190 through the one or more openings. The openings may then be closed after the process of injecting the elastic polymer with elastomer material into the interior cavity 3190 is complete. The apparatus, methods, and articles of manufacture described herein are not limited in this regard.

A golf club head may include any one or a combination of the interior cavities 2590, 2790, 2990 and 3190. For example, a golf club head may include the interior cavities 2590 and 2990. In another example, a golf club head may include the interior cavities 2790 and 3190. In the examples provided herein, the interior cavities are shown to have a certain configuration. However, the interior cavities may have any configuration. For example, the interior cavities 2591 and/or 2592 may extend between the toe portion 2540 and the heel portion 2560 in a smaller length than shown in FIG. 26. In another example, the body portion 2510 may include a plurality of separate internal cavities of similar or different configurations that may be located in a transition region between the top portion 2530 and the front portion 2570, in a transition region between the bottom portion 2540 and the front portion 2570, in a transition region between the toe portion 2550 and the front portion 2570, and/or in a transition region between the heel portion 2560 and the front portion 2570. In another example, any one of the weight ports described herein may extend into any one of the interior cavities described herein. Accordingly, such weight ports may be partially or fully surrounded with an elastic polymer material if the corresponding interior cavity is filled with the elastic polymer material. The apparatus, methods, and articles of manufacture described herein are not limited in this regard.

In the example of FIGS. 33-41, a golf club head 3300 may include a body portion 3310. The golf club head 3300 may include a plurality of weight ports (e.g., one is generally shown as 3320) and a plurality of weight portions that may be similar in many respects to the weight ports and weight portions, respectively, of the golf club heads described herein. Accordingly, a detailed description of the weight ports and the weight portions of the golf club head 3300 is not provided. Alternatively, the golf club head 3300 may not include any weight ports or weight portions. The body portion 3310 may include a top portion 3330, a bottom portion 3340, a toe portion 3350, a heel portion 3360, a front portion 3370, and a rear portion 3380. The bottom portion 3340 may include a skirt portion (not shown) defined as a side portion of the golf club head 3300 between the top portion 3330 and the bottom portion 3340 excluding the front portion 3370 and extending across a periphery of the golf club head 3300 from the toe portion 3350, around the rear portion 3380, and to the heel portion 3360.

The bottom portion 3340 may include one or more weight port region, generally shown as a first weight port region 3342 and a second weight port region 3344. For example, each of the first and second weight port regions 3342 and 3344, respectively, may include a plurality of weight ports, one of which is generally shown as 3320, to receive a plurality of weight portions. The front portion 3370 may include a face portion 3375 to engage a golf ball (not shown). The body portion 3310 may also include a hosel portion 3365 to receive a shaft (not shown). Alternatively, the body portion 3310 may include a bore (not shown) instead of a hosel portion 3365. For example, the body portion 3310 may be made partially or entirely of an aluminum-based material, a magnesium-type material, a steel-based material, a titanium-based material, any combination thereof, or any other suitable material. In another example the body portion 3310 may be made partially or entirely of a non-metal material such as a ceramic material, a composite material, any combination thereof, or any other suitable material.

The golf club head 3300 may have a club head volume greater than or equal to 300 cubic centimeters ($cm^3$ or cc). In one example, the golf club head 3300 may be about 460 cc. Alternatively, the golf club head 3300 may have a club head volume less than or equal to 300 cc. In particular, the golf club head 3300 may have a club head volume between 100 cc and 200 cc. The club head volume of the golf club head 3300 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 3300. Although FIG. 33 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). Accordingly, the club head 3300 may be any type of club head such as the club heads described herein. The apparatus, methods, and articles of manufacture described herein are not limited in this regard.

The body portion 3310 may be a hollow body including a first interior cavity 3385 and a second interior cavity 3390. The first interior cavity 3385 and the second interior cavity 3390 may generally define a volume of the body portion 3310, with the first interior cavity substantially defining the volume of the body portion 3310. Accordingly, the first interior cavity 3385 may be substantially greater than the second interior cavity 3390. Alternatively, the first interior cavity 3385 may define the volume of the body portion 3310 when the second interior cavity 3385 is considered to be recess in the bottom portion 3340.

The second interior cavity 3390 may be near the bottom portion 3340 or at the bottom portion 3340 and extend between the front portion 3360 and the rear portion 3370. The second interior cavity 3390 may extend between the top portion 3380 and the bottom portion 3390. The second interior cavity 3390 may be defined by a recessed portion 3392 of the bottom portion 3340 that is covered with a bottom cover 3394. The space between the recessed portion 3392 of the bottom portion 3340 and the bottom cover 3394 may define the second interior cavity 3390. Accordingly, a portion of the bottom portion 3340 may be between the first interior cavity 3385 and the second interior cavity 3390. Alternatively, the bottom cover 3394 may be considered a portion of the bottom portion 3340 so that the second interior cavity 3390 is considered to be a part of the total volume of the body portion 3310. The second interior cavity 3390 may be at any location on the body portion 3310.

In one example, the second interior cavity 3390 may be near the front portion 3370 and have a length that extends between the toe portion 3350 and the heel portion 3360 and may be greater than or equal to a portion of the face portion 3375 that engages or strikes a golf ball. Accordingly, the second interior cavity 3390 may be located proximate and behind the face portion 3375. In one example, the second interior cavity 3390 may have any shape, configuration, length and/or width.

Figure 34:
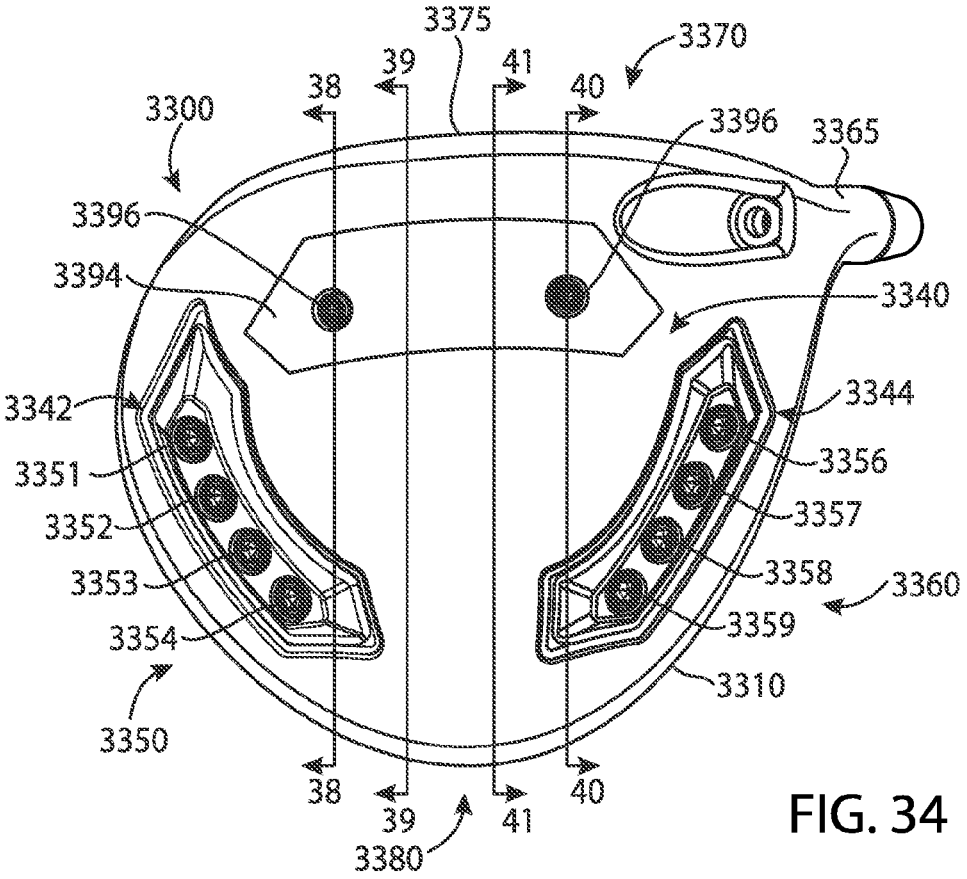
FIG. 34 depicts a bottom view of the golf club head of FIG. 33.
Figure 35:
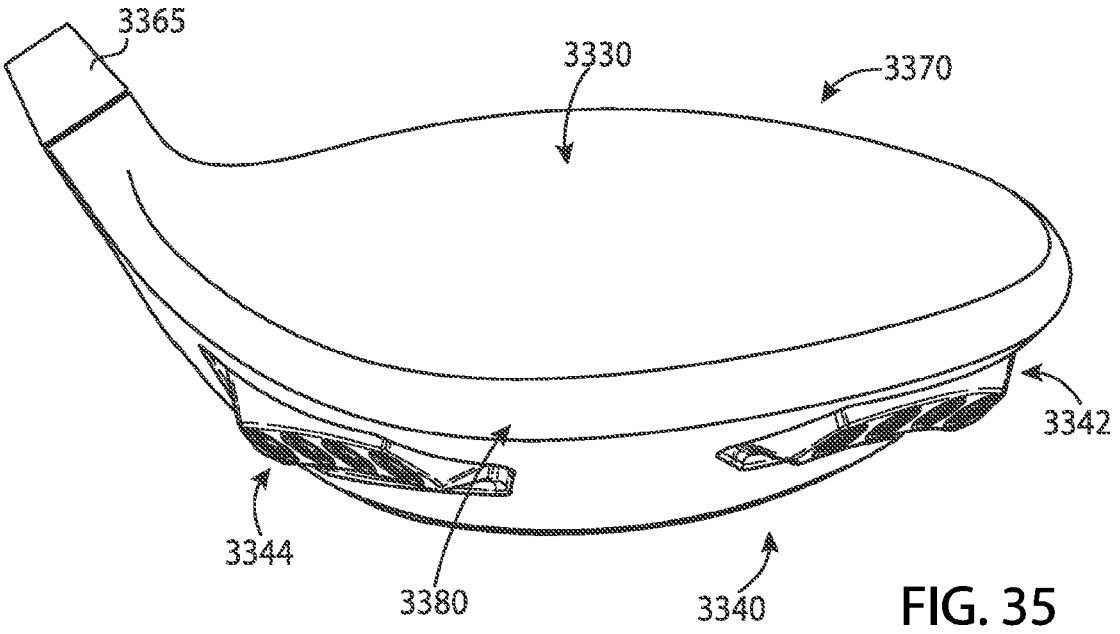
FIG. 35 depicts a rear view of the golf club head of FIG. 33.
Figure 36:
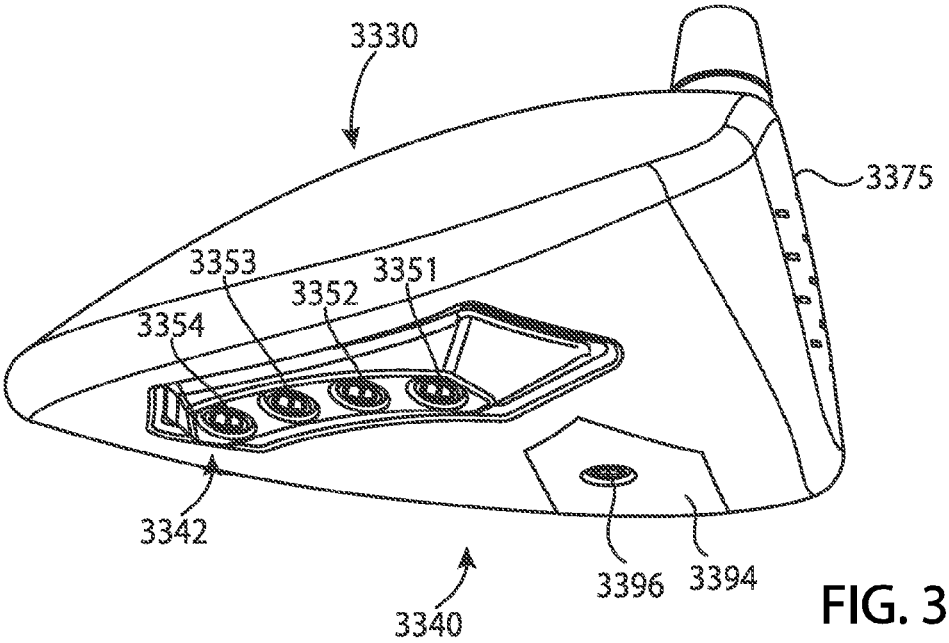
FIG. 36 depicts a toe view of the golf club head of FIG. 33.
Figure 37:
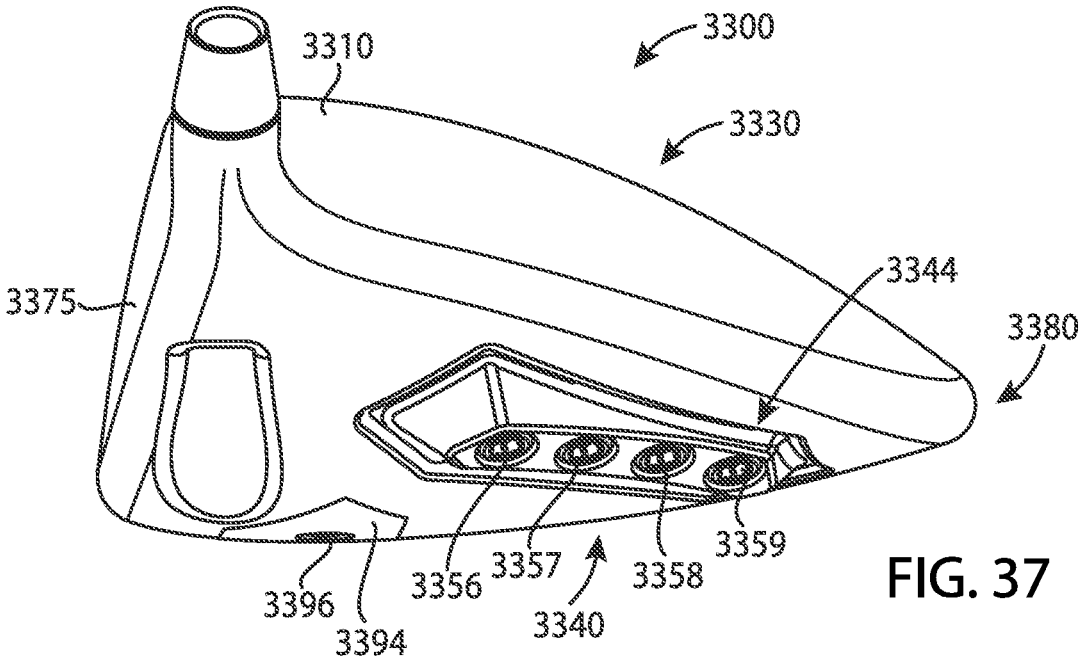
FIG. 37 depicts a heel view of the golf club head of FIG. 33.
Figure 38:
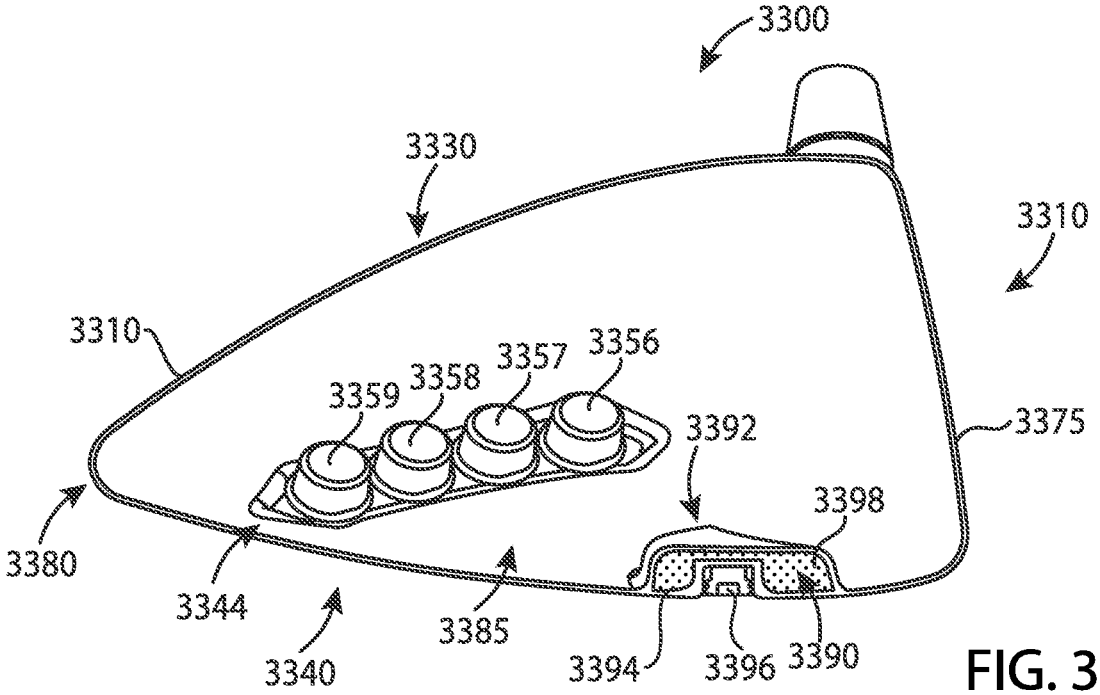
FIG. 38 depicts a side cross-sectional view of the golf club head of FIG. 33 along line 38-38.
Figure 39:
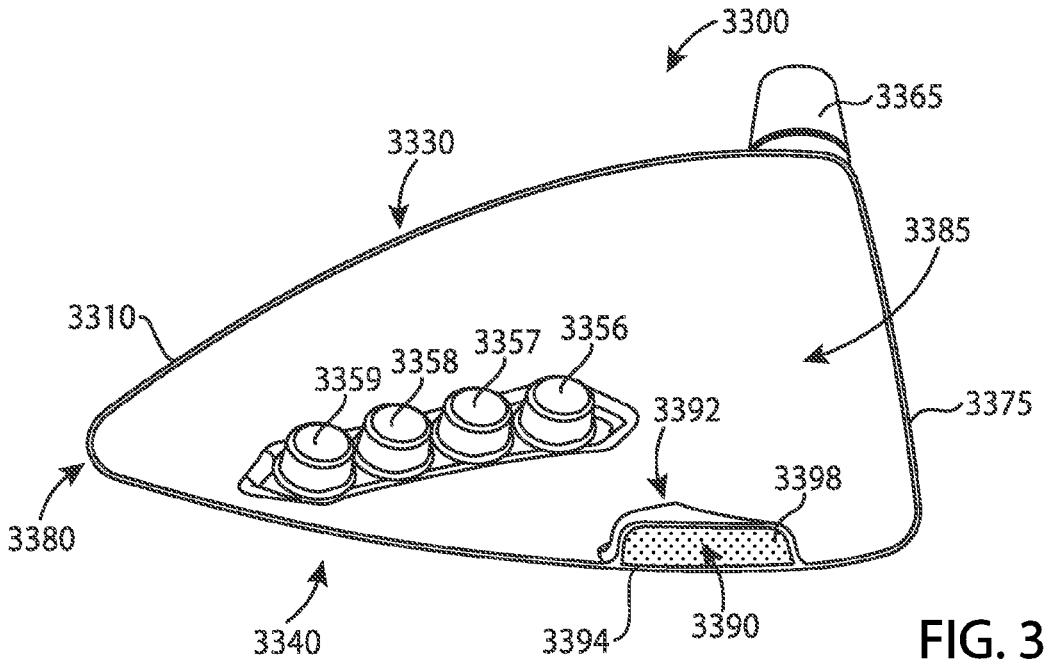
FIG. 39 depicts another side cross-sectional view of the golf club head of FIG. 33 along line 39-39.
Figure 40:
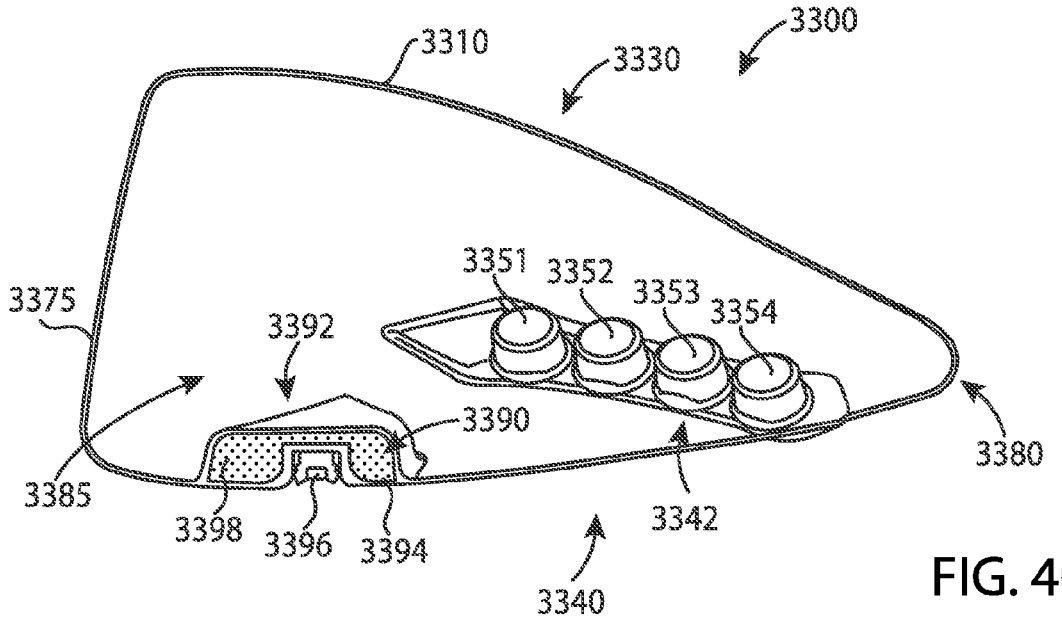
FIG. 40 depicts another side cross-sectional view of the golf club head of FIG. 33 along line 40-40.
Figure 41:
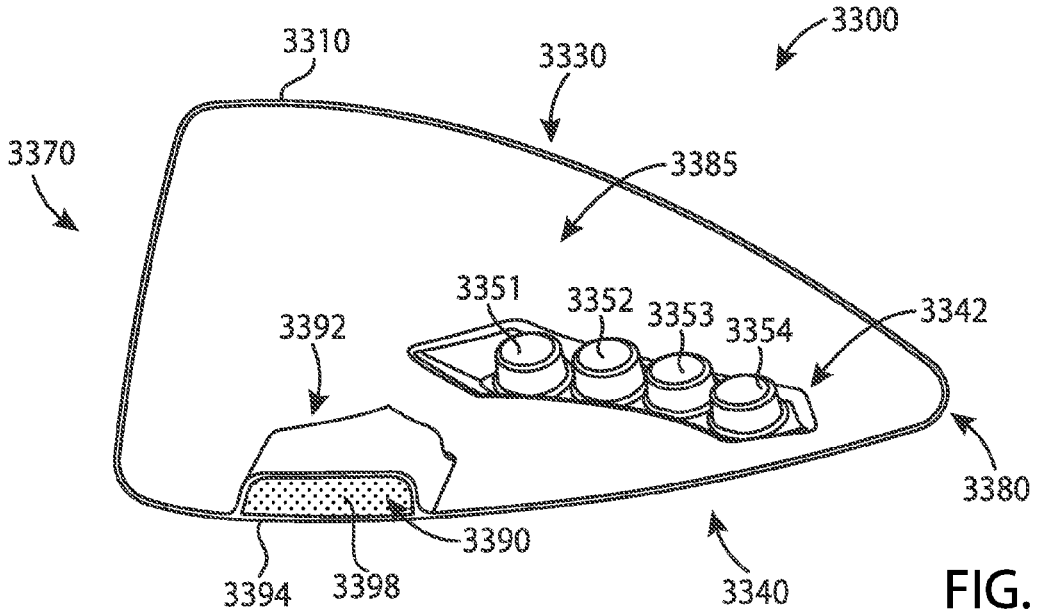
FIG. 41 depicts another side cross-sectional view of the golf club head of FIG. 33 along line 41-41.
Figure 42:
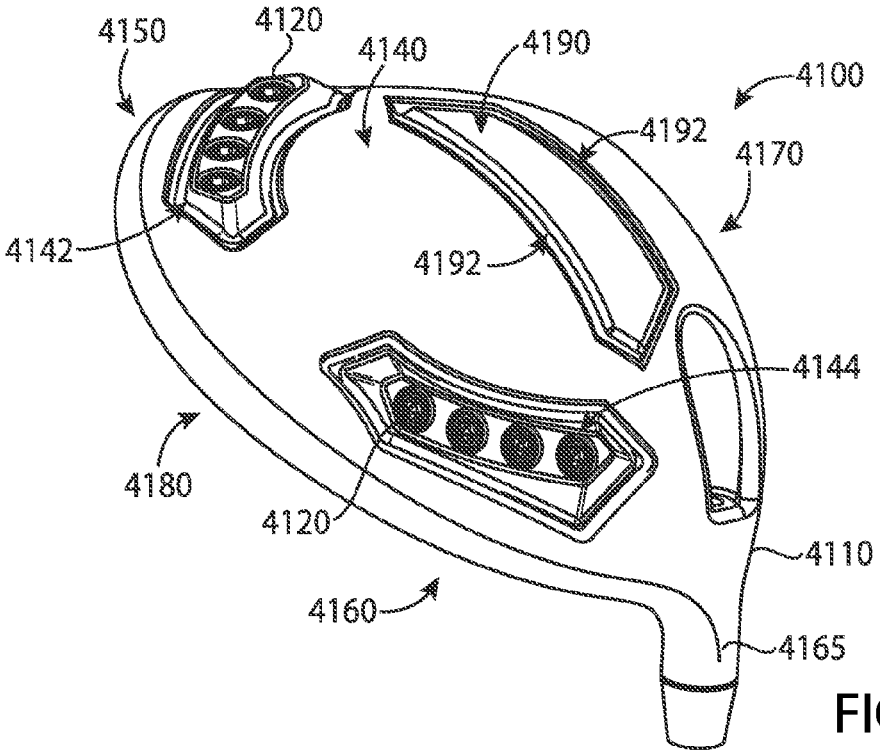
FIG. 42 depicts a bottom perspective view of another example golf club head.

In one example, the second interior cavity 2390 may be unfilled (i.e., empty space). Alternatively, the second interior cavity 3390 may be partially or entirely filled with an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. For example, at least 50% of the second interior cavity 3390 may be filled with a TPE material to absorb shock, isolate vibration, and/or dampen noise when the golf club head 3300 strikes a golf ball via the face portion 3375. As described herein, the second interior cavity 3390 may be near and behind the face portion 3375. When the face portion 3375 strikes a golf ball, the resulting vibrations that may propagate from the face portion 3375 to the rest of the body portion 3310 may be at least partially absorbed and dampened by the second interior cavity 3390 and/or the material by which the second interior cavity 3390 may be filled. Accordingly, the second interior cavity 3390 may provide vibration and noise dampening. Further, the second interior cavity 3390 may provide a preferred sound and feel to an individual. The second interior cavity 3390 may have any shape so as to provide the function of vibration and noise dampening as described herein. For example, the second interior cavity 3390 may have a rectangular, triangular or polygonal shape. Further, the length and width of the second interior cavity 3390 may be determined so as to provide vibration and noise dampening as described herein. For example, the shape, length and/or width of the second interior cavity 3390 may change depending on the shape, size, volume and/or materials of construction of the body portion 3310. In one example, the second interior cavity 3390 may extend generally parallel to the face portion 3375 as shown in FIG. 34. In one example (not shown), the second interior cavity 3390 may be closer to the face portion 3375 near a center portion of the face portion 3375 and farther from the face portion 3375 near the toe portion 3350 and the heel portion 3360. In one example (not shown), the shape and size of the second interior cavity 3390 may be determined by numerical analysis (e.g., finite element analysis) and/or experimental analysis (e.g., vibration testing) so as to provide a particular or an optimum vibration, noise dampening, sound and/or feel. The apparatus, methods, and articles of manufacture described herein are not limited in this regard.

In one example, the second interior cavity 3390 may be filled with an elastic polymer or elastomer material (e.g., shown as 3398) by filling the recessed portion 3392 of the bottom portion 3340 with elastomer polymer or elastomer material, and then attaching the bottom cover 3394 over the recessed portion 3392. Alternatively, the bottom cover 3394 may be initially placed over the recessed portion 3392 and then attached to the bottom portion 3340 with one of the fasteners 3396. Elastic polymer or elastomer material may then be injected into the interior cavity 3390 through a fastener port or another one of the fasteners 3396 for the bottom cover 3394. After the second interior cavity 3390 is filled, all of the fasteners for the bottom cover 3394 may fastened to completely attach the bottom cover 3394 over the recessed portion 3392. In another example, the bottom cover 3394 may be fastened to the bottom portion 3340 prior to filling the second interior cavity 3390 with an elastic polymer or an elastomer material. The bottom cover 3340 or the body portion 3310 may include a port (not shown) that provides access to the second interior cavity 3390. The second interior cavity 3390 may be then filled with an elastic polymer or an elastomer material through the port. The port may then be filled or closed with a plug and/or adhesive. In another example, a combination of the methods described herein including the methods described below may be used to fill the second interior cavity 3390 with an elastic polymer or elastomer material. The apparatus, methods, and articles of manufacture described herein are not limited in this regard.

In one example, the bottom portion 3340 may include a first weight port region 3342 and a second weight port region 3344. Each of the weight port regions 3342 and 3344 may be defined by a portion of the outer surface of the bottom portion 3340 such as the examples described herein and shown in FIGS. 9 and 10. In one example, each of the weight port regions 3342 and 3344 may be defined by a recessed portion of the bottom portion 3340 (not shown). In one example, each of the weight port regions 3342 and 3344 may be defined by a protruded portion of the bottom portion 3340 as shown in FIGS. 33-41. Accordingly, each weight port region 3342 and 3344 may provide a platform on the bottom portion 3340 for accommodating a plurality of weight ports 3320. In one example, each of the weight port regions 3342 and 3344 may be a separate weight port region as shown in FIGS. 33-41. In one example, the weight port regions 3342 and 3344 may be connected to define a single weight port region having a plurality of weight ports with each weight port configured to receive a weight portion of a plurality of weight portions. The apparatus, methods, and articles of manufacture described herein are not limited in this regard.

The first weight port region 3342 may include a plurality of weight ports. In one example, the first weight port region 3342 may include four weight ports, which are generally shown as 3351, 3352, 3353 and 3354. The first weight port region 3342 may be near the toe portion 3350 and extend between the front portion 3370 and the rear portion 3380. The first weight port region 3342 may have any configuration, size and/or shape. In one example, the first weight port region 3342 may generally extend near the toe portion 3350 similar to the contour of the body portion 3310 at the toe portion 3350. Each weight port 3351-3354 of the first weight port region 3342 may be associated with a first port diameter and configured to receive at least one weight portion of a plurality of weight portions. Two adjacent weight ports of the first weight port region 3342 may be separated by less than or equal to the first port diameter. The port diameter associated with each weight port of the first weight port region 3342, the distance between adjacent weight ports of the first weight port region 3342, and the configuration of each weight portion of the plurality of weight portions may be similar in many respects to the example weight ports and weight portions described herein. Accordingly, a detailed description of the weight ports of the first weight port region 3342 and the weight portions received in the weight ports of the first weight port region 3342 is not provided.

The first weight port region 3342 may be a separate piece from the bottom portion 3340 and/or constructed from a different material than the bottom portion 3340. For example, the first weight port region 3342 may be constructed from one or more non-metallic composite materials and attached to the bottom portion 3340 or attached in a corresponding recess (not shown) in the bottom portion 3340. The first weight port region 3342 may include the weight ports 3351, 3352, 3353, and 3354. Each of the weight ports 3351, 3352, 3353, and 3354 may be threaded to receive a weight portion as described herein. Alternatively, each of the weight ports 3351, 3352, 3353, and 3354 may include a threaded metallic sleeve for receiving a weight portion as described herein when the first weight port region 3342 is constructed from a non-metallic material such as a composite material. The apparatus, methods, and articles of manufacture described herein are not limited in this regard.

The weight ports 3351, 3352, 3353, and 3354 of the first weight port region 3342 may be partially or fully surrounded and enveloped by an elastic polymer or elastomer material or any of the suitable materials described herein to absorb shock, isolate vibration, and/or dampen noise. According to one example, the first weight port region 3342 and the weight ports 3351, 3352, 3353, and 3354 may be similar in many respects to the second interior cavity 4790 and the weight ports 4720 of the example of FIG. 47. Accordingly, a detailed description of the first weight port region 3342 is not provided. Similar to the example of FIG. 47, the first weight port region 3342 may define an interior cavity (not shown), through which each of the weight ports 3351, 3352, 3353, and 3354 extends. The interior cavity may be then partially or fully filled with an elastic polymer or elastomer material that may partially or fully surround the weight ports 3351, 3352, 3353, and 3354. The apparatus, methods, and articles of manufacture described herein are not limited in this regard.

The second weight port region 3344 may include a plurality of weight ports. In one example, the second weight port region 3344 may include four weight ports, which are generally shown as 3356, 3357, 3358 and 3359. The second weight port region 3344 may be near the heel portion 3360 and extend between the front portion 3370 and the rear portion 3380. The second weight port region 3344 may have any configuration, size and/or shape. In one example, the second weight port region 3344 may generally extend near the heel portion 3360 similar to the contour of the body portion 3310 at the heel portion 3360. Each weight port 3356-3359 of the second weight port region 3344 may be associated with a second port diameter and configured to receive at least one weight portion of a plurality of weight portions. Two adjacent weight ports of the second weight port region 3344 may be separated by less than or equal to the second port diameter. The first port diameter may be similar to the second port diameter or different from the second port diameter. In one example, the first port diameter may be similar to the second port diameter so that each weight portion of the plurality of weight portions may be interchangeably used in the weight ports of the first weight port region 3342 and the second weight port region 3344. The port diameter associated with each weight port of the second weight port region 3344, the distance between adjacent weight ports of the second weight port region 3344, and the configuration of each weight portion of the plurality of weight portions may be similar in many respects to the example weight ports and weight portions described herein. Accordingly, a detailed description of the weight ports of the second weight port region 3344 and the weight portions received in the weight ports of the second weight port region 3344 is not provided.

The second weight port region 3344 may be a separate piece from the bottom portion 3340 and constructed from a different material than the bottom portion 3340. For example, the second weight port region 3344 may be constructed from one or more non-metallic composite materials and attached to the bottom portion 3340 or attached in a corresponding recess (not shown) in the bottom portion 3340. The second weight port region 3344 may include the weight ports 3356, 3357, 3358, and 3359. Each of the weight ports 3356, 3357, 3358, and 3359 may be threaded to receive a weight portion as described herein. Alternatively, each of weight the ports 3356, 3357, 3358, and 3359 may include a threaded metallic sleeve for receiving a weight portion as described herein when the second weight port region 3344 is constructed from a non-metallic material such as a composite material. The apparatus, methods, and articles of manufacture described herein are not limited in this regard.

The weight ports 3356, 3357, 3358, and 3359 of the second weight port region 3344 may be partially or fully surrounded and enveloped by an elastic polymer or elastomer material or any of the suitable materials described herein to absorb shock, isolate vibration, and/or dampen noise. According to one example, the second weight port region 3344 and the weight ports 3356, 3357, 3358, and 3359 may be similar in many respects to the second interior cavity 4790 and the weight ports 4720 of the example of FIG. 47. Accordingly, a detailed description of the weight port region 3342 is not provided. Similar to the example of FIG. 47, the second weight port region 3344 may define an interior cavity (not shown), through which each of the weight ports 3356, 3357, 3358, and 3359 extends. The interior cavity may be then partially or fully filled with an elastic polymer or elastomer material that may partially or fully surround the weight ports 3356, 3357, 3358, and 3359. The apparatus, methods, and articles of manufacture described herein are not limited in this regard.

In the example of FIGS. 41-46, a golf club head 4100 may include a body portion 4110. The golf club head 4100 may include a plurality of weight ports (e.g., one is generally shown as 4120) and a plurality of weight portions. Alternatively, the golf club head 4100 may not include any weight ports or weight portions. The body portion 4110 may include a top portion 4130, a bottom portion 4140, a toe portion 4150, a heel portion 4160, a front portion 4170, and a rear portion 4180. The bottom portion 4140 may include a skirt portion (not shown) defined as a side portion of the golf club head 4100 between the top portion 4130 and the bottom portion 4140 excluding the front portion 4170 and extending across a periphery of the golf club head 4100 from the toe portion 4150, around the rear portion 4180, and to the heel portion 4160. The bottom portion 4140 may include at least one weight port region, generally shown as a first weight port region 4142 and a second weight port region 4144. For example, each of the first and second weight port regions

4142 and 4144, respectively, may include a plurality of weight ports, one of which is generally shown as 4120, to receive the plurality of weight portions. The first and second weight port regions 4142 and 4144, the plurality of weight ports of the first and second weight port regions 4142 and 4144, and the plurality of weight portions received in the first and second weight port regions 4142 and 4144 may be similar in many respect to the first and second weight port regions 3342 and 3344, respectively, and the other examples described herein. Further, the first and second weight port regions 4142 and 4144 may be constructed from a different material than the bottom portion 4140 and filled with an elastic or elastomer material such that the weight ports of the weight port regions 4142 and 4144 may be partially or fully surrounded by the elastic polymer material as described in detail. Accordingly, a detailed description of the first and second weight port regions 4142 and 4144 is not provided.

The front portion 4170 may include a face portion 4175 to engage a golf ball (not shown). The body portion 4110 may also include a hosel portion 4165 to receive a shaft (not shown). Alternatively, the body portion 4110 may include a bore (not shown) instead of a hosel portion 4165. For example, the body portion 4110 may be made partially or entirely of an aluminum-based material, a magnesium-type material, a steel-based material, a titanium-based material, any combination thereof, or any other suitable material. In another example the body portion 4110 may be made partially or entirely of a non-metal material such as a ceramic material, a composite material, any combination thereof, or any other suitable material.

The golf club head 4100 may have a club head volume greater than or equal to 300 cubic centimeters ($cm^3$ or cc). In one example, the golf club head 4100 may be about 460 cc. Alternatively, the golf club head 4100 may have a club head volume less than or equal to 300 cc. In particular, the golf club head 4100 may have a club head volume between 100 cc and 200 cc. The club head volume of the golf club head 4100 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 4100. Although FIG. 42 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). Accordingly, the club head 4100 may be any type of club head such as the club heads described herein. The apparatus, methods, and articles of manufacture described herein are not limited in this regard.

The body portion 4110 may be a hollow body including an interior cavity (not shown), which may be similar in many respect to the first interior cavity 3385 of the example of FIGS. 33-40. The bottom portion 4140 may include a recessed region 4190 that may extend between the front portion 4170 and the rear portion 4180 and between the toe portion 4150 and the heel portion 4160. However, the bottom portion may not include the recessed region 4190. The recessed region 4190 may be defined by a recess or a groove 4192 in the bottom portion 4190. In one example, the recessed region 4190 may be near the front portion 4170 and have a length that extends between the toe portion 4150 and the heel portion 4160 and is greater than or equal to a portion of the face portion 4175 that engages or strikes a golf ball. Accordingly, recessed region 4190 may be located proximate and behind the face portion 4175. In one example, recessed region 4190 may have any length and/or width. The recessed region 4190 may be at any location on the body portion 4110.

Figure 43:
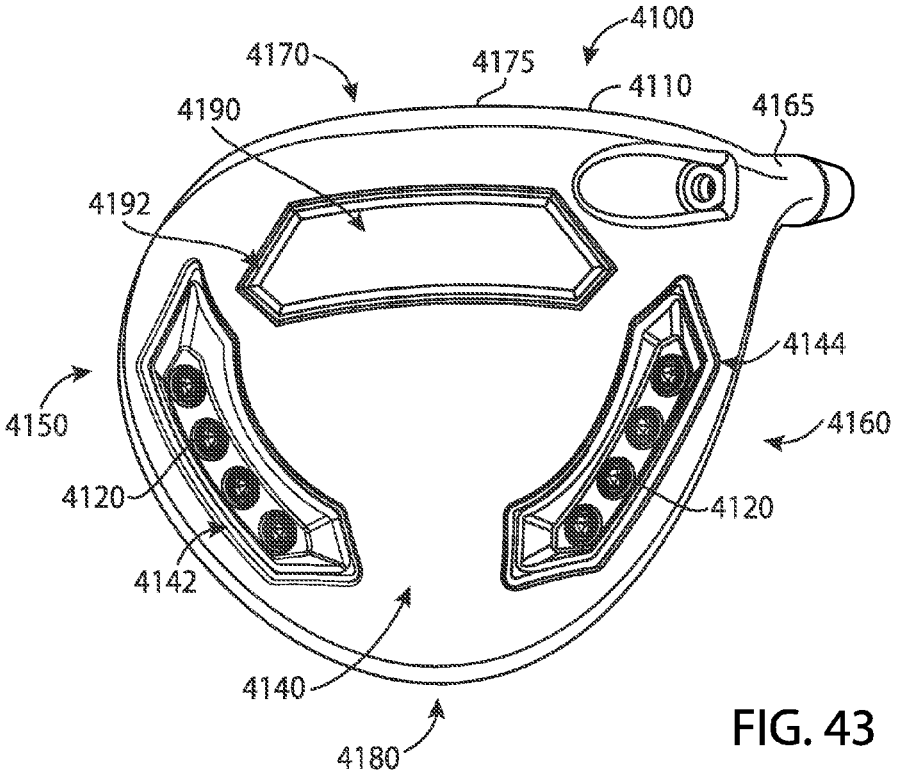
FIG. 43 depicts a bottom view of the golf club head of FIG. 42.
Figure 44:
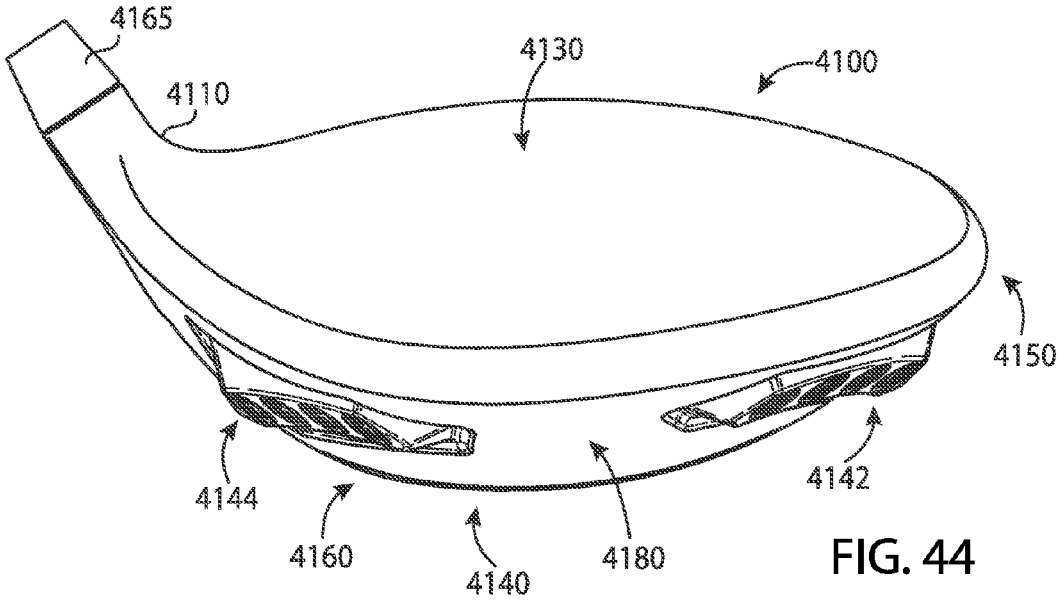
FIG. 44 depicts a rear view of the golf club head of FIG. 42.
Figure 45:
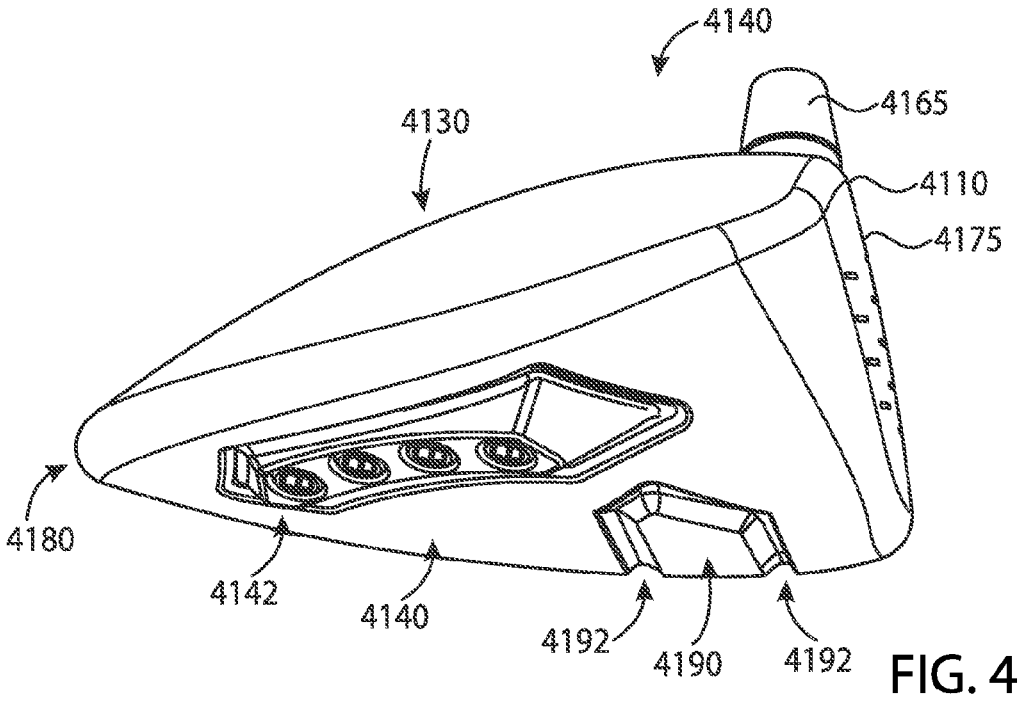
FIG. 45 depicts a toe view of the golf club head of FIG. 42.
Figure 46:
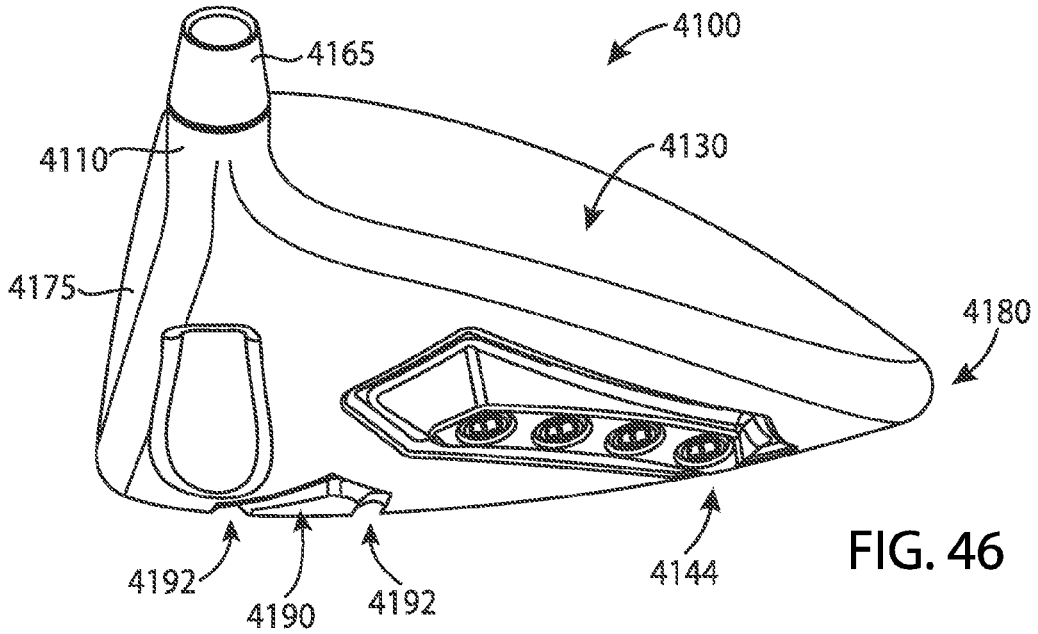
FIG. 46 depicts a heel view of the golf club head of FIG. 42.

The recessed region 4190, which may be defined by the groove 4192, may change the stiffness of the bottom portion 4140. Accordingly, the recessed region 4190 may change the noise and dampening characteristics of the body portion 4100 when the face portion 4175 strikes a golf ball. The characteristics of the vibrations that may propagate from the face portion 4175 to the rest of the body portion 4110 when the face portion 4175 strikes a golf ball may be changed and/or dampened by the recessed region 4190. Accordingly, the recessed region 4190 may provide vibration and noise dampening. Further, the recessed region 4190 may provide a preferred sound and feel to an individual when striking a golf ball (not shown). The recessed region 4190 may have any shape so as to provide a function of vibration and noise dampening as described herein. For example, the recessed region 4190 may have a rectangular, triangular or polygonal shape. Further, the length and width of the recessed region 4190 may be determined so as to provide vibration and noise dampening as described herein. For example, the shape, length and/or width of the recessed region 4190 may change depending on the shape, size, volume and/or materials of construction of the body portion 4110. In one example, the recessed region 4190 may extend generally parallel to the face portion 4175 as shown in FIG. 43. In one example (not shown), the recessed region may be closer to the face portion 4175 near a center portion of the face portion 4175 and farther from the face portion 4175 near the toe portion 4150 and the heel portion 4160. In one example (not shown), the shape and size of the recessed region 4190 and the shape, width and depth of the groove 4192 may be determined by numerical analysis (e.g., finite element analysis) and/or experimental analysis (e.g., vibration testing) so as to provide a particular or an optimum vibration and noise dampening. The recessed region 4190 may include additional grooves, dimples, projections, ridges of the like for providing particular vibration, dampening and noise characteristics for the body portion 4100. The apparatus, methods, and articles of manufacture described herein are not limited in this regard.

Figure 47:
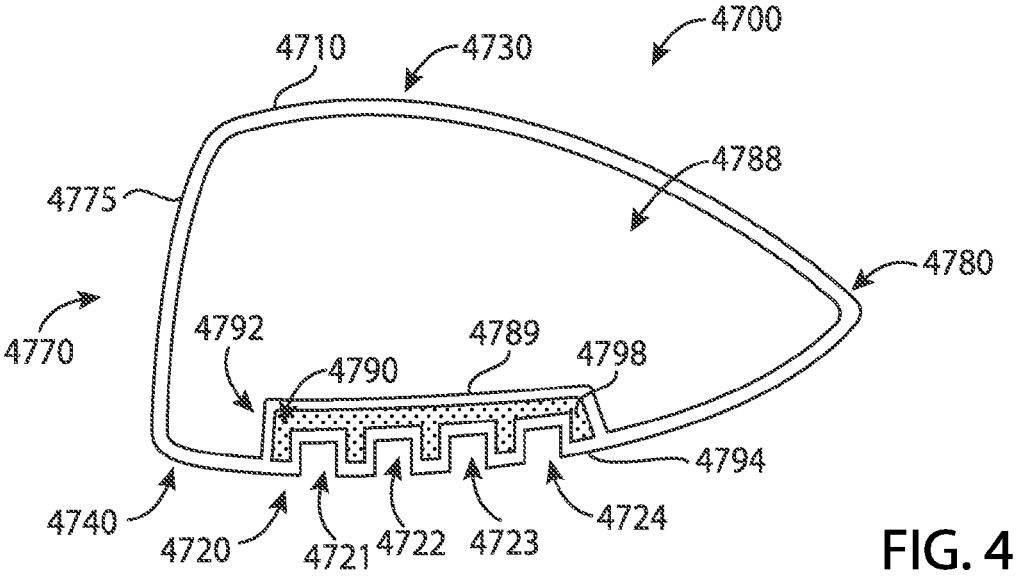
FIG. 47 depicts a schematic side cross-sectional view of another example golf club head.
Figure 48:
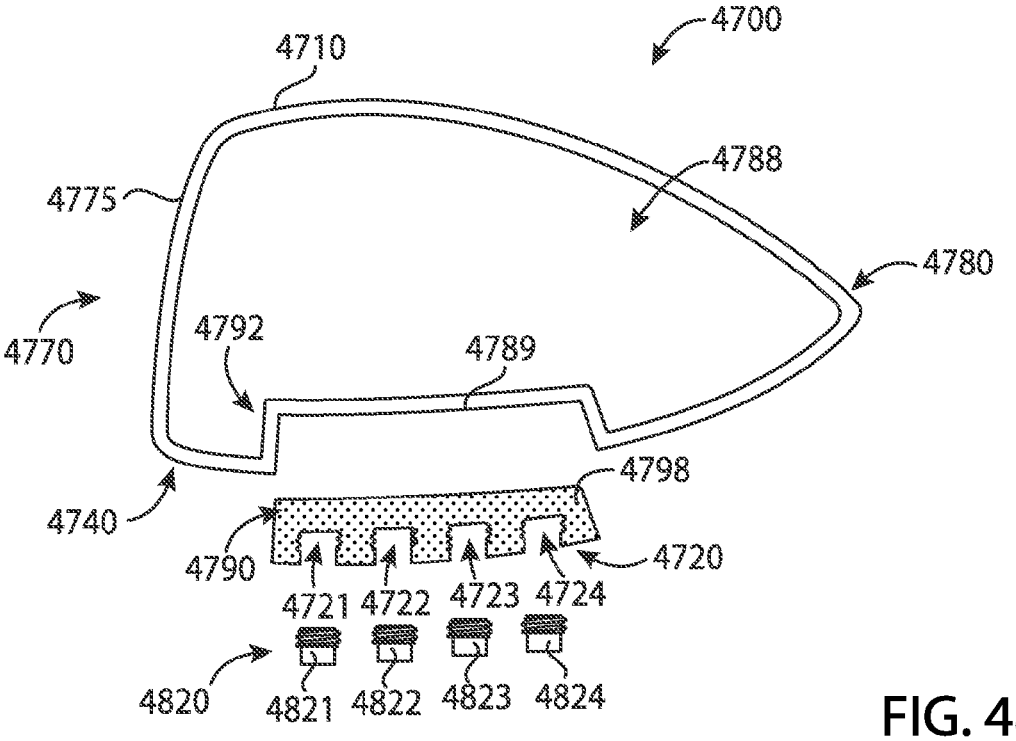
FIG. 48 depicts a schematic exploded cross-sectional view of the golf club head of FIG. 47.

In the example of FIGS. 47 and 48, a golf club head 4700 may include a body portion 4710. The golf club head 4700 may include a plurality of weight ports 4720 (e.g., four weight ports are generally shown as 4721, 4722, 4723, and 4724) that may be similar in many respects to the weight ports and weight portions, respectively, of the golf club heads described herein. Accordingly, a detailed description of the weight ports and the weight portions of the golf club head 4700 is not provided.

The body portion 4710 may include a top portion 4730, a bottom portion 4740, a toe portion (not shown), a heel portion (not shown), a front portion 4770, and a rear portion 4780. The bottom portion 4740 may include a skirt portion (not shown) defined as a side portion of the golf club head 4700 between the top portion 4730 and the bottom portion 4740 excluding the front portion 4770 and extending across a periphery of the golf club head 4700 from the toe portion, around the rear portion 4780, and to the heel portion. The bottom portion 4740 may include one or more weight port regions. In the example of FIG. 47, a weight port region 4715 is shown. A weight port region may include a plurality of weight ports, one of which is generally shown as 4720, to receive a plurality of weight portions, which are generally shown as 4820 in FIG. 48 (e.g., weight portions 4821, 4822, 4823 and 4824). The front portion 4770 may include a face portion 4775 to engage a golf ball (not shown). The body portion 4710 may also include a hosel portion (not shown) to receive a shaft (not shown). Alternatively, the body portion 4710 may include a bore (not shown) instead of a hosel portion (not shown). For example, the body portion 4710 may be made partially or entirely of an aluminum-based material, a magnesium-type material, a steel-based material, a titanium-based material, any combination thereof, or any other suitable material. In another example the body portion 4710 may be made partially or entirely of a non-metal material such as a ceramic material, a composite material, any combination thereof, or any other suitable material.

The golf club head 4700 may have a club head volume greater than or equal to 300 cubic centimeters ($cm^3$ or cc). In one example, the golf club head 4700 may be about 460 cc. Alternatively, the golf club head 4700 may have a club head volume less than or equal to 300 cc. In particular, the golf club head 4700 may have a club head volume between 100 cc and 200 cc. The club head volume of the golf club head 4700 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 4700. Although FIG. 47 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). Accordingly, the club head 4700 may be any type of club head such as the club heads described herein. The apparatus, methods, and articles of manufacture described herein are not limited in this regard.

The body portion 4710 may be a hollow body including a first interior cavity 4788 that may extend from the front portion 4770 to the rear portion 4780 and from the toe portion to the heel portion. The body portion 4710 may include a second interior cavity 4790 near the bottom portion 4740 or at the bottom portion 4740 and extending between the front portion 4760 and the rear portion 4770. The second interior cavity 4790 may extend between the top portion 4730 and the bottom portion 4740. The first interior cavity 4788 and the second interior cavity 4790 may be separated by a cavity wall 4789. The second interior cavity 4790 may be an integral part of the golf club head 4710. In other words, the second interior cavity may be located between the bottom portion 4740 and the top portion 4730. Alternatively, as shown in FIG. 48, the second interior cavity 4790 may be defined by a separate and hollow weight port region 4715 that may be attached in a recessed portion 4792 of the bottom portion 4740.

The weight port region 4715 includes the weight ports 4720 (generally shown as weight ports 4721, 4722, 4723 and 4724). The weight ports 4720 may be defined by ports that extend into the hollow weight port region 4715 (i.e., into the second interior cavity 4790). The second interior cavity 4790 may surround and envelop the weight ports 4720. In one example, the second interior cavity 4790 may be unfilled (i.e., empty space). Alternatively, the second interior cavity 4790 may be partially or entirely filled with an elastic polymer or elastomer material 4798 (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. Accordingly, each of the weight ports 4721, 4722, 4723 and 4724 may be partially or entirely surrounded by the elastic polymer material. Elastic polymer or elastomer material may be injected into the second interior cavity 4792 through one of the weight ports 4720 that may have an opening to the second interior cavity 4790 or another access port (not shown). For example, at least 50% of the second interior cavity 4790 may be filled with a TPE material to absorb shock, isolate vibration, and/or dampen noise when the golf club head 4700 strikes a golf ball via the face portion 4775. The apparatus, methods, and articles of manufacture described herein are not limited in this regard.

According to one example, the weight port region 4715 may be a separate part that may be constructed from the same material as or a different material than the golf club head 4710. For example, the weight port region 4715 may be constructed from a non-metallic composite material. Each of the weight ports 4721, 4722, 4723, and 4724 may include a threaded metallic sleeve for receiving a weight portion as described herein when the weight port region 4715 is constructed from a non-metallic material such as a composite material. The weight port region 4715 may be partially or fully filled with an elastic or elastomer material prior to or after attachment inside the recessed portion 4792 of the bottom portion 4740. The apparatus, methods, and articles of manufacture described herein are not limited in this regard.

In the example of FIGS. 49-52, a golf club head 4900 may include a body portion 4910. The golf club head 4900 may include a plurality of weight ports having a first set of weight ports 5020 (e.g., generally shown as weight ports 5021, 5022, 5023, 5024, and 5025) and a second set of weight ports 5120 (e.g., generally shown as weight ports 5121, 5122, 5123, 5124, and 5125). The golf club head 4900 also may include a plurality of weight portions (not shown). The weight ports 5020 and 5120 and the weight portions may be similar in many respects to the weight ports and weight portions, respectively, of the golf club heads described herein. Accordingly, a detailed description of the weight ports 5020 and 5120 and the weight portions of the golf club head 4900 is not provided. Alternatively, the golf club head 4900 may not include any weight ports or weight portions.

Figure 49:
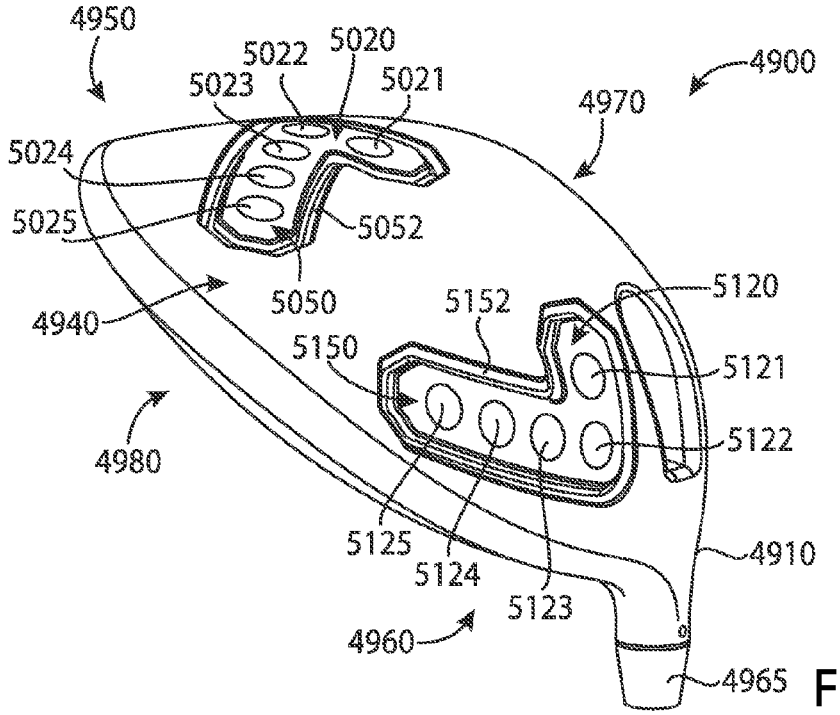
FIG. 49 depicts a bottom perspective view of another example golf club head.
Figure 50:
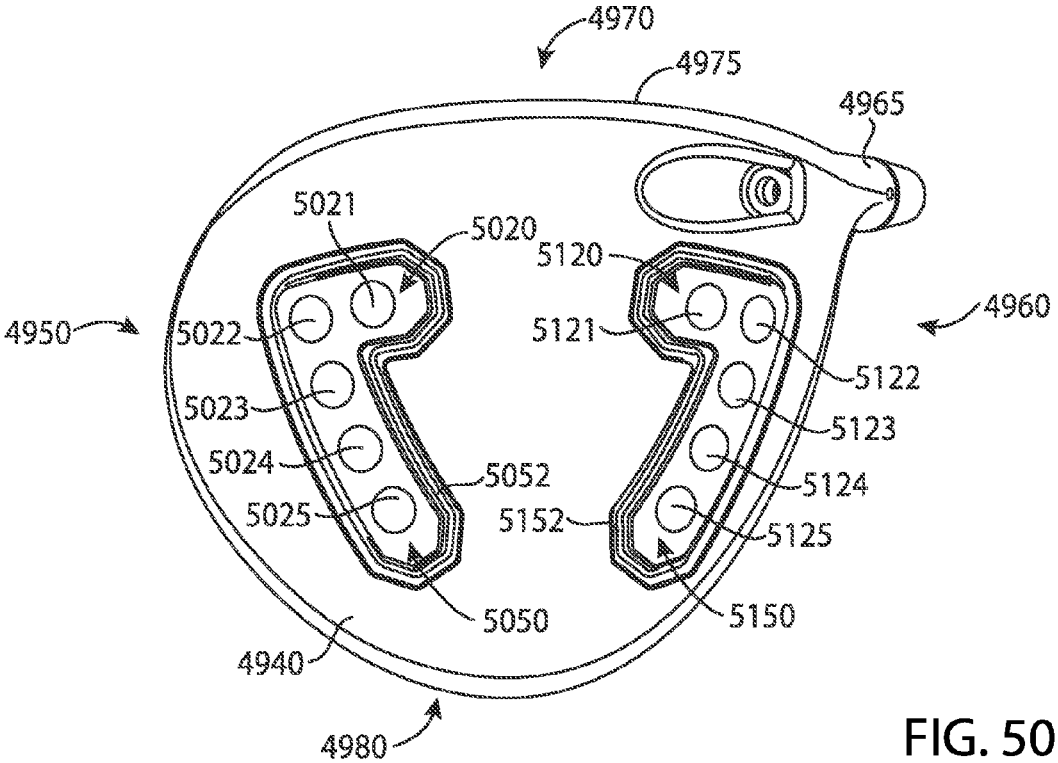
FIG. 50 depicts a bottom view of the golf club head of FIG. 49.

The body portion 4910 may include a top portion 4930, a bottom portion 4940, a toe portion 4950, a heel portion 4960, a front portion 4970, and a rear portion 4980. The bottom portion 4940 may include a skirt portion (not shown) defined as a side portion of the golf club head 4900 between the top portion 4930 and the bottom portion 4940 excluding the front portion 4970 and extending across a periphery of the golf club head 4900 from the toe portion 4950, around the rear portion 4980, and to the heel portion 4960. The bottom portion 4940 may include at least one weight port region. In the example of FIG. 49, the bottom portion 4940 includes a first weight port region 5050 having the first set of weight ports 5020 and a second weight port region 5150 having the second set of weight ports 5120.

The front portion 4970 may include a face portion 4975 to engage a golf ball (not shown). The body portion 4910 may also include a hosel portion 4965 to receive a shaft (not shown). Alternatively, the body portion 4910 may include a bore (not shown) instead of a hosel portion 4965. For example, the body portion 4910 may be made partially or entirely of an aluminum-based material, a magnesium-type material, a steel-based material, a titanium-based material, any combination thereof, or any other suitable material. In another example the body portion 4910 may be made partially or entirely of a non-metal material such as a ceramic material, a composite material, any combination thereof, or any other suitable material. The apparatus, methods, and articles of manufacture described herein are not limited in this regard.

The golf club head 4900 may have a club head volume greater than or equal to 300 cubic centimeters ($cm^3$ or cc). In one example, the golf club head 4900 may be about 460 cc. Alternatively, the golf club head 4900 may have a club head volume less than or equal to 300 cc. In particular, the golf club head 4900 may have a club head volume between 100 cc and 200 cc. The club head volume of the golf club head 4900 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 4900. Although FIG. 49 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). Accordingly, the club head 4900 may be any type of club head such as the club heads described herein. The apparatus, methods, and articles of manufacture described herein are not limited in this regard.

Each of the weight port regions 5050 and 5150 may be defined by a portion of the outer surface of the bottom portion 4940 such as all of the examples described herein and shown in 49 and 50. In one example, each of the weight port regions 5050 and 5150 may be defined by a recessed portion of the bottom portion 4940 (not shown). In one example, each of the weight port regions 5050 and 5150 may be defined by a protruded portion of the bottom portion 4940 (not shown in FIGS. 49-52, and example shown in FIG. 43). In one example, each of the weight port regions 5050 and 5150 may be a separate weight port region (not shown) that may be attached to and protrude from the bottom portion 4940. In one example, each of the weight port regions 5050 and 5150 may be a separate weight port region that may be attached inside a recess that may define each weight port region 5050 and 5150, respectively (not shown) on the bottom portion 4940. In the example of FIG. 49, each of the weight port regions 5050 and 5150 may be defined by a portion of the outer surface of the bottom portion 4940. Each of the weight port regions 5050 and 5150 may be defined by a recess or groove, a projection, or any type of demarcation (e.g., etching, painting, etc.) that may define each of the weight port regions 5050 and 5150, respectively. Alternatively, the weight port regions 5050 and 5150 may be defined by the weight ports of each weight port region 5050 and 5150 without any weight port region boundary structural or visual identification. In the example of FIG. 49, each of the weight port regions 5050 and 5150 may be defined by a boundary recess or boundary groove 5052 and 5152, respectively, which may provide structural reinforcement and/or rigidity to the bottom portion 4940 at and around the weight port regions 5050 and 5150. Instead of the boundary grooves 5052 and 5152, each of the weight port regions 5050 and 5150 may be defined by a boundary projection or boundary rib (not shown) that may provide structural reinforcement and/or rigidity to the bottom portion 4940 at and around the weight port regions 5050 and 5150. The apparatus, methods, and articles of manufacture described herein are not limited in this regard.

The first weight port region 5050 may have any shape. In the example of FIG. 49, the first weight port region 5050 is generally L-shaped. The first weight port region 5050 may be near the toe portion 4950 and include a first portion 5054 that may extend between the front portion 4970 and the rear portion 4980 (e.g., weight ports 5022, 5023, 5024, and 5025), and a second portion 5056 that may extend between the toe portion 4950 and the heel portion 4960 (e.g., weight ports 5021 and 5022). The first portion 5054 and the second portion 5056 may be transverse to resemble a generally L-shaped first weight port region 5050. Each of the first portion 5054 and the second portion 5056 may include any number of weight ports. In the example of FIGS. 49-52, the first portion 5054 may include two weight ports 5021 and 5022 that may extend in a direction between the toe portion 4950 and the heel portion 4960. The second portion 5056 may include four weight ports 5022, 5023, 5024 and 5025 that may extend in a direction between the face portion 4970 and the rear portion 4980. The weight ports of the first portion 5054 may extend along a line or a curve. The weight ports of the second portion 5056 may extend along a line or a curve. In one example, the weight ports of the first portion 5054 may extend in a direction that may generally correspond to the contour of the front portion 4970. In one example, the weight ports of the second portion 5056 may extend in a direction that may generally correspond to the contour of the toe portion 4950. Accordingly, the first weight port region 5050 may be defined by linear or curved sides that may generally define a generally linear or curved L-shaped region on the bottom portion 4940. A generally L-shaped region may be defined by two regions that may be generally transverse and form a right angle, a large acute angle (e.g., greater than 45°) or a small obtuse angle (e.g., less than 135°) relative to each other. The apparatus, methods, and articles of manufacture described herein are not limited in this regard.

Each weight port 5021, 5022, 5023, 5024, and 5025 of the first weight port region 5050 may be associated with a first port diameter and configured to receive at least one weight portion of a plurality of weight portions. Adjacent weight ports of the first weight port region 5050 may be separated by any distance. In one example, two adjacent weight ports of the first weight port region 5050 may be separated by less than or equal to a first port diameter, which may be the diameter of any of the two adjacent weight ports. The port diameter associated with each weight port of the first weight port region 5050, the distance between adjacent weight ports of the first weight port region 5050, and the configuration of each weight portion of the plurality of weight portions may be similar in many respects to the example weight ports and weight portions described herein. Accordingly, a detailed description of the weight ports of the first weight port region 5050 and the weight portions received in the weight ports of the first weight port region 5050 is not provided. The apparatus, methods, and articles of manufacture described herein are not limited in this regard.

The second weight port region 5150 may have any shape. In the example of FIG. 49, the second weight port region 5150 is generally L-shaped. The second weight port region 5150 may be near the heel portion 4960 and may include a first portion 5154 that may extend between the front portion 4970 and the rear portion 4980 (e.g., weight ports 5122, 5123, 5124, and 5125), and a second portion 5156 that may extend between the toe portion 4950 and the heel portion 4960 (e.g., weight ports 5121 and 5122). The first portion 5154 and the second portion 5156 may be transverse to define a generally L-shaped second weight port region 5150. Each of the first portion 5154 and the second portion 5156 may include any number of weight ports. In the example of FIGS. 49-52, the first portion 5154 may include two weight ports 5121 and 5122 that may extend in a direction between the toe portion 4950 and the heel portion 4960. The second portion 5156 may include four weight ports 5122, 5123, 5124 and 5125 that may extend in a direction between the face portion 4970 and the rear portion 4980. The weight ports of the first portion 5154 may extend along a line or a curve. The weight ports of the second portion 5156 may extend along a line or a curve. In one example, the weight ports of the first portion 5154 may extend in a direction that may generally correspond to the contour of the front portion 4970. In one example, the weight ports of the second portion 5156 may extend in a direction that may generally correspond to the contour of the heel portion 4960. Accordingly, the second weight port region 5150 may be defined by linear or curved sides that may generally define a generally linear or curved L-shaped region on the bottom portion 4940. A generally L-shaped region may be defined by two regions that may be generally transverse and form a right angle, a large acute angle (e.g., greater than 45°) or a small obtuse angle (e.g., less than 135°) relative to each other. The apparatus, methods, and articles of manufacture described herein are not limited in this regard.

Each weight port 5121, 5122, 5123, 5124, and 5125 of the second weight port region 5150 may be associated with a second port diameter and configured to receive at least one weight portion of a plurality of weight portions. Adjacent weight ports of the second weight port region 5150 may be separated by any distance. In one example, two adjacent weight ports of the second weight port region 5150 may be separated by less than or equal to the second port diameter, which may be the port diameter of any of the two adjacent weight ports. The second port diameter may be similar to the first port diameter or different from the first port diameter. In one example, the first port diameter may be similar to the second port diameter so that each weight portion of the plurality of weight portions may be interchangeably used in the weight ports of the first weight port region 5050 and the second weight port region 5150. The port diameter associated with each weight port of the second weight port region 5150, the distance between adjacent weight ports of the second weight port region 5150, and the configuration of each weight portion of the plurality of weight portions may be similar in many respects to the example weight ports and weight portions described herein. Accordingly, a detailed description of the weight ports of the second weight port region 5150 and the weight portions received in the weight ports of the second weight port region 5150 is not provided. The apparatus, methods, and articles of manufacture described herein are not limited in this regard.

The body portion 4910 may be a hollow body including an interior cavity (not shown) that may generally define the volume of the body portion 4910. Alternatively, the body portion 4910 may include a plurality of interior cavities that may generally define the volume of the body portion 4910. The configuration of any interior cavities of the body portion 4910 may be similar in many respects to the one or more interior cavities of the golf club heads described herein. Furthermore, any interior cavity of the body portion 4910 may be unfilled (i.e., empty space), partially filled, or entirely filled with an elastic polymer or elastomer material in a similar manner as any of the golf club heads described herein. Any one or a plurality of weight ports of the weight port regions 5050 and/or 5150 may be partially or entirely surrounded by an elastic polymer or elastomer material. In one example, one or more of the weight ports of the weight port regions 5050 and/or 5150 may be proximate to or surrounded by an elastic polymer material similar to the examples shown in FIGS. 29 and 30. In one example, one or more of the weight ports of the weight port regions 5050 and/or 5150 may be proximate to or surrounded by an elastic polymer material similar to the examples shown in FIGS. 31 and 32. In one example, one or more of the weight ports of the weight port regions 5050 and/or 5150 may be proximate to or surrounded by an elastic polymer material similar to the examples shown in FIGS. 47 and 48. A weight port having a portion thereof covered by an elastic polymer material and a portion thereof exposed to an internal cavity (not shown) of the body portion 4910 may be defined as a weight port being partially surrounded by an elastic polymer material. For example, as shown in FIGS. 30 and 32, one side of a weight port may be covered by an elastic polymer material, hence the weight port may be partially surrounded by an elastic polymer material. Alternatively, a weight port that may be entirely surrounded by an elastic polymer material in an internal cavity (not shown) of the body portion 4910 may be defined as a weight port being fully surrounded by an elastic polymer material. For example, as shown in FIG. 47, a weight port may be fully surrounded by an elastic polymer material in an internal cavity of the body portion 4910. The configuration of any interior cavities of the body portion 4910 and/or the weight ports 5050 and/or 5150 may be similar in many respects to the one or more interior cavities of the golf club heads described herein. Furthermore, any interior cavity of the body portion 4910 and/or any portion of an interior cavity that is near or surrounding any of the weight ports 5050 and/or 5150 may be unfilled (i.e., empty space), partially filled, or entirely filled with an elastic polymer or elastomer material in a similar manner as any of the golf club heads described herein. Any interior cavity of the body portion 4910 may be filled with an elastic polymer material through one or more weight ports as described in detail herein. Therefore, a detailed description of any interior cavities of the body portion 4090 and the filling of such interior cavities with an elastic polymer or elastomer material is not provided. The apparatus, methods, and articles of manufacture described herein are not limited in this regard.

Figure 51:
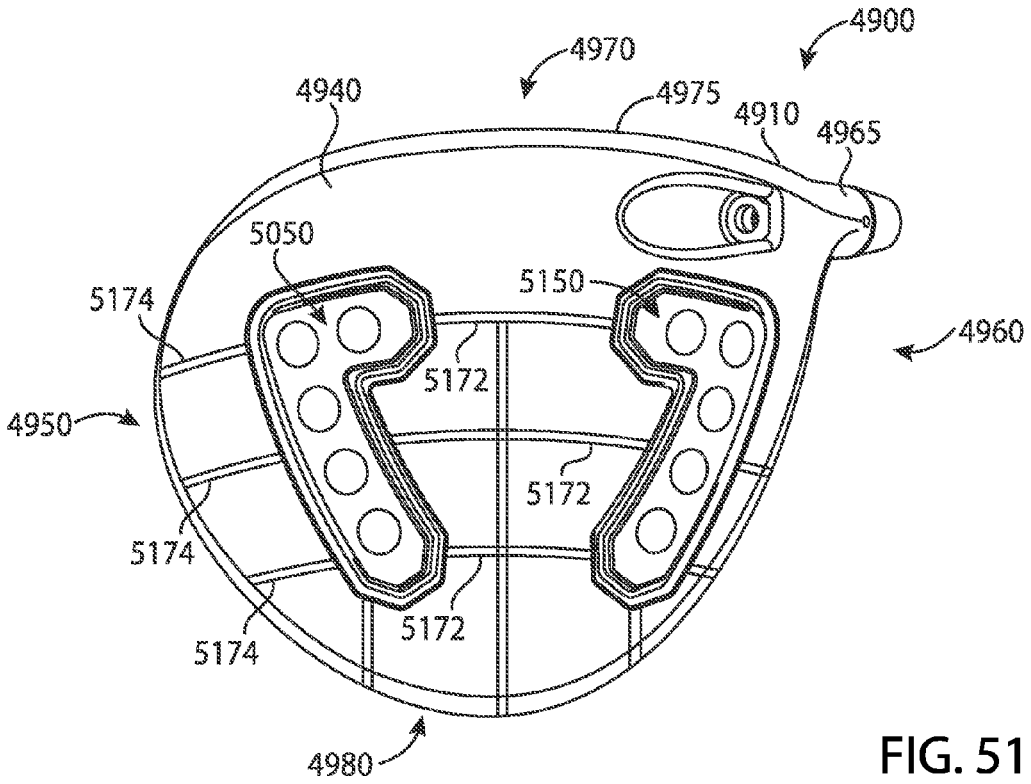
FIG. 51 depicts a bottom cross-sectional view of the golf club head of FIG. 49.
Figure 52:
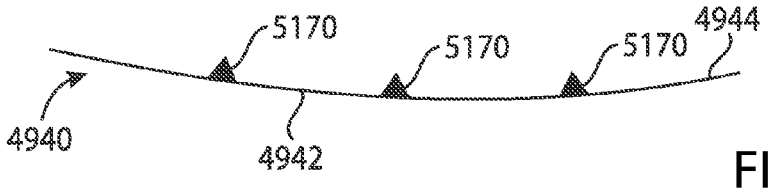
FIG. 52 depicts a schematic cross-sectional view of a portion of a bottom portion of the golf club head of FIG. 51.

In one example shown in FIGS. 51 and 52, the bottom portion 4940 may include an outer surface 4942 and an inner surface 4944. The inner surface 4942 may include a plurality of support portions 5170. Alternatively or in conjunction with the inner surface 4944, the outer surface 4942 may include a plurality of support portions (not shown). For example, at least one of the support portions may be an elongated recessed rib (e.g., a groove, not shown) or an elongated projecting rib (shown in FIG. 52). The plurality of support portions 5170 may include one or more first support portions 5172 extending between the toe portion 4950 and heel portion 4960. The plurality of support portions 5170 may include one or more second support portions 5174 extending between the front portion 4970 and rear portion 4980. At least one of the first support portions may intersect with at least one of the second support portions. In one example, intersecting first support portions and second support portions may provide a truss-like structure that may function similar to a truss to enhance structural reinforcement and rigidity of the bottom portion 4940. The apparatus, methods, and articles of manufacture described herein are not limited in this regard.

In one example, the bottom portion 4940 may include at least three of the first support portions 5172 that may extend between the toe portion 4950 and the heel portion 4960. The first support portions 5172 may be similarly spaced apart and/or generally parallel and configured to intersect with the first and second weight port regions 5050 and 5150. Accordingly, the first support portions 5172 may provide structural reinforcement and rigidity to the weight port regions 5050 and 5150 and/or areas of the bottom portion 4940 near the weight port regions 5050 and 5150. The first support portions 5172 may have a curvature similar to either the curvature of the front portion 4970 or the rear portion 4980. In the example of FIG. 51, the first support portions 5172 have a similar curvature at the curvature of the front portion 4970, which may provide structural reinforcement and rigidity to the bottom portion 4940 when the face portion 4975 strikes a golf ball (not shown). Alternatively, the first support portions 5172 may have any configuration or curvature or may be linear. In one example, the first support portions 5172 may be defined by radial lines (not shown) that converge at a point (not shown) on or outside of the bottom portion 4940. The apparatus, methods, and articles of manufacture described herein are not limited in this regard.

In one example, the bottom portion 4940 may include at least three of the second support portions 5174 that may extend between the front portion 4970 and the rear portion 4980. The second support portions 5174 may be similarly spaced apart and/or generally parallel. At least one or more of the second support portions 5174 may be configured to intersect with the first and second weight port regions 5050 and 5150. Accordingly, the second support portions 5174 may provide structural reinforcement and rigidity to the weight port regions 5050 and 5150 and/or areas of the bottom portion 4940 near the weight port regions 5050 and 5150. The first support portions 5174 may have a curvature similar to either the curvature of the toe portion 4950 or the heel portion 4960. In the example of FIG. 51, the second support portions 5174 extend generally linearly between the rear portion 4980 and the front portion 4970 yet follow the curvature of the bottom portion 4940 from the rear portion 4980 to the front portion 4970. The second support portions 5174 may provide structural reinforcement and rigidity to the bottom portion 4940 when the face portion 4975 strikes a golf ball (not shown). Alternatively, the second support portions 5174 may have any configuration. In one example, the second support portions 5174 may be defined by radial lines (not shown) that converge at a point (not shown) on or outside of the bottom portion 4940. The apparatus, methods, and articles of manufacture described herein are not limited in this regard.

Figure 53:
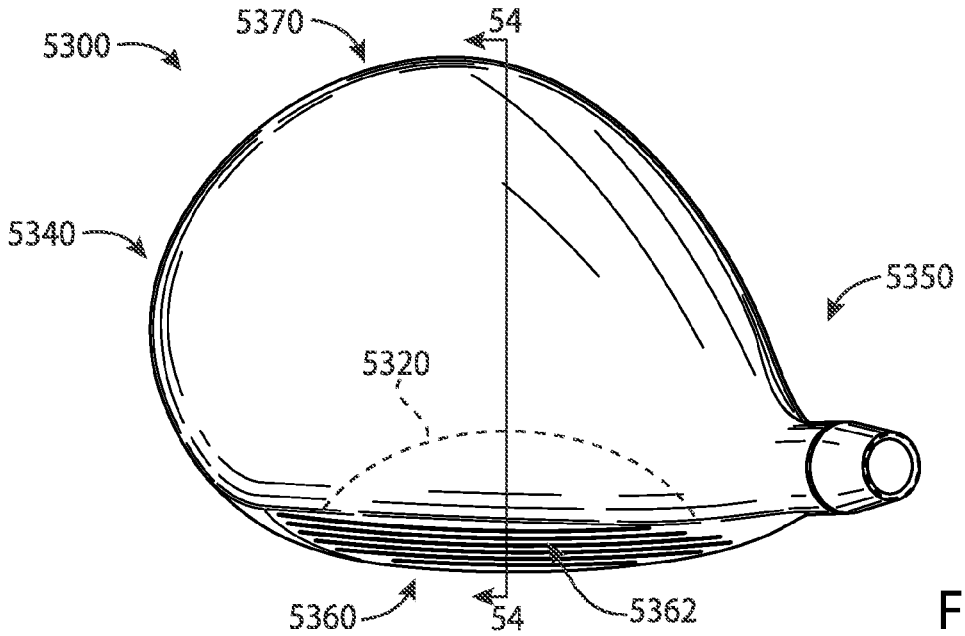
FIG. 53 depicts a top view of a golf club head according to another embodiment of the apparatus, methods, and articles of manufacture described herein.
Figure 54:
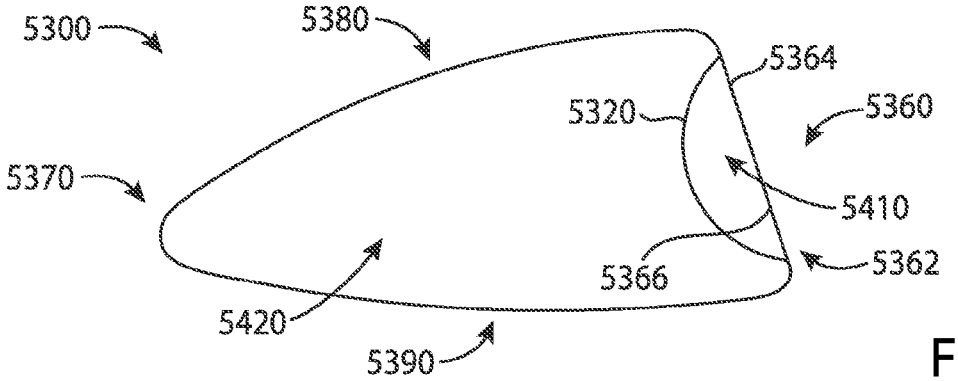
FIG. 54 depicts a schematic cross-sectional view of the example golf club head of FIG. 53 along line 54-54.
Figure 55:
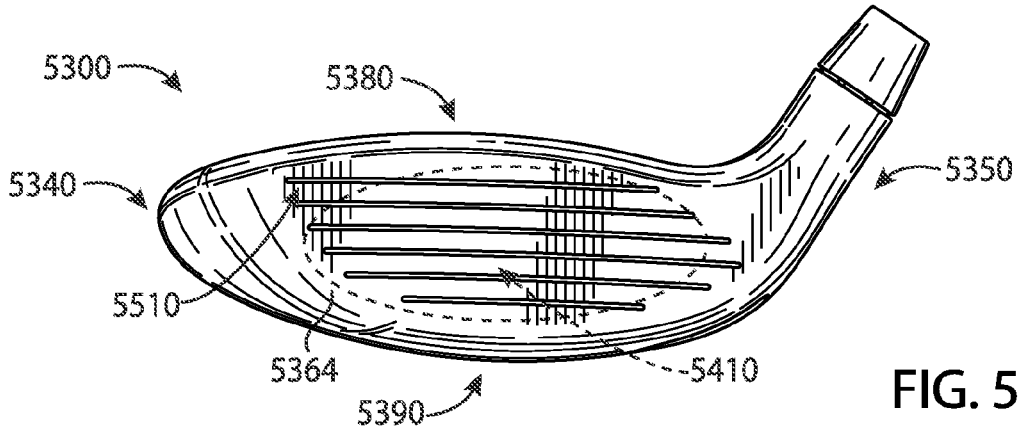
FIG. 55 depicts a front view of the example golf club head of FIG. 53.

While the above examples may describe a certain type of golf club head, the apparatus, methods, and articles of manufacture described herein may be applicable to other types of golf club heads. Referring to FIGS. 53-55, for example, a golf club head 5300 may include a body portion 5310 and a cavity wall portion 5320. The golf club head 5300 may have a club head volume greater than or equal to 300 cubic centimeters ($cm^3$ or cc). In one example, the golf club head 5300 may be about 460 cc. Alternatively, the golf club head 5300 may have a club head volume less than or equal to 300 cc. For example, the golf club head 5300 may have a club head volume between 100 cc and 200 cc. The club head volume of the golf club head 5300 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 100. Although FIGS. 53-55 may depict a particular type of club head (e.g., a fairway wood-type club head), the apparatus, methods, and articles of manufacture described herein may be applicable to other types of club head (e.g., a driver-type club head, a hybrid-type club head, an iron-type club head, a putter-type club head, etc.). The apparatus, methods, and articles of manufacture described herein are not limited in this regard.

The body portion 5310 may include a toe portion 5340, a heel portion 5350, a front portion 5360, a rear portion 5370, a top portion 5380 (e.g., a crown portion), and a bottom portion 5390 (e.g., a sole portion). The body portion 5310 may be a hollow body made partially or entirely of an aluminum-based material, a magnesium-type material, a steel-based material, a titanium-based material, any other suitable material, or any combination thereof. In another example, the body portion 5310 may be made partially or entirely of a non-metal material such as a ceramic material, a composite material, any other suitable material, or any combination thereof. The front portion 5360 may include a face portion 5362 (e.g., a strike face). The face portion 5362 may include a front surface 5364 and a back surface 5366. The front surface 5364 may include a plurality of grooves, generally shown as 5510 in FIG. 55.

The cavity wall portion 5320 may form a first interior cavity 5410 and a second interior cavity 5420 within the body portion 5310. For example, the cavity wall portion 5320 may be made partially or entirely of an aluminum-based material, a steel-based material, any other suitable material, or any combination thereof. In another example, the cavity wall portion 5320 may be made partially or entirely of a non-metal material such as a ceramic material, a composite material, any other suitable material, or any combination thereof. The first interior cavity 5410 may be associated with a first volume, and the second interior cavity 5420 may be associated with a second volume. In one example, the first volume may be less than the second volume. Further, the first volume may be less than or equal to 50% of the second volume.

As illustrated in FIG. 54, for example, the cavity wall portion 5320 may extend from the back surface 5366 of the face portion 5362. In one example, the cavity wall portion 5320 may extend no more than one inch from the back surface 5366. In another example, the cavity wall portion 5320 may extend no more than two inches from the back surface 5366. The cavity wall portion 5320 may be a single curved wall section. In particular, the cavity wall portion 5320 may have a convex arc profile relative to the back surface 5366 (e.g., C shape) to form a dome-like structure with an elliptical base (e.g., FIG. 55) or a circular base on the back surface 5366. In another example, the cavity wall portion 5320 may form a cone-like structure or a cylinder-like structure with the body portion 5310. Alternatively, the cavity wall portion 5320 may be a concave arc profile relative to the back surface 5366. The apparatus, methods, and articles of manufacture described herein are not limited in this regard.

The first interior cavity 5410 may be partially or entirely filled with an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, dampen noise, and/or provide structural support. The elastic polymer material may be injected into the first interior cavity 5410 via an injection molding process via a port on the face portion 5362. For example, at least 50% of the first interior cavity 5410 may be filled with a TPE material to absorb shock, isolate vibration, dampen noise, and/or provide structural support when the golf club head 5300 strikes a golf ball via the face portion 5362. With the support of the cavity wall portion 5320 to form the first interior cavity 5410 and filling at least a portion of the first interior cavity 5410 with an elastic polymer material, the face portion 5362 may be relatively thin without degrading the structural integrity, sound, and/or feel of the golf club head 5300. In one example, the face portion 5362 may have a thickness of less than or equal to 0.075 inch (e.g., a distance between the front surface 5364 and the back surface 5366). In another example, the face portion 5362 may have a thickness of less than or equal to 0.060 inch. In yet another example, the face portion 5362 may have a thickness of less than or equal to 0.050 inch. Further, the face portion 5362 may have a thickness of less than or equal to 0.030 inch. The apparatus, methods, and articles of manufacture described herein are not limited in this regard.

Figure 56:
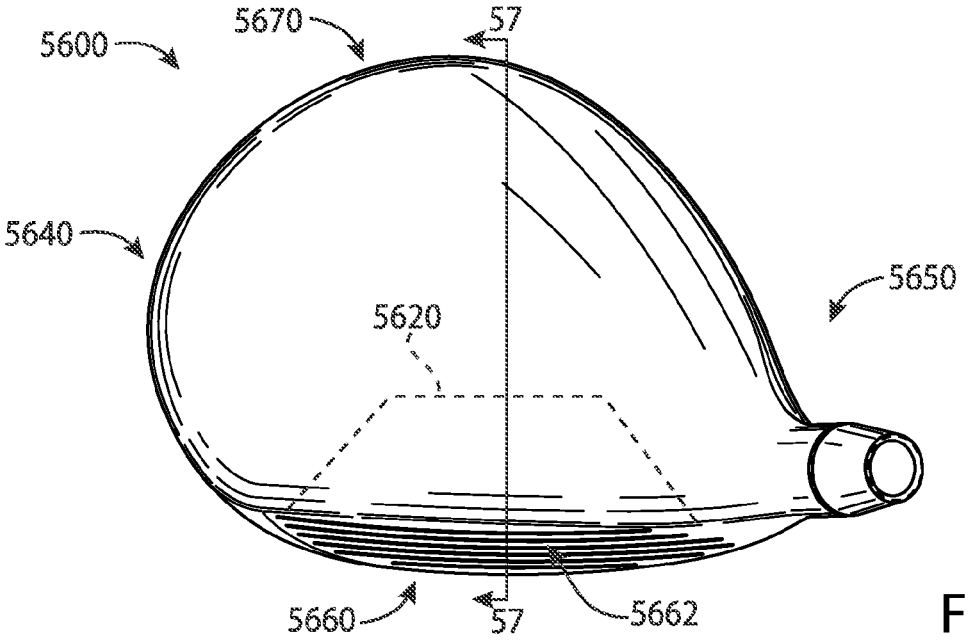
FIG. 56 depicts a top view of a golf club head according to yet another embodiment of the apparatus, methods, and articles of manufacture described herein.
Figure 57:
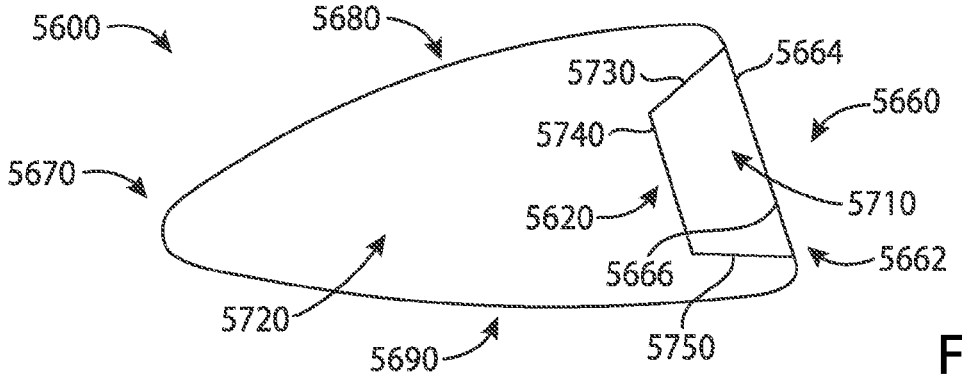
FIG. 57 depicts a schematic cross-sectional view of the example golf club head of FIG. 56 along line 57-57.
Figure 58:
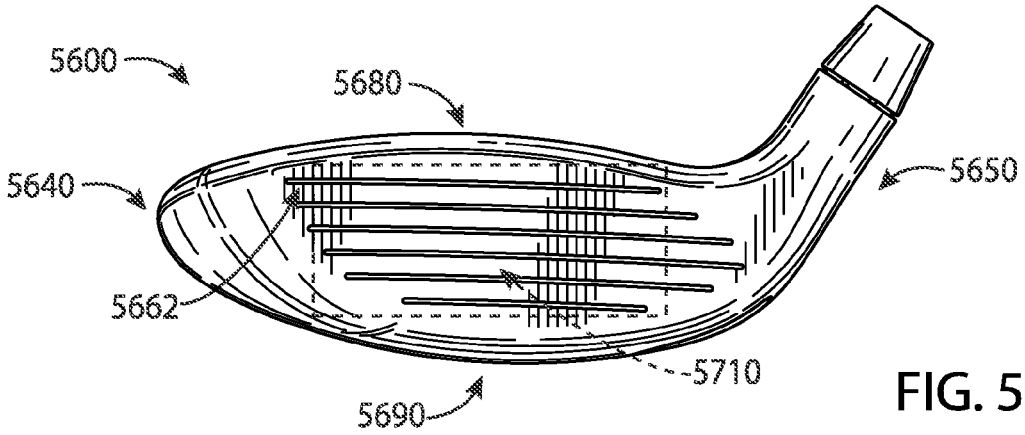
FIG. 58 depicts a front view of the example golf club head of FIG. 56.

The cavity wall portion 5320 may include multiple sections. Turning to FIGS. 56-58, for example, a golf club head 5600 may include a body portion 5610 and a cavity wall portion 5620. The body portion 5610 may include a toe portion 5640, a heel portion 5650, a front portion 5660, a rear portion 5670, a top portion 5680 (e.g., a crown portion), and a bottom portion 5690 (e.g., a sole portion). The front portion 5660 may include a face portion 5662 (e.g., a strike face) with a front surface 5664 and a back surface 5666. The cavity wall portion 5620 may extend from the back surface 5666 to form a first interior cavity 5710 and a second interior cavity 5720 within the body portion 5610. The cavity wall portion 5620 may include two or more wall sections, generally shown as 5730, 5740, and 5750 in FIG. 57. The cavity wall portion 5620 may form a truncated pyramid-like structure with a rectangular base (e.g., FIG. 58) or a square base on the back surface 5666. Alternatively, the cavity wall portion 5620 may form a cuboid-like structure (i.e., with a rectangular base) or a cuboid-like structure (i.e., with a square base) on the back surface 5666. In another example, the cavity wall portion 5620 may form a square-based, pyramid-like structure on the back surface 5666. In yet another example, the cavity wall portion 5620 may form a triangular-based, pyramid-like structure or a triangular prism-like structure on the back surface 5666. Similar to the first interior cavity 5410 (FIGS. 53-55), the first interior cavity 5710 may be partially or entirely filled with an elastic polymer or elastomer material (e.g., a TPE material, a TPU material, etc.). The elastic polymer material may be injected into the first interior cavity 5710 via an injection molding process via a port on the face portion 5662. The apparatus, methods, and articles of manufacture described herein are not limited in this regard.

Figure 59:
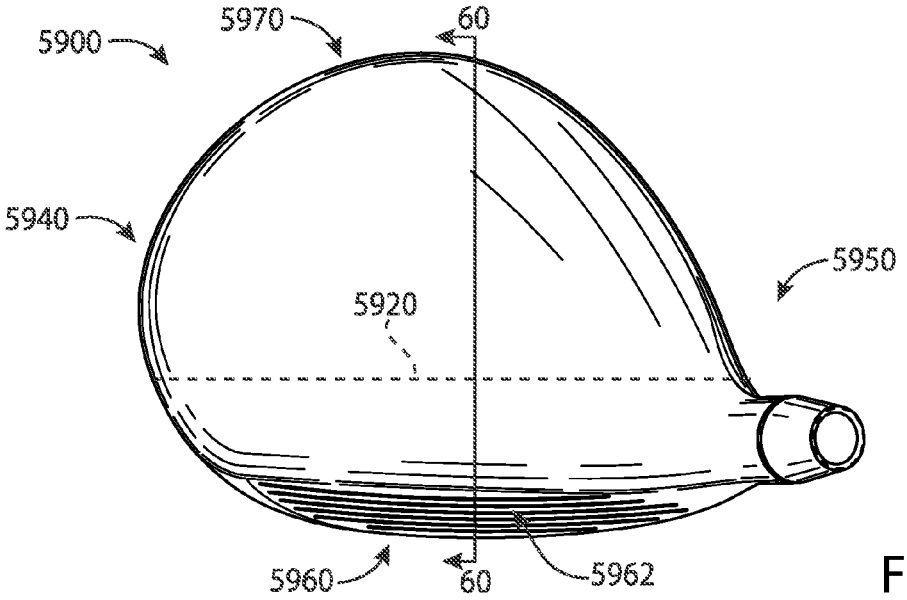
FIG. 59 depicts a top view of a golf club head according to yet another embodiment of the apparatus, methods, and articles of manufacture described herein.
Figure 60:
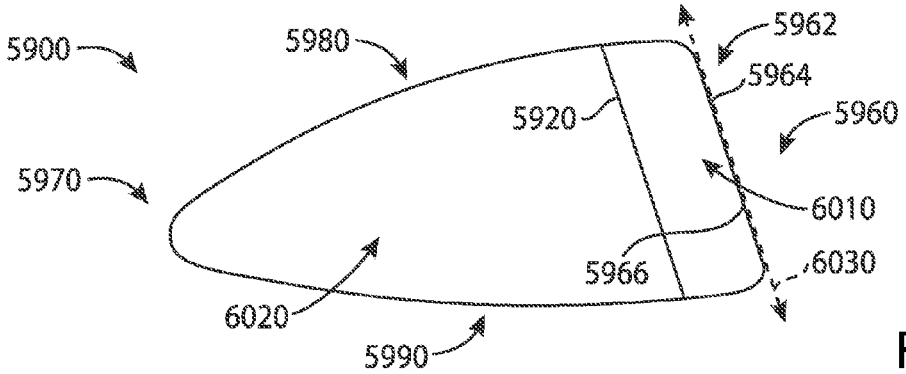
FIG. 60 depicts a schematic cross-sectional view of the example golf club head of FIG. 59 along line 60-60.

As illustrated in FIGS. 59 and 60, for example, a golf club head 5900 may include a body portion 5910 and a cavity wall portion 5920. The body portion 5910 may include a toe portion 5940, a heel portion 5950, a front portion 5960, a rear portion 5970, a top portion 5980 (e.g., a crown portion), and a bottom portion 5990 (e.g., a sole portion). The front portion 5960 may include a face portion 5962 (e.g., a strike face) with a front surface 5964 and a back surface 5966. The face portion 5962 may be associated with a loft plane 6005 that defines the loft angle of the golf club head 5900.

Figure 61:
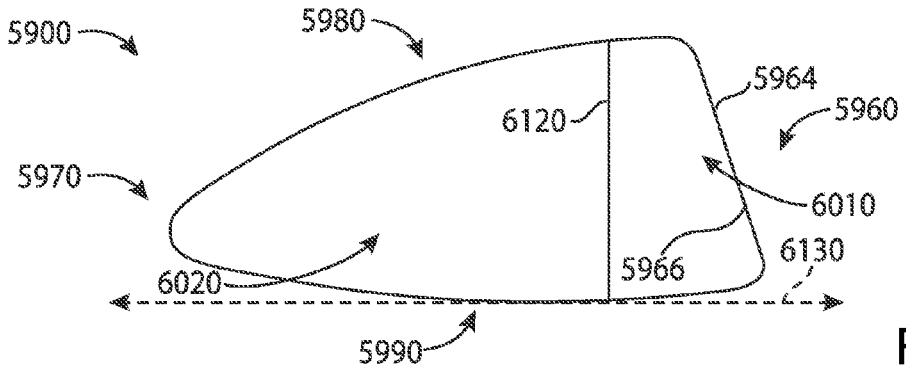
FIG. 61 depicts a schematic cross-sectional view of the example golf club head of FIG. 59 along line 60-60 according to another embodiment of the apparatus, methods, and articles of manufacture described herein.

The cavity wall portion 5920 may be a single flat wall section. In particular, the cavity wall portion 5920 may extend between the toe portion 5940 and the heel portion 5950 and between the top portion 5980 and the bottom portion 5990 to form a first interior cavity 6010 and a second interior cavity 6020 within the body portion 5910. The cavity wall portion 5920 may be parallel or substantially parallel to the loft plane 6005. Alternatively as shown in FIG. 61, a cavity wall portion 6120 may be perpendicular or substantially perpendicular to a ground plane 6130. Similar to the first interior cavities 5410 (FIGS. 53-55) and 5710 (FIGS. 56-58), the first interior cavity 6010 may be partially or entirely filled with an elastic polymer or elastomer material. The elastic polymer material may be injected into the first interior cavity 6010 via an injection molding process via a port on the face portion 5962 and/or the bottom portion 5990. The apparatus, methods, and articles of manufacture described herein are not limited in this regard.

Alternatively, the cavity wall portion 5920 may extend between the bottom portion 5990 and a top-and-front transition region (i.e., a transition region between the top portion 5980 and the front portion 5970) so that the cavity wall portion 5920 and the loft plane 6030 may not be parallel to each other. In another example, the cavity wall portion 5920 may extend between the top portion 5980 and a bottom-and-front transition region (i.e., a transition region between the bottom portion 5990 and the front portion 5970) so that the cavity wall portion 5920 and the loft plane 6030 may be not parallel to each other. Although FIGS. 59-61, may depict the cavity wall portions 5920 and 6120 being flat or substantially flat, the cavity wall portions 5920 and/or 6120 may be concaved or convexed relatively to the face portion 5962. The apparatus, methods, and articles of manufacture described herein are not limited in this regard.

While above examples may describe a cavity wall portion dividing an interior cavity of a hollow body portion to form two separate interior cavities with one interior cavity partially or entirely filled with an elastic polymer material, the apparatus, methods, and articles of manufacture described herein may include two or more cavity wall portions dividing an interior cavity of a hollow body portion to form three or more separate interior cavities with at least two interior cavities partially or entirely filled with an elastic polymer material. In one example, one interior cavity may be partially or entirely filled with a TPE material whereas another interior cavity may be partially or entirely filled with a TPU material. The apparatus, methods, and articles of manufacture described herein are not limited in this regard.

The terms "and" and "or" may have both conjunctive and disjunctive meanings. The terms "a" and "an" are defined as one or more unless this disclosure indicates otherwise. The term "coupled" and any variation thereof refer to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby", "neighboring", etc., and such terms may be used interchangeably as appearing in this disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the USGA, the R&A, etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Further, while the above examples may be described with respect to golf clubs, the apparatus, methods and articles of manufacture described herein may be applicable to other suitable types of sports equipment such as a fishing pole, a hockey stick, a ski pole, a tennis racket, etc.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf club head comprising:

a hollow body portion having a first interior cavity portion, a toe portion, a heel portion, a top portion, a bottom portion, a rear portion, and a front portion having a face portion;

a second interior cavity portion extending at or proximate to the bottom portion; and a plurality of ports on the hollow body portion, each port extending into the second interior cavity portion, the plurality of ports comprising:

a first port region near the toe portion and having a plurality of first ports of the plurality of ports, the first port region being substantially L-shaped; and a second port region near the heel portion and having a plurality of second ports of the plurality of ports, the second port region being substantially L-shaped;

wherein each port of the plurality of first ports or the plurality of second ports is configured to receive a weight portion of a plurality of weight portions, and wherein the second interior cavity portion is at least 50% filled with an elastic polymer material.

2. A golf club head as defined in claim 1, wherein each port is fully surrounded by the elastic polymer material.

3. A golf club head as defined in claim 1, wherein the second interior cavity portion is within the hollow body portion and separate from the first interior cavity portion.

4. A golf club head as defined in claim 1, wherein the first port region comprises a first protruded portion of the bottom portion, and wherein the second port region comprises a second protruded portion of the bottom portion.

5. A golf club head as defined in claim 1, wherein the first port region has a first portion of the first port region extending between the front portion and the rear portion and a second portion of the first port region extending between the toe portion and the heel portion and being transverse to the first portion of the first port region; and wherein the second port region has a first portion of the second port region extending between the front portion and the rear portion and a second portion of the second port region extending between the toe portion and the heel portion and being transverse to the first portion of the second port region.

6. A golf club head as defined in claim 1 further comprising a plurality of support portions in the hollow body portion extending between the toe portion and the heel portion.

7. A golf club head as defined in claim 1 further comprising a plurality of support portions in the hollow body portion extending between the front portion and the rear portion.

8. A golf club head comprising:

a hollow body portion having a toe portion, a heel portion, a top portion, a bottom portion, a rear portion, and a front portion having a face portion, a cavity portion extending near at least one of a region between the toe portion and the front portion, a region between the heel portion and the front portion, a region between the top portion and the front portion, a region between the bottom portion and the front portion, or the bottom portion, and a port region located at or proximate to the bottom portion, the port region comprising:

a first port region near the toe portion and having a plurality of first ports of the plurality of ports, the first port region being substantially L-shaped; and a second port region near the heel portion and having a plurality of second ports of the plurality of ports, the second port region being substantially L-shaped;

wherein each port of the plurality of first ports or the plurality of second ports is configured to receive a weight portion of a plurality of weight portions, and wherein the cavity portion is at least 50% filled with an elastic polymer material.

9. A golf club head as defined in claim 8, wherein each port is at least partially surrounded by the elastic polymer material.

10. A golf club head as defined in claim 8, wherein the first port region comprises a first protruded portion of the bottom portion; and wherein the second port region comprises a second protruded portion of the bottom portion.

11. A golf club head as defined in claim 8 further comprising a plurality of support portions in the hollow body portion extending between the toe portion and the heel portion.

12. A golf club head as defined in claim 8 further comprising a plurality of support portions in the hollow body portion extending between the front portion and the rear portion.

13. A golf club head comprising:

a hollow body portion having a toe portion, a heel portion, a top portion, a bottom portion, a rear portion, and a front portion having a face portion, and a port region located at or proximate to the bottom portion, a first port region near the toe portion and having a plurality of first ports of the plurality of ports, the first port region being substantially L-shaped; and a second port region near the heel portion and having a plurality of second ports of the plurality of ports, the second port region being substantially L-shaped;

wherein each port of the plurality of first ports or the plurality of second ports is configured to receive a weight portion of a plurality of weight portions, and an elastic polymer material at least partially surrounding each port of the plurality of first ports and the plurality of second ports.

14. A golf club head as defined in claim 13 further comprising:

a first cavity portion at least 50% filled with the elastic polymer material; and a second cavity portion at least 50% filled with the elastic polymer material, wherein the plurality of first ports extend from the bottom portion into the first cavity, and wherein the plurality of second ports extend from the bottom portion into the second cavity.

15. A golf club head as defined in claim 13, wherein each port of the plurality of first ports and the plurality of second ports is fully surrounded by the elastic polymer material.

16. A golf club head as defined in claim 13 further comprising a plurality of support portions in the hollow body portion extending along the bottom portion.

17. A golf club head as defined in claim 13 further comprising a plurality of support portions in the hollow body portion extending between the toe portion and the heel portion or between the front portion and the rear portion.

* * * * *